US008020347B2

(12) United States Patent
Mower et al.

(10) Patent No.: US 8,020,347 B2
(45) Date of Patent: Sep. 20, 2011

(54) MODULAR ENCLOSURE

(75) Inventors: Barry D. Mower, Layton, UT (US); Brent Steed, Syracuse, UT (US); Jay Calkin, Clinton, UT (US); Neil Watson, Layton, UT (US); Robert A. Astle, Farmington, UT (US); L. Curtis Strong, Clearfield, UT (US); Rich Howe, Pleasant View, UT (US); David C. Winter, Layton, UT (US); Kent Ashby, Logan, UT (US)

(73) Assignee: Lifetime Products, Inc., Clearfield, UT (US)

( * ) Notice: Subject to any disclaimer, the term of this patent is extended or adjusted under 35 U.S.C. 154(b) by 1007 days.

(21) Appl. No.: 11/432,825

(22) Filed: May 11, 2006

(65) Prior Publication Data

US 2006/0277852 A1 Dec. 14, 2006

Related U.S. Application Data

(60) Provisional application No. 60/680,246, filed on May 11, 2005, provisional application No. 60/680,279, filed on May 11, 2005.

(51) Int. Cl.
*E04H 1/00* (2006.01)

(52) U.S. Cl. ..... 52/79.1; 52/79.5; 52/93.1

(58) Field of Classification Search ..... 52/79.12, 52/93.1, 287.1, 79.9, 459, 460, 282.4
See application file for complete search history.

(56) References Cited

U.S. PATENT DOCUMENTS

| | | | |
|---|---|---|---|
| 383,353 | A | 5/1887 | Baker |
| 1,300,439 | A | 4/1919 | Madison |
| 1,516,096 | A | 11/1924 | Hahn |
| 1,736,548 | A | 11/1929 | Pye |
| 1,828,193 | A | 10/1931 | Levin |
| 2,107,418 | A | 2/1938 | Keller |

(Continued)

FOREIGN PATENT DOCUMENTS

| | | |
|---|---|---|
| CA | 2365055 | 3/2000 |

(Continued)

OTHER PUBLICATIONS

Keter North America; *Owner 's Manual, Apex 4x6*; date created: May 15, 2004 ; date modified: May 15, 2004.

(Continued)

*Primary Examiner* — Jeanette E Chapman
*Assistant Examiner* — Daniel Kenny
(74) *Attorney, Agent, or Firm* — Workman Nydegger

(57) ABSTRACT

A modular enclosure, such as a shed, may include sidewalls and a roof. The roof, for example, may include one or more roof panels. The roof may also include a truss that is sized and configured to support the roof panels. The shed may also include one or more support beams that may be connected to the truss and may be connected to one or more panels. The shed may include one or more brackets used to connect a pair of panels that are positioned at an angle to form a corner of the shed. The shed may also include a cover, which may include one or more receiving portions sized and configured to receive at least a portion of the brackets. A plurality of roof panels may be positioned within a shipping container to form storage areas or cavities sized and configured to receive all or at least a portion of one or more floor panels.

22 Claims, 30 Drawing Sheets

U.S. PATENT DOCUMENTS 2,304,145 A 12/1942 Borchers
D142,945 S 11/1945 Borchers
2,388,297 A 11/1945 Slaughter
2,766,855 A 10/1956 Johnson et al.
2,816,329 A 12/1957 Sogaro
2,863,185 A 12/1958 Riedi
2,922,344 A 1/1960 Meissner
3,077,426 A 2/1963 Johnston
3,090,087 A 5/1963 Miller
3,173,383 A 3/1965 Eggert
3,194,596 A 7/1965 Jakeway
3,199,258 A 8/1965 Jentoft et al.
3,200,547 A 8/1965 Johnson
3,222,829 A 12/1965 Bening
3,234,700 A 2/1966 Creveling
D204,088 S 3/1966 Adler
3,343,321 A 9/1967 Axelsson
3,344,564 A 10/1967 Siegal
3,401,494 A 9/1968 Anderson
3,423,891 A 1/1969 Burris
3,436,881 A 4/1969 Schlecht
3,438,312 A 4/1969 Becker et al.
3,488,905 A 1/1970 Campbell
3,521,414 A 7/1970 Malissa
3,543,456 A 12/1970 Gregoire
3,563,582 A 2/1971 Shroyer
3,566,554 A 3/1971 Schaffer et al.
3,597,858 A 8/1971 Ogsbury
3,700,213 A 10/1972 Blease
3,717,968 A * 2/1973 Olsen et al. ..... 52/288.1
3,762,109 A 10/1973 Cohen
3,766,699 A 10/1973 Dinkel
3,778,949 A 12/1973 Hellerich
3,839,837 A 10/1974 Jaconeli
3,865,679 A 2/1975 Hale
3,905,167 A 9/1975 Watkins et al.
3,908,326 A 9/1975 Francis
3,928,691 A 12/1975 Knudson
3,935,357 A 1/1976 Padovani
3,969,862 A 7/1976 Kuss
3,984,961 A 10/1976 Chieger et al.
3,992,839 A 11/1976 La Borde
4,004,387 A 1/1977 Ellingson
4,008,548 A 2/1977 Leclerc
4,010,586 A 3/1977 Brechbuhler
4,023,317 A 5/1977 Bettger et al.
4,028,750 A 6/1977 Gustafsson
4,031,682 A 6/1977 Renkert
4,032,680 A 6/1977 Allard
4,045,937 A 9/1977 Stucky
4,054,987 A 10/1977 Forlenza
4,186,723 A 2/1980 Coppola et al.
4,201,019 A 5/1980 Jones
4,226,064 A 10/1980 Kraayenhof
4,236,361 A 12/1980 Boden
4,258,519 A 3/1981 Hugens
4,348,442 A 9/1982 Figge
4,430,833 A * 2/1984 Balzer et al. ..... 52/255
4,436,779 A 3/1984 Menconi et al.
4,470,405 A 9/1984 Landstrom et al.
4,557,091 A 12/1985 Auer
4,563,374 A 1/1986 Treber
4,568,584 A 2/1986 Holland
4,641,468 A 2/1987 Slater
4,662,515 A 5/1987 Newby, Sr.
4,674,250 A 6/1987 Altizer
4,706,426 A * 11/1987 Rumsey ..... 52/232
4,790,112 A 12/1988 Wang
4,792,082 A 12/1988 Williamson
4,805,357 A 2/1989 Aleixo
4,826,265 A 5/1989 Hockenberry
4,843,788 A 7/1989 Gavin et al.
4,862,653 A 9/1989 Pomento
4,903,445 A 2/1990 Mankowski
4,910,280 A 3/1990 Robbins, III
4,925,338 A 5/1990 Kapusta
4,930,286 A 6/1990 Kotler
4,984,406 A 1/1991 Friesen
4,998,023 A 3/1991 Kitts
5,036,634 A 8/1991 Lessard et al.
5,040,834 A 8/1991 Kahl et al.
5,125,697 A 6/1992 Kahl et al.
5,184,436 A 2/1993 Sadler
5,191,985 A 3/1993 Licari
5,219,085 A 6/1993 Craft et al.
5,265,385 A 11/1993 Smith et al.
5,293,725 A 3/1994 Matticks et al.
5,331,778 A 7/1994 Mazpule et al.
5,335,614 A 8/1994 Klaus
5,364,204 A 11/1994 MacLeod
5,411,782 A 5/1995 Jarvis et al.
5,437,573 A 8/1995 Rodriguez-Ferre
5,459,967 A 10/1995 Bodtker
D364,468 S 11/1995 Maple
5,470,641 A 11/1995 Shuert
D365,154 S 12/1995 Maple
5,544,870 A 8/1996 Kelley et al.
5,555,681 A 9/1996 Cawthon
D375,168 S 10/1996 Hunt et al.
D375,169 S 10/1996 Hunt et al.
5,566,961 A 10/1996 Snell et al.
5,568,772 A 10/1996 Carson
5,596,843 A 1/1997 Watson
5,605,344 A 2/1997 Insalaco et al.
5,609,327 A 3/1997 Amidon
5,647,181 A 7/1997 Hunts
5,657,583 A 8/1997 Tennant
5,660,907 A 8/1997 Skalka
5,671,913 A 9/1997 Vesper
D387,876 S 12/1997 Maple
5,694,730 A 12/1997 Del Rincon et al.
5,704,699 A 1/1998 Pagelow et al.
5,706,620 A 1/1998 De Zen
5,713,806 A 2/1998 Teitgen et al.
5,715,854 A 2/1998 Andrieux et al.
5,724,774 A 3/1998 Rooney
D393,724 S 4/1998 Sagol
5,743,426 A 4/1998 Mosley
5,755,341 A 5/1998 Spamer
5,761,867 A 6/1998 Carling
5,776,582 A 7/1998 Needham
5,778,604 A 7/1998 Snow
5,787,654 A 8/1998 Drost
5,789,057 A 8/1998 Naitou et al.
D399,575 S 10/1998 Hunt
5,826,389 A 10/1998 Siler
D405,540 S 2/1999 Maple
5,882,140 A 3/1999 Yoduck, Jr. et al.
5,890,338 A 4/1999 Rodriguez-Ferre
5,904,021 A 5/1999 Fisher
D411,625 S 6/1999 Fuller et al.
D411,629 S 6/1999 Mandell
5,915,724 A 6/1999 Daris et al.
5,925,510 A 7/1999 Schulsinger et al.
5,935,510 A 8/1999 Hansen
5,944,377 A 8/1999 Vlahovic
5,950,378 A 9/1999 Council et al.
5,950,568 A 9/1999 Axelrod et al.
5,970,663 A 10/1999 McDonough
D416,091 S 11/1999 Ohanesian
5,975,660 A 11/1999 Tisbo et al.
5,992,106 A 11/1999 Carling et al.
6,012,253 A 1/2000 Burns
6,044,598 A 4/2000 Elsasser et al.
6,061,979 A 5/2000 Johannes
6,061,987 A 5/2000 King
6,068,308 A 5/2000 Molzer
6,098,354 A 8/2000 Skandis
6,101,768 A 8/2000 Springstead et al.
D431,869 S 10/2000 Hampel
6,129,605 A 10/2000 Cyrus et al.
6,148,583 A 11/2000 Hardy
D436,830 S 1/2001 Nesseth
D437,421 S 2/2001 Hampel
D437,942 S 2/2001 Hampel
6,185,878 B1 2/2001 Bullard, III et al.
6,189,270 B1 2/2001 Jeffers et al.

| | | | | |
|---|---|---|---|---|
| 6,250,022 | B1 | 6/2001 | Paz et al. | |
| 6,257,559 | B1 | 7/2001 | Mouri | |
| 6,298,619 | B1 | 10/2001 | Davie | |
| 6,318,770 | B1 | 11/2001 | Molzer | |
| 6,332,554 | B1 | 12/2001 | McCarthy | |
| D452,913 | S | 1/2002 | Ohanesian | |
| D455,501 | S | 4/2002 | Greene | |
| 6,385,942 | B1 | 5/2002 | Grossman | |
| 6,389,769 | B1 | 5/2002 | McKinney et al. | |
| 6,397,537 | B2 | 6/2002 | Auer et al. | |
| 6,413,348 | B2 | 7/2002 | Stancu et al. | |
| 6,418,672 | B1 | 7/2002 | Hampel | |
| 6,438,903 | B1 * | 8/2002 | Weiss | 52/79.1 |
| 6,446,414 | B1 | 9/2002 | Bullard, III et al. | |
| 6,482,500 | B1 | 11/2002 | Diginosa | |
| D468,026 | S | 12/2002 | Tisbo et al. | |
| D468,442 | S | 1/2003 | Tisbo et al. | |
| D468,833 | S | 1/2003 | Tisbo et al. | |
| D468,834 | S | 1/2003 | Tisbo et al. | |
| D469,188 | S | 1/2003 | Tisbo et al. | |
| 6,539,680 | B2 | 4/2003 | Kunz et al. | |
| 6,562,414 | B2 | 5/2003 | Carling | |
| D476,424 | S | 6/2003 | Shanahan | |
| 6,581,337 | B1 | 6/2003 | Skov et al. | |
| 6,589,891 | B1 | 7/2003 | Rast | |
| 6,591,558 | B1 | 7/2003 | De Zen | |
| 6,601,355 | B2 * | 8/2003 | Kreitz et al. | 52/287.1 |
| 6,604,328 | B1 | 8/2003 | Paddock | |
| D479,882 | S | 9/2003 | Tisbo et al. | |
| D481,138 | S | 10/2003 | Carling et al. | |
| 6,631,594 | B2 | 10/2003 | Whiting | |
| 6,631,821 | B2 | 10/2003 | Vourganas | |
| 6,637,728 | B2 | 10/2003 | Pettit et al. | |
| D484,339 | S | 12/2003 | Greene | |
| D484,612 | S | 12/2003 | Greene | |
| 6,668,514 | B2 | 12/2003 | Skov et al. | |
| 6,672,970 | B2 | 1/2004 | Barlow | |
| 6,675,545 | B2 | 1/2004 | Chen et al. | |
| 6,681,447 | B2 | 1/2004 | Houk, Jr. et al. | |
| 6,701,678 | B1 | 3/2004 | Skov et al. | |
| 6,702,128 | B2 | 3/2004 | Winig et al. | |
| 6,709,034 | B2 | 3/2004 | Michael | |
| 6,719,360 | B1 | 4/2004 | Backs | |
| D492,793 | S | 7/2004 | Moon et al. | |
| D494,281 | S | 8/2004 | Greene | |
| D494,834 | S | 8/2004 | Etlicher | |
| 6,776,300 | B2 | 8/2004 | Walsh et al. | |
| 6,782,624 | B2 | 8/2004 | Marsh et al. | |
| D496,737 | S | 9/2004 | Moon et al. | |
| 6,796,087 | B1 | 9/2004 | Greene | |
| 6,802,158 | B1 | 10/2004 | Greene | |
| 6,802,327 | B2 | 10/2004 | Koss | |
| 6,808,674 | B1 | 10/2004 | Skov et al. | |
| 6,821,049 | B1 | 11/2004 | Greene | |
| 6,823,639 | B2 | 11/2004 | Hampel | |
| D500,605 | S | 1/2005 | Schmidt et al. | |
| 6,868,081 | B1 | 3/2005 | Akram et al. | |
| 6,868,703 | B2 | 3/2005 | Molzer | |
| D505,497 | S | 5/2005 | Astle et al. | |
| 6,892,497 | B2 | 5/2005 | Moon et al. | |
| D506,011 | S | 6/2005 | Astle et al. | |
| D506,266 | S | 6/2005 | Astle et al. | |
| D506,267 | S | 6/2005 | Astle et al. | |
| D506,268 | S | 6/2005 | Astle et al. | |
| 6,939,599 | B2 | 9/2005 | Clark | |
| 6,948,280 | B2 | 9/2005 | Marcinkowski et al. | |
| D525,715 | S | 7/2006 | Richardson et al. | |
| D529,623 | S | 10/2006 | Richardson et al. | |
| 7,210,277 | B2 | 5/2007 | Steed et al. | |
| D547,880 | S | 7/2007 | Ashby et al. | |
| D548,362 | S | 8/2007 | Ashby et al. | |
| 7,407,216 | B2 * | 8/2008 | Taylor | 296/182.1 |
| 2001/0009703 | A1 | 7/2001 | Toshikawa | |
| 2002/0000545 | A1 | 1/2002 | Pettit et al. | |
| 2002/0043035 | A1 | 4/2002 | Patel et al. | |
| 2002/0092128 | A1 | 7/2002 | Houk, Jr. et al. | |
| 2002/0092245 | A1 | 7/2002 | Floyd et al. | |
| 2002/0092818 | A1 | 7/2002 | Craft et al. | |
| 2002/0170259 | A1 | 11/2002 | Ferris | |
| 2002/0174532 | A1 | 11/2002 | Skov et al. | |
| 2003/0024191 | A1 | 2/2003 | Hampel | |
| 2003/0029113 | A1 | 2/2003 | Wetzel, III et al. | |
| 2003/0033770 | A1 | 2/2003 | Harel | |
| 2003/0106472 | A1 | 6/2003 | Lonneman et al. | |
| 2003/0114101 | A1 | 6/2003 | Paz | |
| 2003/0118404 | A1 | 6/2003 | Lee | |
| 2003/0125399 | A1 | 7/2003 | Zhang et al. | |
| 2003/0126814 | A1 | 7/2003 | Cook et al. | |
| 2003/0146426 | A1 | 8/2003 | Ray et al. | |
| 2003/0154675 | A1 | 8/2003 | LaBruzza | |
| 2003/0178383 | A1 | 9/2003 | Craft et al. | |
| 2003/0197165 | A1 | 10/2003 | Perelli | |
| 2003/0201272 | A1 | 10/2003 | Carter | |
| 2003/0203150 | A1 | 10/2003 | Moran et al. | |
| 2003/0217676 | A1 | 11/2003 | Strong et al. | |
| 2003/0226815 | A1 | 12/2003 | Gaunt et al. | |
| 2004/0049992 | A1 | 3/2004 | Seavy | |
| 2004/0074158 | A1 | 4/2004 | De Zen | |
| 2004/0163340 | A1 | 8/2004 | Harel | |
| 2004/0187400 | A1 | 9/2004 | Anderson et al. | |
| 2005/0005537 | A1 * | 1/2005 | Houk, Jr. | 52/127.6 |
| 2005/0166476 | A1 | 8/2005 | Feng | |
| 2005/0223655 | A1 | 10/2005 | Mower et al. | |
| 2005/0252109 | A1 | 11/2005 | Fuccella et al. | |
| 2005/0279034 | A1 | 12/2005 | Tsang | |
| 2006/0048459 | A1 | 3/2006 | Moore | |
| 2006/0059792 | A1 | 3/2006 | Tiramani | |
| 2006/0108899 | A1 | 5/2006 | Jin | |
| 2006/0191209 | A1 | 8/2006 | Reisman | |
| 2007/0044391 | A1 | 3/2007 | Richardson | |
| 2007/0209295 | A1 | 9/2007 | Mower et al. | |
| 2007/0251166 | A1 | 11/2007 | Thiagarajan et al. | |

FOREIGN PATENT DOCUMENTS

| | | |
|---|---|---|
| CA | 2446581 | 11/2002 |
| EP | 0339216 | 11/1989 |
| FR | 2552467 | 3/1985 |
| JP | 5230935 | 9/1993 |
| JP | 07-012123 | 2/1995 |

OTHER PUBLICATIONS

Keter North America; *Owner 's Manual, Apex 8x6 Extension Kit*; date created: Sep. 25, 2003 ; date modifed: Oct. 30, 2003.

Keter North America; *Owner's Manual, Apex 8x6*; date created: May 15, 2004; date modified: May 15, 2004.

Royal Outdoor Products Co.; *4' Extension Kit for Winchester Models S010, S011 & S020, Model E001 Owner's Manual 10'×12' Version 2.8*; date created: Oct. 29, 2003; date modified: Oct. 29, 2003; Copyright 2003.

Royal Outdoor Products Co.; *7' Extension Kit for Winchester Models S010, S011 & S020, Model E002 Owner's Manual 10'×15' Version 2.9*; date created: Oct. 29, 2003 ; date modified: Oct. 29, 2003 ; copyright 2003.

Royal Outdoor Products Co.; *The Winchester II Storage Building, Model S011 Owner's Manual 10'×8' Version 3.2*; date created: Oct. 29, 2003 ; date modified: Oct. 29, 2003 ; copyright 2003.

Royal Outdoor Products Co.; *The Winchester Storage Building, Model S010 Owner's Manual 10'×8' Version 3.2*; date created: Oct. 29, 2003 ; date modified: Oct. 29, 2003 ; copyright 2003.

Rubbermaid Home Products; *3713 Big Max 7'×3 '6" Resin Storage Building Assembly*; date created: Jan. 19, 2004 ; date modified: Jan. 19, 2004 ; copyright 2003.

Rubbermaid Home Products; *3784 Big Max 7'×7' Resin Storage Building Assembly*; date created: Jan. 19, 2004 ; date modified: Jan. 19, 2004 ; copyright 2003.

Rubbermaid Home Products; *Roughneck Vertical Storage Shed 3673*; date created: Jun. 30, 2004 ; date modified: Jun. 30, 2004 ; copyright 2003.

Suncast Corporation; *GS8000 Owner's Manual*; date created: Aug. 26, 2004 ; date modified: not available ; copyright 2004.

Suncast Corporation; *GS8500 Owner's Manual*; date created: Mar. 11, 2004 ; date modified: not available ; copyright 2003.

Suncast Corporation; *GS9000 Owner's Manual*; date created: Aug. 26, 2004 ; date modified: not available ; copyright 2004.

Suncast Corporation; *GS9500 Owner's Manual*; date created: Mar. 8, 2004 ; date modified: not available ; copyright 2004.
The STEP2 Company; *LifeScapes Storage Building*; date created: Feb. 2, 2004 ; date modified: Jul. 14, 2004 ; copyright 2004.
The STEP2 Company; *LifeScapes Storage House*; date created: Feb. 2, 2004 ; date modified: Mar. 4, 2004 ; copyright 2004.
The STEP2 Company; *LifeScapes Storage Shed*; date created: Feb. 2, 2004 ; date modified: Mar. 4, 2004 ; copyright 2004.
Thinking Outside, L.L.C.; *Bill of Materials for SmartShed Deluxe Plus*; date created: Apr. 16, 2004 ; date modified: Apr. 16, 2004.
Thinking Outside, L.L.C.; *Bill of Materials for SmartShed Deluxe*; date created: Apr. 2, 2004 ; date modified: Apr. 2, 2004.
Thinking Outside, L.L.C.; *Bill of Materials for SmartShed Extension Unit*; date created: Apr. 16, 2004 ; date modified: Apr. 16, 2004.
Thinking Outside, L.L.C.; *Bill of Materials for SmartShed Utility*; date created: Apr. 2, 2004 ; date modified: Apr. 2, 2004.
Thinking Outside, L.L.C.; *SmartShed Outdoor Storage Chest Parts List*; date created: Aug. 17, 2004 ; date modified: Aug. 18, 2004.
US Polymers Inc.; *DuraMax Storage Shed Owner 's Manual / Instructions for Assembly Size; 10'×8' Ver: 2.0*; date created: Jan. 3, 2004 ; date modified: Jan. 3, 2004.
US Polymers Inc.; *DuraMax Storage Shed Owner's Manual / Instructions for Assembly Size; 8'×6' Ver: 1.2*; date created: Feb. 25, 2003 ; date modified: Feb. 25, 2003.
US Polymers Inc.; *DuraMax Storage Shed Owner's Manual / Instructions for Assembly Size; 10'×8' Ver: 1.2*; date created: Feb. 26, 2003 ; date modified: Feb. 26, 2003.
U.S. Appl. No. 11/091,848, filed Mar. 28, 2005, Mower et al.
U.S. Appl. No. 11/091,849, filed Mar. 28, 2005, Mower et al.
U.S. Appl. No. 11/091,606, filed Mar. 28, 2005, Mower et al.
U.S. Appl. No. 11/091,813, filed Mar. 28, 2005, Mower et al.
U.S. Appl. No. 11/091,811, filed Mar. 28, 2005, Mower et al.
U.S. Appl. No. 11/091,620, filed Mar. 28, 2005, Mower et al.
U.S. Appl. No. 11/091,861, filed Mar. 28, 2005, Mower et al.
U.S. Appl. No. 11/091,837, filed Mar. 28, 2005, Mower et al.
U.S. Appl. No. 11/742,467, filed Apr. 20, 2007, Steed et al.
Office Action from U.S. Appl. No. 11/091,811 dated Nov. 24, 2006, 8 pages.
Office Action from U.S. Appl. No. 11/091,811 dated Aug. 8, 2007, 23 pages.
International Search Report from PCT/US2005/010262 dated Dec. 11, 2006, 1 page.
International Preliminary Report on Patentability from PCT/US2005/010262 dated Jan. 9, 2007, 9 pages.
Written Opinion from PCT/US2005/010262 dated Nov. 7, 2006, 8 pages.
Examination Report from Canadian Patent Application No. 2525098 dated Aug. 31, 2007, 4 pages.
LifeScapes Storage Building, The Step2 Company, 4 pages, 2004.
LifeScapes Storage House, The Step2 Company, 2 pages, 2004.
LifeScapes Storage Shed, The Step2 Company, 4 pages, 2004.

* cited by examiner

MODULAR ENCLOSURE

CROSS-REFERENCE TO RELATED APPLICATIONS

This application claims priority to and the benefit of U.S. Provisional Patent Application Ser. No. 60/680,246, filed May 11, 2005 and entitled MODULAR ENCLOSURE. This application also claims priority to and the benefit of U.S. Provisional Patent Application Ser. No. 60/680,279, filed May 11, 2005 and entitled MODULAR ENCLOSURE. These applications are incorporated by reference in their entireties.

BACKGROUND OF THE INVENTION

1. Field of the Invention

The invention generally relates to enclosures and, in particular, to modular enclosures.

2. Description of Related Art

Many types of enclosures are used for storing various items such as tools, machines, lawn care equipment, recreational equipment, athletic equipment, supplies and the like. Conventional storage enclosures often include walls, a door, a floor and a roof. The walls, door, floor and roof of typical storage enclosures often include one or more parts that are interconnected. The walls, door, floor and roof may then be attached to form the enclosure.

A well known type of storage enclosure is a shed. Conventional sheds are typically relatively small structures that may be either freestanding or attached to another structure, and sheds are often used for storage and/or shelter. Disadvantageously, conventional sheds often require a substantial amount of time, labor, skill and effort to build and construct. Conventional sheds may include one or more windows or vents to allow light and air to enter the shed. The windows and vents of many conventional sheds, however, often require a number of interconnected components and are difficult to manufacture and install. Additionally, many conventional sheds are difficult to repair, modify, change or rearrange because the sheds may be difficult or impossible to disassemble or dismantle. Accordingly, it is often impractical or unfeasible to move or reconfigure many conventional sheds.

Conventional sheds are often constructed from wood. Wooden sheds, however, are relatively heavy and require a large amount of time to construct and assemble. In particular, wooden sheds are frequently constructed from a large number of support beams, trusses, sidewalls and roof panels that are connected by a large number of screws or bolts. These numerous parts typically increase the costs of the shed and require a large amount of time and effort to construct the shed. In addition, wooden sheds typically deteriorate over time and often require continual maintenance. For example, conventional wooden sheds may be damaged by rotting or otherwise deteriorating when exposed to the elements. In addition, the wood may warp or decay over time. In order to help protect the wood from being damaged, conventional sheds must be periodically painted, stained or otherwise finished. Undesirably, this may result in significant maintenance costs.

Known sheds may also be constructed from metal. For example, the roof and walls of conventional metal sheds may be constructed from sheet metal. Disadvantageously, the sheet metal is often flexible and easily damaged. In particular, the sheet metal walls may be damaged by forces being applied to either the inner or outer walls of the shed. In particular, this may cause the walls to undesirably bow inwardly or outwardly and, in some circumstances, may create an opening in the wall. Significantly, the damaged sheet metal may be more susceptible to rust or corrosion and the damaged sheet metal may be very difficult to repair or replace. In addition, conventional metal sheds often require a plurality of screws or bolts to assemble the shed, which may increase manufacturing costs and the time required to assemble the shed. Moreover, metal sheds often have a tendency to rust and deteriorate over time, especially when exposed to the elements. Thus, metal sheds may have to be painted or otherwise protected from rusting or oxidation.

The materials used to construct conventional sheds are often heavy and bulky. For example, many conventional sheds have a length of 8 to 12 feet (2.4 to 3.7 meters), and a width of 8 to 12 feet (2.4 to 3.7 meters). In particular, known sheds are often 8 feet by 8 feet (2.4 by 2.4 meters), 8 feet by 10 feet (2.4 by 3 meters), 8 feet by 12 feet (2.4 by 3.7 meters), 10 feet by 12 feet (3 by 3.7 meters) or 12 feet by 12 feet (3.7 by 3.7 meters). Thus, the components used to constructed these sheds are often elongated and may have a length of 6 feet (1.8 meters) or more and a width of 2 feet (0.6 meters) or greater. Accordingly, many of the components are large and bulky. In addition, if these components are constructed from wood or metal, then the components may be very heavy. Thus, the components of conventional sheds may be large, awkward, heavy and generally unwieldy.

Many conventional sheds are shipped in an unassembled configuration because of their large size in the assembled configuration. The weight of the components, however, may result in significant shipping expenses and those expenses may be compounded every time the shed is transported or shipped. For example, there may be significant costs when the manufacturer ships the shed to the retailer, which the consumer may ultimately have to pay. Many consumers may have to pay more to have the shed delivered from the retailer because of the weight of the packaging. In addition, many consumers may be unwilling or unable to purchase these conventional sheds because they have no practical way of taking the shed home. Specifically, many consumers are unable to lift or move the packaging of many conventional sheds. In particular, the consumer may also have to rent or borrow a forklift to load and unload the shed from the vehicle. Accordingly, these large costs and difficulties in transportation may discourage many potential consumers from purchasing conventional sheds.

In addition to conventional sheds being constructed from heavy and bulky materials and components, conventional sheds are often shipped in very large and heavy boxes. These gigantic shipping boxes often will not fit in a typical retail consumer's vehicle. Accordingly, the consumer may have to rent or borrow a vehicle, such as a truck, to take the shed home.

In greater detail, a conventional shed having a width of 10 feet (3 meters), a length of 8 feet (2.4 meters) and a height of 7 feet (2.1 meters) that is constructed from polyvinylchloride (PVC) plastic is shipped in a box having a length of 96 inches (2.4 meters), a width of 48 inches (1.2 meters) and a height of 36 inches (0.9 meters). Thus, the packaging has a volume of 96 cubic feet (2.7 cubic meters). Another known shed, which is constructed from blow-molded and injection-molded plastic, has a width of 7 feet (2.1 meters), a length of 7 feet (2.1 meters) and a height of 8 feet (2.4 meters) is shipped in a box that has a length of 78 inches (2 meters), a width of 48 inches (1.2 meters) and a height of 32 inches (0.8 meters). This packaging has a volume of 69.3 cubic feet (2 cubic meters). Still another known shed, which is constructed from roto-molded plastic and plastic coated aluminum, has a width of 7 feet (2.1 meters), a length of 7 feet (2.1 meters) and a height of 8 feet, 8 inches (2.6 meters) is shipped in a box that has a length of 100 inches (2.5 meters), a width of 55 inches (1.4 meters) and a height of 50 inches (1.27 meters), and this packaging has a volume of 159.1 cubic feet (4.5 cubic meters) and a weight of 540 pounds (245 kilograms) including the packaging. Still yet another known shed, which is constructed from injection-molded plastic, has a width of 7 feet (2.1 meters), a length of 7 feet (2.1 meters) and a height of 7.5 feet (2.3 meters) is shipped in a box that has a length of 96 inches (2.4 meters), a width of 48 inches (1.2 meters) and a height of 46 inches (1.17 meters). This packaging has a volume of about 69.3 cubic feet (1.9 cubic meters) and a weight of 350 pounds (159 kilograms) including the packaging. A further known shed that is constructed from blow-molded plastic has a width of 7 feet (2.1 meters), a length of 15.5 feet (4.7 meters) and a height of 6.5 feet (2 meters) is shipped in a box that has a length of 96 inches (2.4 meters), a width of 48 inches (1.2 meters) and a height of 48 inches (1.2 meters), and this packaging has a volume of 128 cubic feet (3.6 cubic meters) and a weight of 548 pounds (249 kilograms) including the packaging. Another conventional shed is constructed from roto-molded plastic and it has a width of 5.5 feet (1.7 meters), a length of 6 feet (1.8 meters) and a height of 6.5 feet (2 meters). This known shed is shipped in packaging having a length of 77 inches (1.96 meters), a width of 38 inches (0.96 meters), a height of 12 inches (0.3 meters) and a weight of 248 pounds (112 kilograms). Still another conventional shed is constructed from extruded polypropylene and it has a width of 8 feet (2.4 meters), a length of 6 feet (1.8 meters) and a height of 7 feet (2.1 meters). This shed is shipped in packaging having a length of 78 inches (2 meters), a width of 30 inches (0.76 meters), a height of 33 inches (0.84 meters) and a weight of 318 pounds (144 kilograms). Yet another conventional shed is constructed from thermo-formed ABS plastic and it has a width of 8 feet (2.4 meters), a length of 8 feet (2.4 meters) and a height of 6 feet (1.8 meters). This shed is shipped in packaging having a length of 66 inches (1.68 meters), a width of 39.5 inches (1 meter), a height of 15 inches (0.38 meters) and a weight of 325 pounds (147 kilograms). Accordingly, the size and weight of many known sheds is substantial, which may greatly complicate and increase the costs of shipping.

Because conventional sheds are shipped in boxes that have such a large size and volume, fewer sheds may be shipped in standard shipping containers or in commercial trailers. Accordingly, the shipping costs per shed (such as, from a supplier to a retailer) can be significantly increased. Also, because these packaged sheds are so large and heavy, many shippers may find it difficult to efficiently deliver the sheds and may refuse to ship the sheds. In addition, because many conventional packaged sheds are so large and heavy, they typically must be shipped to consumers using freight shippers, which may charge even more for these heavy, large and awkward boxes. In some instances, this cost may be simply too large for a customer to justify the purchase.

Known storage sheds are also typically constructed of a variety of awkwardly shaped components, which can be difficult to ship and can be susceptible to damage if shipped. In order to ship and protect these awkwardly shaped components, large amounts of packaging materials may be required. The packing material, however, takes additional space in the packaging and the packing material increases the shipping costs. In addition, because the components may be awkwardly shaped, custom packing materials may be required and the packing material may be irreparably damaged during shipping. Thus, the packing material may not be reusable and may create a significant amount of waste. Further, it may require a significant amount of time to prepare these awkward components for shipping, and this may increase labor costs and decrease manufacturing efficiency. Finally, the awkwardly shaped components often consume a large amount of area, which may increase the overall volume required to ship the shed and that may correspondingly increasing shipping costs.

Conventional sheds are also often constructed from a variety of interconnected components that form a number of joints or seams. Disadvantageously, these seams or joints are often susceptible to leaks. For example, the seams or joints may allow water to enter the shed and the water can damage whatever is stored within the shed.

In addition, many sheds are subjected to a variety of adverse weather conditions and some conventional sheds may be damaged if they are constructed from weak materials or poorly assembled. For example, conventional sheds may be damaged by heavy winds. Known sheds may also have a flat or slightly sloped roof, which may allow snow to collect on the roof. Undesirably, the snow may damage the roof and, in extreme circumstances, may cause the roof to collapse. The flat roofs may also allow water and other objects to collect on the roof, which may damage the roof and/or leak through the roof and into the shed.

BRIEF SUMMARY OF THE INVENTION

A need therefore exists for an enclosure that eliminates the above-described disadvantages and problems.

One aspect is an enclosure that may be constructed from a number of components. At least some of the components may be interchangeable and the enclosure may be a modular enclosure.

Another aspect is an enclosure that may be part of a kit. The kit, for example, may include a number of components that may be interchangeable and/or interconnected. The components may also be part of a group and/or be available individually or separately.

Still another aspect is an enclosure that may include one or more components that may be interconnected to form a structure. The structure may include walls, roof, floor, etc. and these components can be connected. Preferably, the components can be relatively quickly and easily connected and disconnected. Advantageously, this may allow the components to be easily reconfigured, repaired and/or replaced. In addition, this may allow the structure to be easily moved, reused and the like.

Yet another aspect is an enclosure that may be used in a variety of different situations and environments. For instance, the enclosure may be used for storage and/or to protect items from the elements. In particular, the enclosure may be a shed, but it will be appreciated that the enclosure may have a much wider applicability and may be used for a number of different purposes. Thus, while the enclosure may be illustrated and described in connection with a shed, the enclosure could have other suitable arrangements, configurations, designs, purposes and the like.

A further aspect is an enclosure, such as a shed, that may be at least partially constructed from relatively lightweight materials such as blow-molded plastic. The blow-molded plastic components may be constructed from polyethylene with ultraviolet (UV) additives or inhibitors, if desired, but other suitable plastics and materials may be used to construct the shed. Advantageously, the blow-molded plastic components may provide superior weathering and durability because, for example, the blow-molded plastic may be able to withstand the elements and it is generally impact resistant. In addition, the blow-molded plastic components may be easy to clean and virtually maintenance free. For example, painting and finishing of the blow-molded plastic is not required. Further, the blow-molded plastic may include two walls that are separated by a distance. The double walls may create air pockets that help insulate the shed. Further, blow-molded plastic generally does not rust or otherwise deteriorate over time, and the blow-molded plastic is rodent and insect resistant. Thus, constructing at least a portion of the shed from blow-molded plastic may allow the shed to be used in a wide variety of situations and environments.

A still further aspect is a shed that is at least substantially constructed from blow-molded plastic. Advantageously, at least a portion of the walls, roof, floor and/or doors may be constructed from blow-molded plastic. The gables, corners and other portions of the shed may also be constructed from blow-molded plastic. Significantly, the blow-molded plastic components may include finished interior and exterior surfaces. For example, the exterior surface could include one design or pattern and the interior surface could include another design or pattern. Advantageously, the patterns on the opposing surfaces may include discrete points of intersection and depressions, which may be sized and configured to increase the strength and/or rigidity of the components, may be located at those points. In particular, because the patterns may extend inwardly, that may decrease the size and/or height of the depressions located at the points of intersection.

Another aspect is a shed that may be constructed from lightweight materials so that the shed can be easily transported and shipped. In addition, the shed is preferably constructed from lightweight materials so that a consumer can transport the shed and more easily assembly the shed.

Yet another aspect is a shed that may be sized and configured to be shipped and transported in relatively small sized packaging in comparison to the packaging of conventional sheds.

Still another aspect is a shed that may include components constructed from plastic, such as high density polyethylene, and the plastic components may provide sufficient strength and rigidity to allow a strong and sturdy structure to be created. As discussed above, various components of the shed may be constructed from blow-molded plastic, but other processes such as injection molding, rotary molding, compression molding and the like may also be used to construct the various components of the shed. Advantageously, the blow-molded plastic components are desirably designed to create rigid, high-strength structures that are capable of withstanding repeated use and wear. Significantly, the blow-molded plastic components may be easily manufactured and formed into the desired size and shape. In addition, the blow-molded plastic components can form structural elements of the shed to minimize the number of parts required to construct the shed. Further, the blow-molded plastic components may be easily interconnected and disconnected, and the blow-molded plastic components may be simply and easily assembled and/or disassembled with minimum effort and tools. It will be appreciated that frames, braces, other support members, fasteners and the like may also be used to support and construct the shed, if desired.

Advantageously, the shed may be relatively simple to manufacture because one or more of the components constructed from blow-molded plastic. In addition, one or more features may be integrally formed in the blow-molded plastic components. The blow-molded plastic components may by strong and lightweight because the components may include two opposing walls that are spaced apart by a relatively small distance. In addition, the blow-molded plastic components may include one or more depressions, connections or tack-offs that may interconnect the opposing surfaces and these depressions may further increase the strength of the components. Further, the blow-molded plastic components can desirably be formed in various shapes, sizes, configurations and designs, which may allow an attractive and functional shed that is available in a variety of configurations and sizes to be constructed.

Another aspect is a shed that may be quickly and easily assembled, which may reduce manufacturing and labor costs. For example, this may allow the manufacturer to quickly and easily assemble the shed. In addition, this may allow the manufacturer to ship the shed in an unassembled configuration and the consumer may quickly and easily assembly the shed. Advantageously, shipping the shed in the unassembled configuration may reduce manufacturing and shipping costs.

Yet another aspect is a shed that may include a plurality of panels that are interconnected. For example, the shed may include one or more floor panels, wall panels and/or roof panels that are interconnected. Preferably, the floor panels, wall panels and/or roof panels are connected to adjacent floor panels, sidewalls and/or roof panels, respectively, with one or more overlapping portions to help securely connect the panels or walls. In particular, the panels may include one or more extensions, flanges, projections, protrusions, etc., that extend outwardly from one panel and overlap with one or more receiving portions, notches, grooves, openings, etc. in the adjacent panel. Advantageously, this may allow the panels to be interconnected. The overlapping portions may be connected by fasteners, such as screws or bolts, or adhesives to help secure the panels together. Significantly, the overlapping portions may help prevent rain, snow, sunlight, foreign objects and the like from undesirably entering the shed.

A further aspect is a shed that may include sidewalls that are directly connected to the floor. For example, the sidewalls may contain one of more protrusions or projections and the floor may include one or more openings or receiving portions. The projections may be inserted into the receiving portions to securely connect the sidewalls to the floor. Advantageously, this may allow the sidewalls to be connected to the floor by a friction, interference and/or snap fit connection, if desired. The sidewalls and floor may also be connected by one or more fasteners, such as screws or bolts, if desired.

A still further aspect is a shed that may include a roof that is directly connected to the sidewalls. Preferably the roof is connected to the sidewalls so that is a there is an overhang of the roof to the sidewalls. Advantageously, this may allow water to run off the roof to the ground without contacting the sidewalls, which may help prevent water leaks and the water from marring or damaging the sidewalls. The roof and sidewalls may be connected, for example, by one or more interlocking pieces such as a tongue and groove arrangement. The roof and sidewalls may also be connected by one or more fasteners, such as screws or bolts, if desired.

Still another aspect is a shed that may include roof trusses constructed from metal. In particular, the shed may include trusses that are constructed from metal and have a generally A-frame type configuration. Advantageously, the metal roof trusses may be used in connection with panels constructed from blow-molded plastic to create a strong and durable roof. The roof trusses may also assist in connecting the roof panels to the shed and the trusses may be sized and configured to allow water or moisture that passes between the roof panels to be drained from the shed.

Yet another aspect is a shed that may include a support member that is sized and configured to increase the rigidity and/or strength of the shed. For example, the support member may be connected to a truss and/or one or more panels, such as wall panels, floor panels and roof panels. Because the support member may increase the strength and/or rigidity of the shed, the shed may not require various reinforcing members or structures. For instance, the support member may help support one or more of the panels, which may eliminate the need for any reinforcing members or structures for the panels.

Yet still another aspect is a shed that may include a support member that is constructed from a relatively strong and rigid material such as metal. In particular, the support member is preferably constructed from steel and the support beam may include a powder-coated finish. Preferably the support member is constructed from different materials and/or has different characteristics than other portions of the shed, such as the panels.

Another aspect is a shed that may include a support member that is connected to a wall. The support member is preferably connected to an interior surface of the wall, which may advantageously help protect the support beam from weather-related damage when the shed is used outdoors. The support member may also be used to connect, for example, two or more panels to form at least a portion of the wall. In addition, the support member could be connected to other portions of the shed such as the floor or roof.

Yet another aspect is a shed that may include a pair of panels that are positioned at an angle to form a corner. One or more brackets may be used to connect the panels. In addition, a cover may be used in connection with the brackets and the cover may include one or more receiving portions that are sized and configured to receive at least a portion of the brackets. Further, a seam may be formed between the panels and the cover may be disposed along at least a portion of the seam.

Still another aspect is a shed that may include panels, such as roof panels, floor panels and/or wall panels, which can be efficiently packaged. For example, the roof panels may be positioned within a shipping container so that storage areas or cavities are disposed between the panels. The storage areas or cavities may be sized and configured to receive all or at least a portion of one or more floor panels. Advantageously, this may allow the shed to be packaged in a relatively small container. This may also allow the shed to be stored and shipped more easily and professionally.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

Before describing preferred and other exemplary embodiments in greater detail, several introductory comments regarding the general applicability and scope of the invention may be helpful.

First, the following detailed description of preferred and other exemplary embodiments is generally directed towards an enclosure such as a storage enclosure. It will be appreciated that the storage enclosure may be used to temporarily and/or permanently store a variety of items, objects, devices and the like depending, for example, upon the intended use of the enclosure. The principles of the present invention, however, are not limited to storage enclosures. It will be understood that, in light of the present disclosure, the enclosures disclosed herein can have a variety of suitable shapes, arrangements, configurations and the like; and that the enclosures can be used for a variety of different functions, purposes and uses.

Second, the enclosures discussed in more detail below and shown in the accompanying figures are illustrated in connection with exemplary and preferred embodiments of a shed. It will be appreciated that the shed can have a wide variety of suitable arrangements and configurations. It will also be appreciated that the enclosure does not have to be a shed and the enclosures can be other types of structures, storage devices, units, enclosures, boxes, bins, containers, recreational equipment enclosures, organizers and the like. In addition, the size and dimensions of the shed and its various components can be varied depending, for example, upon the intended use and/or desired purpose of the shed.

Third, the particular materials used to construct preferred and exemplary embodiments of the shed are illustrative. For example, as discussed in greater detail below, blow-molded plastic is preferably used to construct various portions of the shed, such as floor panels, wall panels, door panels and/or roof panels. It will be understood, however, that other materials can be used such as thermoplastics, resins, polymers, acrylonitrile butadiene styrene (ABS), polyurethane, nylon, composites and the like. It will also be understood that other suitable processes may be used to construct these various components, such as extrusion molding, injection molding, vacuum molding, rotational molding and the like. Further, it will be understood that these and other components of the shed can be made from other materials such as metal (including steel, aluminum, etc.), wood and the like.

Further, to assist in the description of the shed, words such as upper, lower, top, bottom, front, back, right and left are used to describe the accompanying figures. It will be appreciated, however, that the shed can be located in a variety of desired positions, angles and orientations. A detailed description of the shed now follows.

Figure 1:
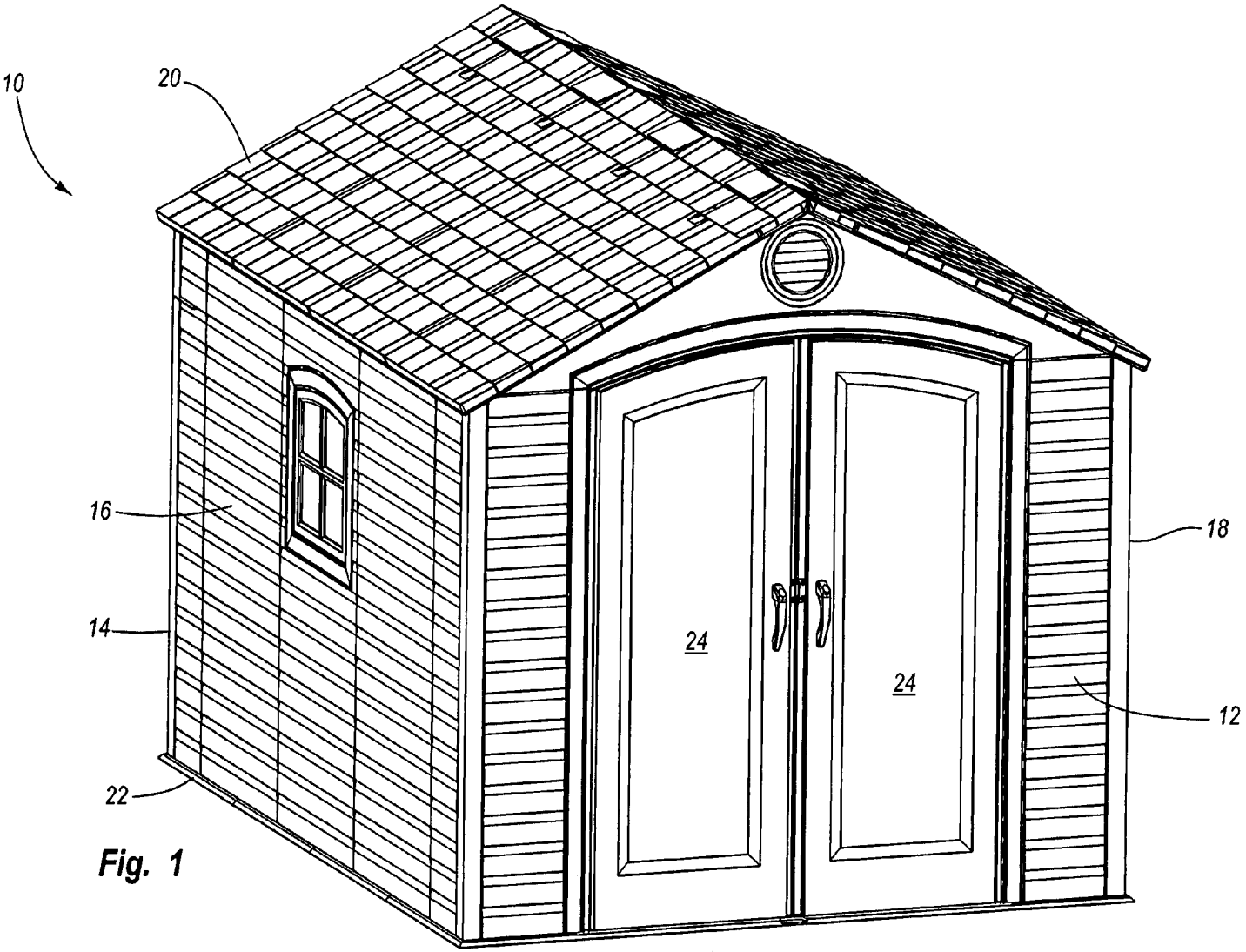
FIG. 1 is a front perspective view of an exemplary embodiment of a shed.
Figure 2:
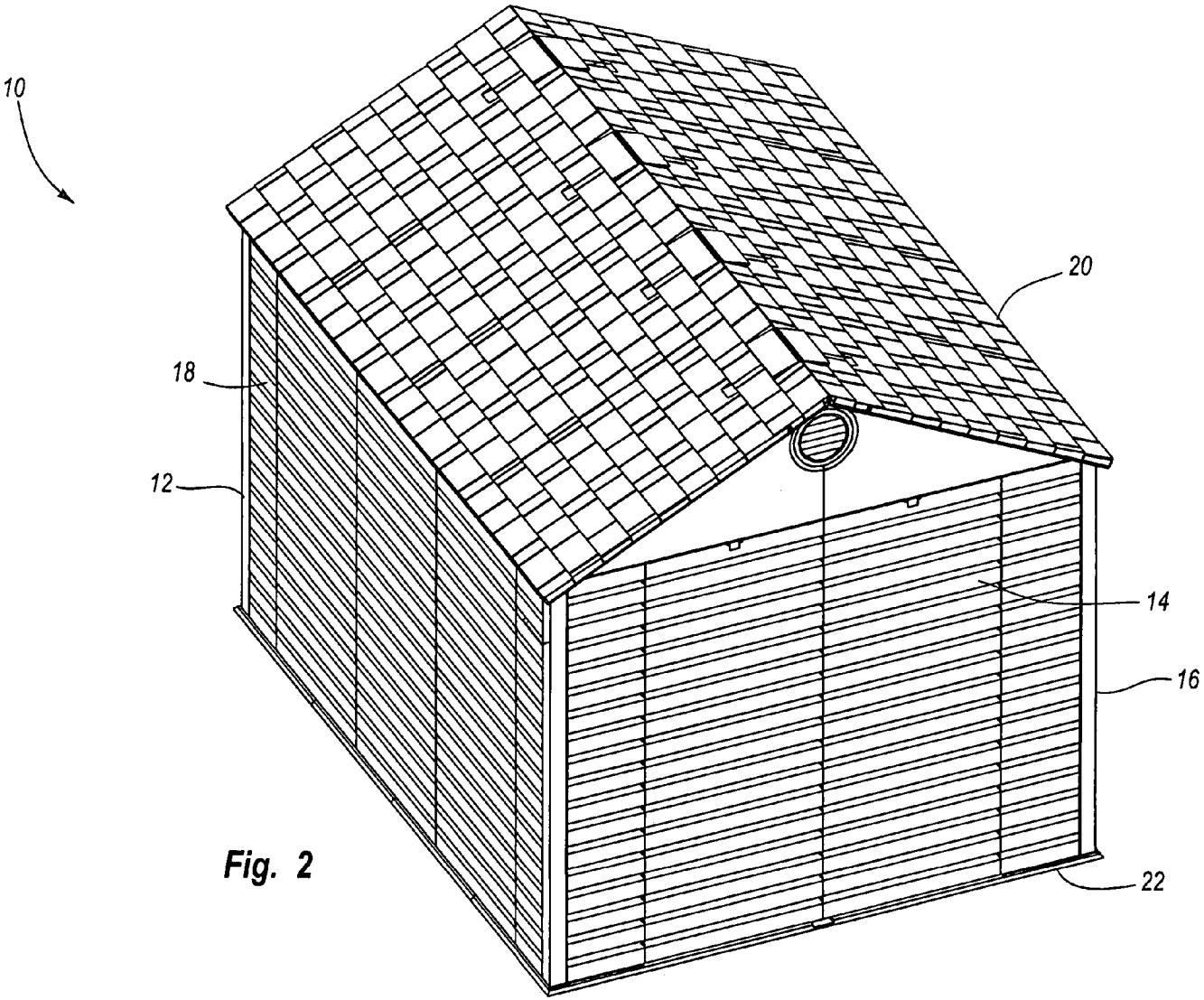
FIG. 2 is a rear perspective view of the shed shown in FIG. 1.

As shown in FIGS. 1 and 2, an exemplary embodiment of the shed 10 includes a front wall 12, a rear wall 14, a left sidewall 16 and a right sidewall 18. The shed 10 also includes a roof 20, a floor 22 and doors 24.

As discussed in greater detail below, the shed 10 may be a modular structure with a number of connected and/or interlocking components. The components, for example, may be connected by a snap-fit, interference and/or friction fit; and the components may be connected by one or more connectors or fasteners, such as screws and bolts. The modular structure may allow the same components to be used to form different parts of the shed 10. For example, the walls 12, 14, 16, 18; roof 20 and/or floor 22 may be formed from a number of panels and one or more of the panels may be interchangeable. This may allow the shed 10 to be more easily constructed and it may reduce the number of molds required to make the components. Advantageously, this may also allow the shed 10 to be quickly and easily assembled without a large number of parts or tools. In addition, the modular components may allow the shed 10 to be made with larger or smaller dimensions using generally the same components. This may significantly increase the potential uses of the shed 10.

The shed 10 may also provide a relatively inexpensive enclosure that may be efficiently manufactured, shipped, stored, displayed, transported and the like. The shed 10 may also be sold as a kit or as an assembled structure. In addition, the shed 10 may include components that are sold separately, which may allow a consumer to repair, replace, reconfigure and/or modify the shed. The shed 10 may also be sold according to specified dimensions, but the dimensions may be changed to expand or contract the shed. The shed 10 may also be sold with an expansion kit that is sized and configured to increase the size of the shed.

Figure 3:
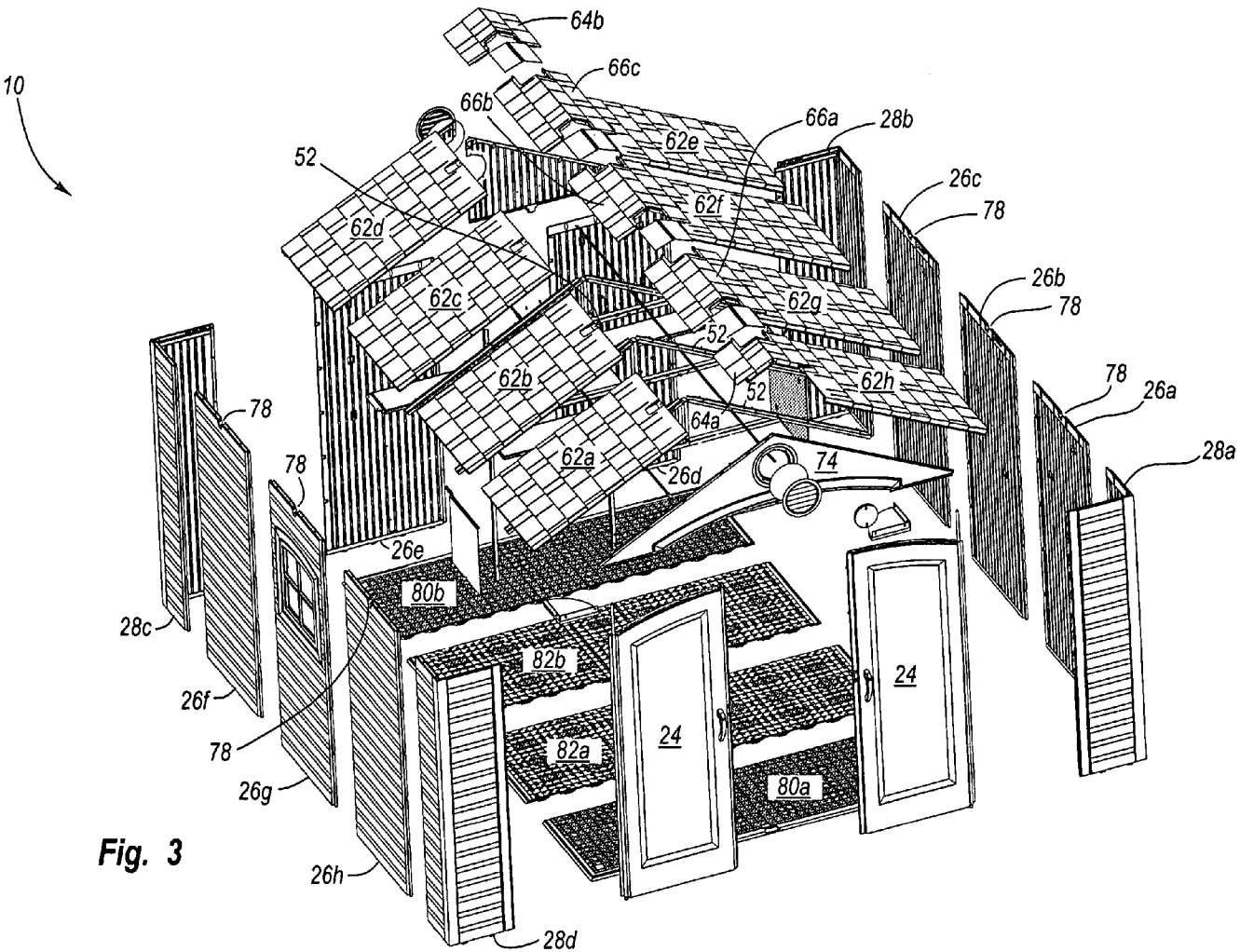
FIG. 3 is an exploded, front perspective view of the shed shown in FIG. 1.
Figure 4:
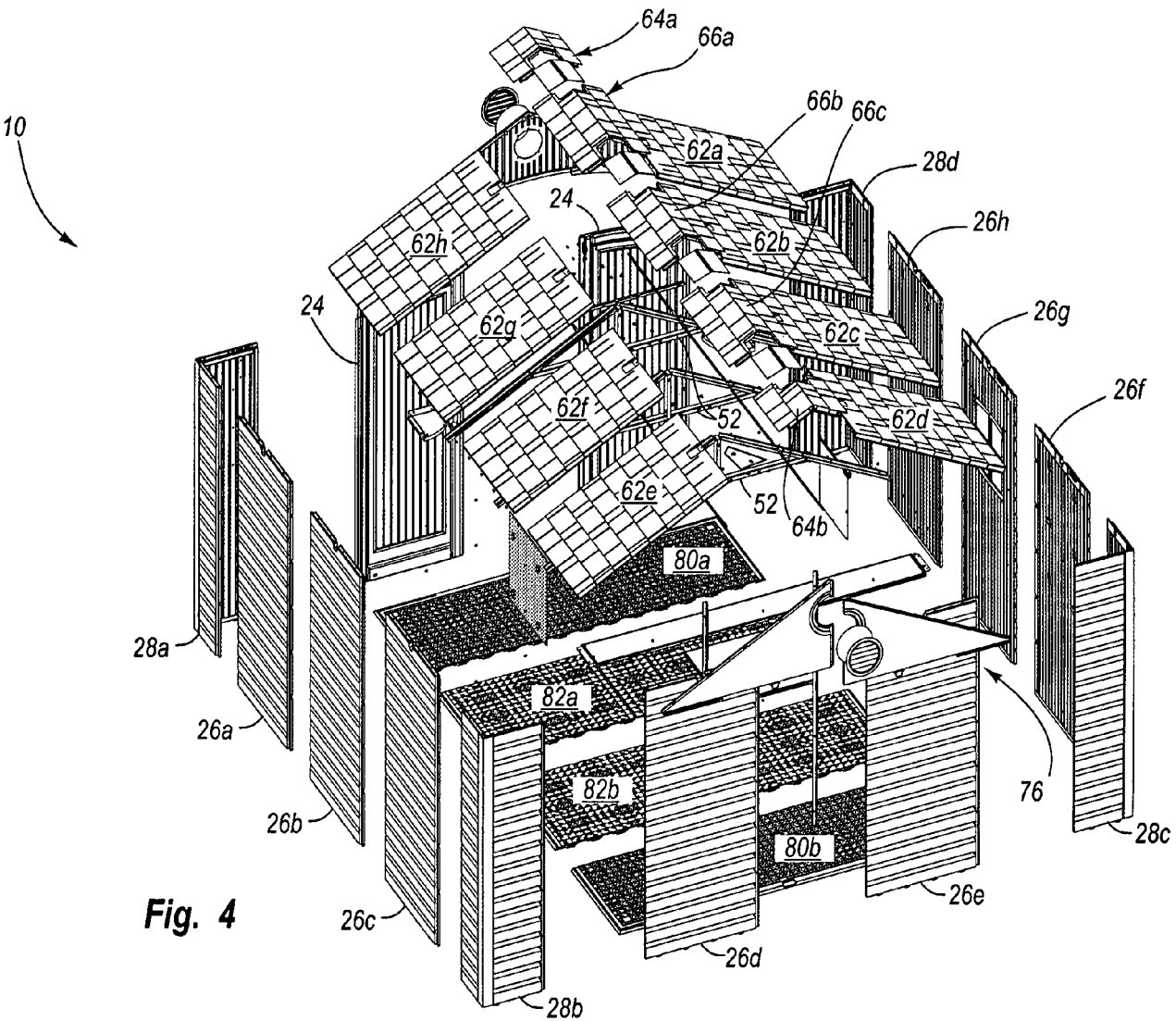
FIG. 4 is an exploded, rear perspective view of the shed shown in FIG. 1.

As shown in FIGS. 3 and 4, the shed 10 is constructed from a number of components that are interconnected to form the shed. In particular, as described in greater detail below, the walls 12, 14, 16, 18 of the shed 10 can be constructed from a number of interconnected panels. Additionally, the roof 20 may include a number of interconnected panels and the floor 22 may also include a number of interconnected panels. It will be appreciated that the number of components used to form the walls 12, 14, 16, 18; roof 20; and floor 22 may depend, for example, upon the size and configuration of the shed 10.

Significantly, the various components may allow the shed 10 to be relatively quickly and easily assembled. This may allow, for example, the manufacturing costs of the shed 10 to be decreased. This may also allow the shed 10 to be shipped in an unassembled configuration and the consumer may be able to quickly and easily assemble the shed. Advantageously, shipping the shed 10 in an unassembled configuration may reduce shipping costs and increase the potential uses of the shed. In addition, as discussed in greater detail below, the components of the shed 10 are preferably generally lightweight and that may also reduce shipping costs and facilitate transportation or shipping of the shed. Further, as discussed in greater detail below, various components of the shed 10 may be sized and configured to minimize the size and shape of the packaging. This may greatly decrease the size of the packaging, which may considerably decrease shipping costs and allow, for example, the consumer to readily transport the shed 10.

Further, while the shed 10 may be shown in the accompanying drawings as having a general size and configuration, it will be appreciated that the shed may be larger, smaller or have other suitable dimensions. In addition, as discussed below, the length of the shed 10 may be increased or decreased, which may significantly expand the potential uses and functionality of the shed.

Various exemplary features and aspects of the shed 10 will now be discussed in more detail. It will be appreciated that the shed 10 does not require all or any of these exemplary features and aspects, and the shed could have other suitable features and aspects depending, for example, upon the intended design, use or purpose of the shed.

Wall Panels & Corner Panels

As shown in FIGS. 3 and 4, the walls 12, 14, 16, 18 may include a number of panels that are interconnected. In particular, the walls 12, 14, 16 18 may include a number of modular panels and one or more of these modular panels may be interchangeable. For example, the walls 12, 14, 16, 18 may be constructed from wall panels 26*a-h* and corner panels 28*a-d*. These wall panels 26*a-h* and corner panels 28*a-d* may be used to construct a shed with a generally rectangular configuration. It will be appreciated, however, that shed could have other suitable configurations such as square, polygonal, triangular, circular and the like. In addition, as discussed in greater detail below, the roof 20 may be constructed from a number of roof panels, the floor 22 constructed from a number of floor panels, and the doors 24 may be constructed from a number of door panels.

In greater detail, the rear wall 14, the left sidewall 16 and the right sidewall 18 may have a generally similar construction in that they may be primarily constructed from wall panels 26 and corner panels 28. For example, the right sidewall 18 may be formed from a portion of the front right corner panel 28*a*, three wall panels 26*a*, 26*b*, 26*c*, and a portion of the right rear corner panel 28*b*. The rear wall 14 may be constructed from another portion of the right rear corner panel 28*b*, two wall panels 26*d*, 26*e*, and a portion of the left rear corner panel 28*c*. Similarly, the left sidewall 16 may be constructed from another portion of the left rear corner panel 28*c*, three wall panels 26*f*, 26*g*, 26*h*, and a portion of the left front corner panel 28*d*.

Advantageously, manufacturing and assembly of the shed may be greatly simplified because each of the wall panels 26*a-h* may have the same size and configuration.

The corner panels 28*a-d* desirably include a first portion that is separated by a second portion by a living hinge. It will be appreciated, however, that the corner panels 28 do not require living hinges and the corner panels may have other suitable configurations, arrangements, connections and the like.

Each of the corner panels 28*a-d* preferably have the same general configuration, which may help create a modular structure. Advantageously, the corner panels may be positioned in a flat, generally planar configuration. This may facilitate shipping, transport and/or storage of the shed 10 because the corner panels 28 may be shipped and stored in the generally planar configuration and then simply bent into the desired position for assembly of the shed. In addition, because the corner panels 28 may have generally the same size and configuration as the wall panels 26 in the planar configuration, that may allow the shed to be easily shipped; transported and/or stored. In particular, this may allow the wall panels 26 and corner panels 28 to be stacked and/or positioned adjacent to each other within the packaging. It will be appreciated, however, that the wall and corner panels 26, 28 may be shipped in any desired configuration.

As shown in FIGS. 3 and 4, the wall panels 26 may be connected to a corner panel 28 and/or another wall panel. Advantageously, the same type of connection configuration may be used to connect the wall panels 26 and/or corner panels 28. For example, the left side of each wall panel 26*a-h* may have generally the same configuration and the right side of each wall panels 26*a-h* may have generally the same configuration so that the wall panels 26 can be used interchangeably. In addition, the left side of each corner panel 28*a-d* may have generally the same configuration and the right side of each corner panel 28*a-d* may have generally the same configuration so that the corner panels 28 can be used interchangeably. Such a construction may simplify the manufacturing and assembly of the shed 10. Additionally, the left side of each wall panels 26*a-h* may have generally the same configuration as the left side of each corner panels 28*a-d*, and the right side of each wall panels 26*a-h* may have generally the same configuration as the right side of each corner panels 28*a-d*, which may allow the wall and/or corner panels to be used interchangeably. Further, the right and left sides of the wall and/or corner panels 26, 28 may be generally mirror images and/or include complementary features that allow the panels to be readily connected and disconnected. It will be appreciated, however, that the wall panels 26 and/or corner panels 28 may also have other suitable configurations and arrangements, and the panels do not have to be interchangeable or have the same general configuration.

The wall panels 26*a-h* and/or corner panels 28*a-d* preferably are securely connected to allow a strong and sturdy shed 10 to be constructed. Advantageously, the secure connection of the panels 26, 28 may help prevent inadvertent separation of the panels and may enhance the structural integrity of the shed 10. In addition, a tight-fit between the panels 26, 28 may help prevent water and/or air from undesirably entering the shed 10. Further, the secure connection of the panels 26, 28 may prevent undesirable movement of panels and other portions of the shed 10.

Figure 6:
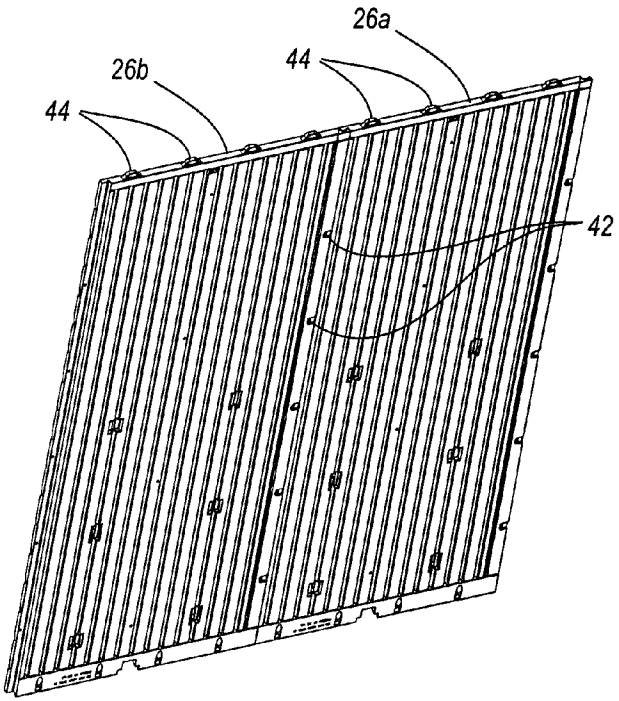
FIG. 6 is a perspective view of a portion of the shed shown in FIG. 1, illustrating an exemplary embodiment of a connection of two panels.
Figure 5:
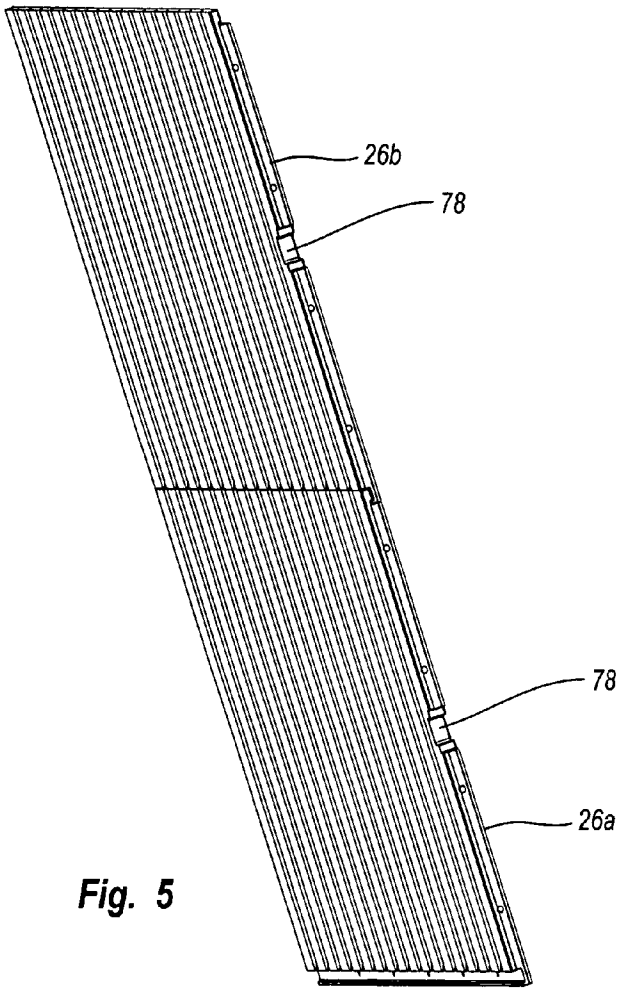
FIG. 5 is a perspective view of a portion of the shed shown in FIG. 1, illustrating an exemplary embodiment of a connection of two panels.
Figure 7:
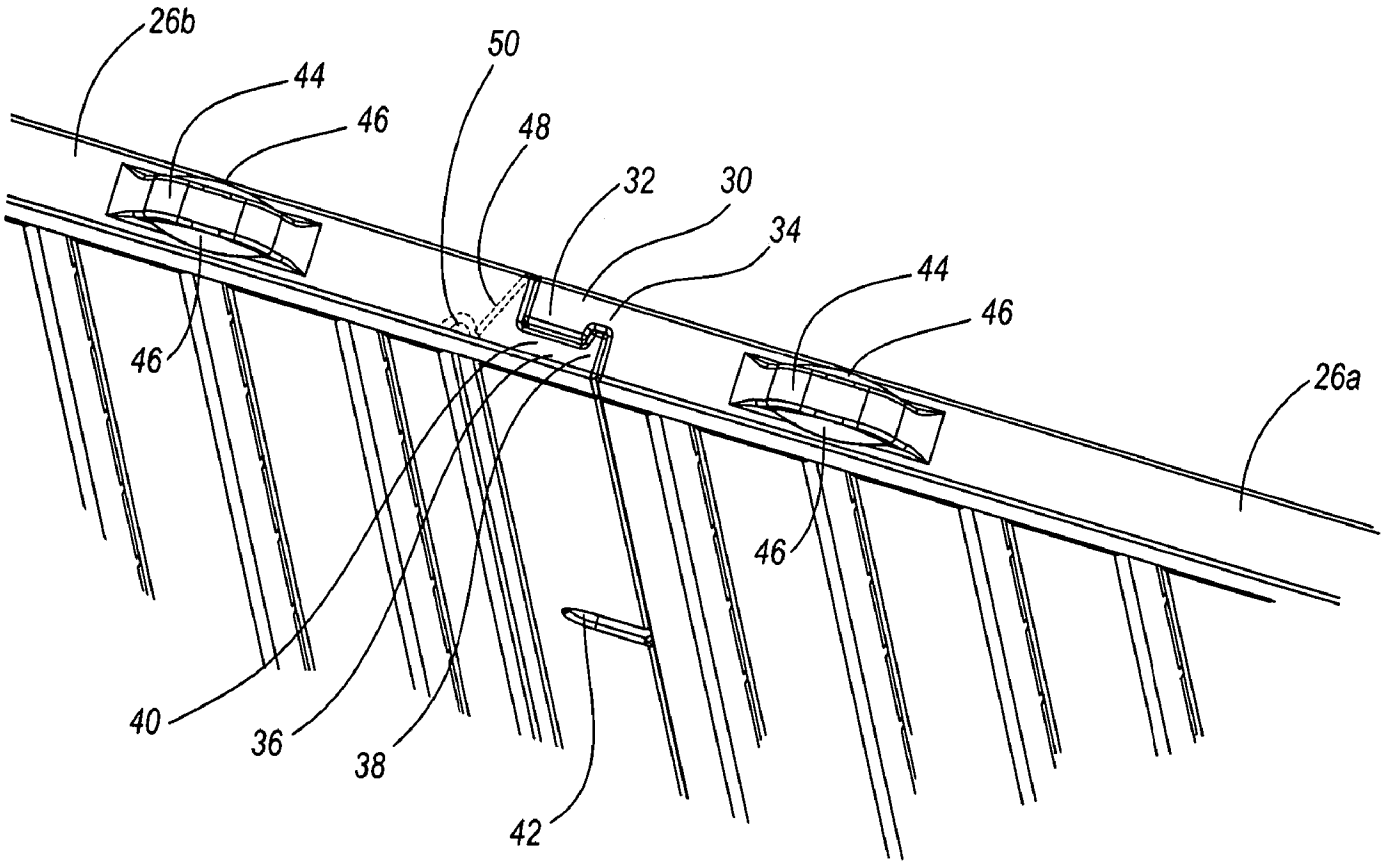
FIG. 7 is an enlarged perspective view of a portion of the panels shown in FIG. 6, illustrating a reinforcing member disposed within one of the panels.

As shown in FIGS. 5, 6 and 7, the connection of the walls panels 26 and/or corner panels 28 may include overlapping portions. The overlapping portions may extend along all or just a portion of the connection between the panels 26, 28, and the panels may be connected by one or more overlapping portions. That is, for example, two adjacent panels 26, 28 may be connected by a single overlapping portion or multiple overlapping portions depending, for example, upon the intended design and/or use of the shed 10.

In greater detail, as shown in FIG. 7, the wall panels 26*a*, 26*b* are used to illustrate an exemplary embodiment of the connection between two adjacent wall panels and this same general configuration may be used to connect other wall and corner panels 26, 28. One of ordinary skill in the art will appreciate, however, that this type of connection does not have to connect all the wall and corner panels 26, 28 and that other suitable types of connections and connectors may also be used.

The wall panel 26 may include an inner surface, an outer surface, a top portion, a bottom portion, a left side and a right side. The top portion of wall panel 26*a* may be substantially flat but, if desired, the inner surface can have a different height that the outer surface. A mating interface is provided on the left side of the wall panel 26*a* and the right side of the wall panel 26*b*. For example, as shown in FIG. 7, the left side of the wall panel 26*a* may include one or more connectors, which may include an extension or flange 30 that is generally aligned with and flush with the outer surface of wall panel 26*a*. The extension 30 may include a connecting member, which may include an enlarged head portion 32, and an extension, such as a neck portion 34. In addition, the right side of the wall panel 26*b* may include one or more connectors, which may include an extension or flange 36 that is generally aligned with and flush with the inner surface of the wall panel 26*b*. The extension 36 may include a connecting member, which may include an enlarged head portion 38, and an extension, such as a neck portion 40.

As shown in FIGS. 5, 6 and 7, the extensions 30, 36 may overlap and mate together to connect the panels 26*a*, 26*b*. In particular, the enlarged head portion 32 of the extension 30 may fit within the neck portion 40 of the extension 36, and the enlarged head portion 38 of the extension 36 may fit within the neck portion 34. Advantageously, these extending portions and receiving portions may allow the panels 26*a*, 26*b* to be rigidly connected and help prevent the panels from inadvertently separating. In addition, these extensions or flanges may interlock to secure the panels 26*a*, 26*b* together. Further, the extensions or flanges may be sized and configured to allow the panels 26*a*, 26*b* to be connected by a friction, interference or snap fit.

The panels 26*a*, 26*b* may also include other features that facilitate attachment of the panels. For example, the extensions 30, 36 may include one or more detents, ribs, projections and the like that may help connect and/or align the panels. In addition, the panels may include beveled and/or rounded surfaces to facilitate connection of the panels.

Advantageously, the overlapping portions, such as the extensions 30, 36, do not extend beyond a plane generally aligned with the inner or outer surfaces of the panels 26*a*, 26*b*. This allows the panels 26*a*, 26*b* to be connected so that the inner and outer surfaces of the panels are generally aligned. While the panels 26*a*, 26*b* preferably include complimentary overlapping portions that allow the panels to be securely connected and the inner and outer surfaces of the panels to be generally aligned, the panels could be connected in any suitable manner or arrangement.

As shown in FIGS. 6 and 7, the extension 36 on the wall panel 26*b* may include one or more portions 42 that are sized and configured to allow a fastener, such as a screw, to connect the panels 26*a*, 26*b*. In particular, the portions 42 of the wall panel 26*a* may include a screw boss that is sized and configured to receive a screw. Advantageously, the mechanical fastener may secure the wall panels 26*a*, 26*b* together. It will be appreciated that any number of screw bosses and screws may be used to connect the panels 26*a*, 26*b*, but screw bosses and/or screws are not required.

Additionally, as seen in FIGS. 6 and 7, the bottom portion of the wall panels 26*a*, 26*b* may include outwardly extending protrusions 44. The outwardly extending protrusions 44 may include a locking portion 46 that is formed on the inner and/or outer surfaces of the protrusion. The locking portion 46 may have a generally tapered configuration and it may extend outwardly from the side of protrusion 44. The locking portion 46 may also include an outwardly extending lip or edge, which may be spaced apart from the bottom of the protrusion 44. As will be discussed in more detail below, the protrusion 44 and locking portion 46 may assist in connecting the wall panels 26*a-h* to the floor 22.

One of ordinary skill in the art will understand that the wall panels 26*a-h* and the corner panels 28*a-d*, and the interconnection of these panels, may have other suitable configurations, arrangements, features and the like. Additional embodiments and disclosure regarding wall panels, corner panels and the interconnection of these and other components is disclosed in Assignee's co-pending U.S. application Ser. No. 11/091,813, entitled SYSTEM AND METHOD FOR CONSTRUCTING A MODULAR ENCLOSURE, filed Mar. 28, 2005, which is incorporated by reference in its entirety.

Blow-Molded Plastic

The wall panels 26 and corner panels 28 are preferably constructed from a lightweight material such as plastic. In addition, other portions of the shed 10, such as the roof 20, floor 22 and doors 24, may also be constructed from a lightweight material such as plastic. In particular, these and other components may be constructed from high density polyethylene and these components are desirably formed by a blow-molding process. Importantly, blow-molding may allow strong, lightweight, rigid and sturdy components to be quickly and easily manufactured. In particular, the blow-molded components may include a hollow interior portion that is formed during the blow-molding process, which may allow a lightweight component to be manufactured. Advantageously, this may allow the shed 10 to have significantly lighter weight than conventional sheds constructed from wood or metal. In addition, constructing the shed 10 from blow-molded plastic may allow the shed to be constructed from less plastic than conventional plastic shed, which may save manufacturing costs and reduce consumer costs. The blow-molded plastic may also include ultraviolet (UV) inhibitors that help prevent the plastic from deteriorating when exposed to sunlight. It will be appreciated that other suitable plastic, materials and/or processes may also be used to construct these and other components depending, for example, upon the particular design and use of the shed 10.

The shed 10 may also be constructed from blow-molded plastic because this may allow the shed to be economically manufactured. In addition, the blow-molded plastic may allow the shed 10 to be readily produced because, among other reasons, the components may be quickly manufactured and the blow-molded plastic components may be created with a variety of suitable shapes, sizes, designs and/or colors depending, for example, upon the intended use of the shed. Further, the blow-molded plastic components may be durable, weather resistant, generally temperature insensitive, corrosion resistant, rust resistant and generally do not deteriorate over time. Thus, the blow-molded plastic may allow a long-lasting and durable shed 10 to be constructed.

The blow-molded plastic components of the shed 10 may also include one or more depressions, indentations or the like, and these depressions may be sized and configured to increase the strength and/or rigidity of the component. These depressions, which may also be known as "tack-offs," preferably cover at least a substantial portion of the components and the depressions may be arranged into a predetermined pattern. The depressions, for example, may be formed in one surface and extend towards an opposing surface. The ends of the depressions may contact or engage the opposing surface and/or the ends of the depressions may be spaced apart from the opposing surface. Advantageously, the depressions may help support the opposing surface and/or increase the structural integrity of the component. In addition, the depressions may be closely spaced in order to increase the strength and/or structural integrity of the component. Further, the depressions may be spaced or positioned into a generally regular or constant pattern so that the component has generally consistent properties. It will be appreciated that the depressions may have a variety of suitable configurations and arrangements. For instance, additional information regarding other suitable configurations and arrangements of the depressions is disclosed in Assignee's co-pending U.S. patent application Ser.

No. 10/490,000, entitled HIGH STRENGTH, LIGHT WEIGHT BLOW-MOLDED PLASTIC STRUCTURES, which was filed on Apr. 8, 2003; and U.S. Provisional Patent Application Ser. No. 60/659,982, entitled HIGH-STRENGTH, LIGHTWEIGHT BLOW-MOLDED PLASTIC STRUCTURES, which was filed on Mar. 9, 2005. These applications are incorporated by reference in their entireties.

The depressions may also be positioned on opposing surfaces of various components of the shed 10, if desired. For example, one or more depressions may be formed on a first surface and these depressions may extend towards the second, opposing surface. In addition, one or more depressions may be formed on the second surface and these depressions may extend towards the first surface. These depressions on the first and second surfaces may be generally aligned and the ends of the opposing depressions may touch or engage. Significantly, this may create depressions that may contact and support the opposing surface, but the depressions have a smaller size and/or height than conventional depressions because the depressions do not span the entire distance between the opposing surfaces. In contrast, the depressions on the opposing surfaces only span a portion of the distance separating the opposing surfaces.

One skilled in the art, however, will appreciate that the components do not have to be constructed from blow-molded plastic and other suitable materials and/or processes can be used to construct the various components depending, for example, upon the intended use of the shed 10. Thus, some or all of the components could also be constructed from other materials with suitable characteristics, such as wood, metal and other types of plastic. Additionally, all the components do not have to be constructed from blow-molded plastic and some or all of the components could be constructed from injection molded plastic, extrusion molded plastic, and the like.

Various components of the shed 10 may also include reinforcements that may be sized and configured to increase the strength and/or rigidity of the shed. For example, the walls 12, 14, 16, 18, which are preferably constructed from blow-molded plastic panels, may include reinforcements to increase their strength and/or rigidity. In particular, the blow-molded plastic panels may include one or more reinforcing members that have different capabilities or characteristics than the panels. For instance, the reinforcing members may have different strength, resilience, compression and/or tension capabilities that the panels, which may allow the panel to be reinforced. Advantageously, the reinforced panel may have greater strength, rigidity, impact resistance, resilience and/or ability to prevent deformation. In addition, the reinforcing members may be arranged or configured to maximize the strengths or characteristics of the reinforcing members.

For example, as seen in FIG. 7, the exemplary wall panel 26*b* may be reinforced by a reinforcing member 48. The reinforcing member 48 is preferably disposed within a receiving portion that is formed inside of the wall panel 26*b* and it is sized and configured to support the reinforcing member in a desired position. For example, as seen in FIG. 7, the reinforcing member 48 may be disposed at an angle to maximize the desirable characteristics of the reinforcing member. In particular, the reinforcing member 48 may be sized and configured to be disposed between one or more alignment portions, such as a groove 50, and an outer edge of the panel 26*a*. The wall panel 26*b*, however, does not require any reinforcing members or any alignment portions.

Additional information regarding structures constructed from blow-molded plastic and reinforcing members for blow-molded plastic structures is disclosed in Assignee's co-pending U.S. application Ser. No. 10/890,601, entitled PARTITION SYSTEM, which was filed on Jul. 14, 2004, and is incorporated by reference in its entirety.

Roof Assembly

Figure 8:
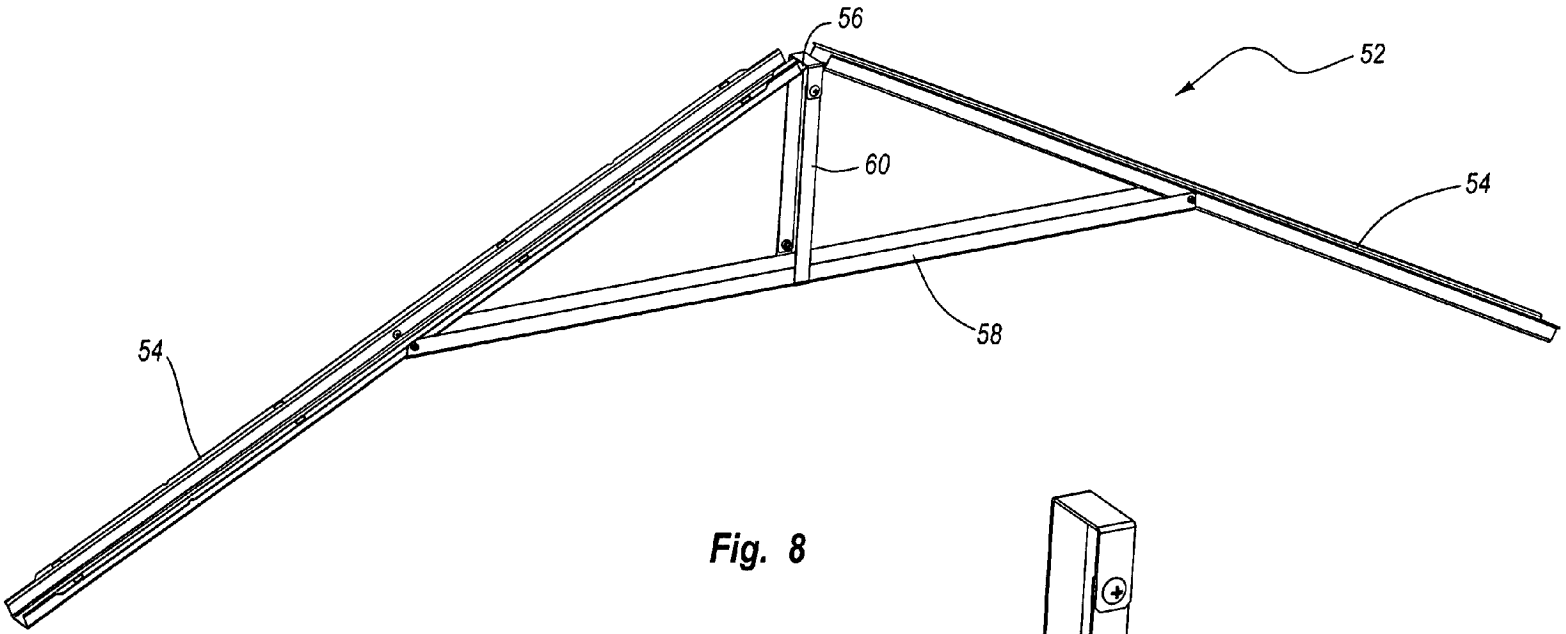
FIG. 8 is a perspective view of a portion of the shed shown in FIG. 1, illustrating an exemplary roof truss.
Figure 9:
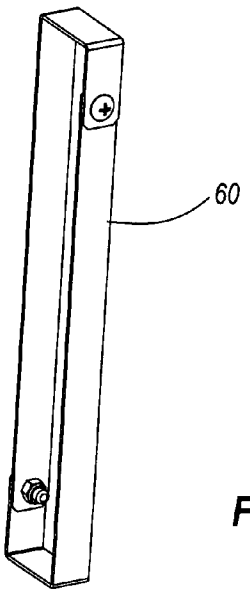
FIG. 9 is a perspective view of a portion of the roof truss shown in FIG. 8, illustrating an exemplary bracket that may be used in connection with the truss.

Turning back to FIGS. 3 and 4, the roof 20 of the shed 10 will now be discussed in further detail. The roof 20 may include a plurality of trusses 52, and as shown in FIG. 8, each truss may include a pair of support beams 54 that are connected at one end by a bracket 56. The support beams 54 are preferably elongated structures and each of the support beams may include a channel. A cross beam 58 or rafter is connected proximate the midsection of the pair of support beams 54 to form a generally A-frame type truss system. A bracket 60 may connect the bracket 56 and the cross beam 58, as shown in FIGS. 8 and 9. The support beams 54 and cross beams 58 are preferably constructed of metal (such as steel) and these beams can be powder coated, galvanized, or otherwise processed to reduce or minimize corrosion. It- will be appreciated that these beams could also be constructed from other materials with suitable characteristics.

As shown in FIGS. 3 and 4, the roof 20 preferably has a modular construction with a plurality of roof panels 62 and roof caps 64, 66. For example, as shown in the accompanying figures, the roof 20 may include lower roof panels 62*a-h,* end roof cap portions 64*a*, 64*b*, and intermediate roof cap portions 66*a*, 66*b*, 66*c*. The roof panels 62 and roof caps 64, 66 are preferably constructed from blow-molded plastic, but these components could also be constructed from other materials and processes with suitable characteristics.

Figure 12:
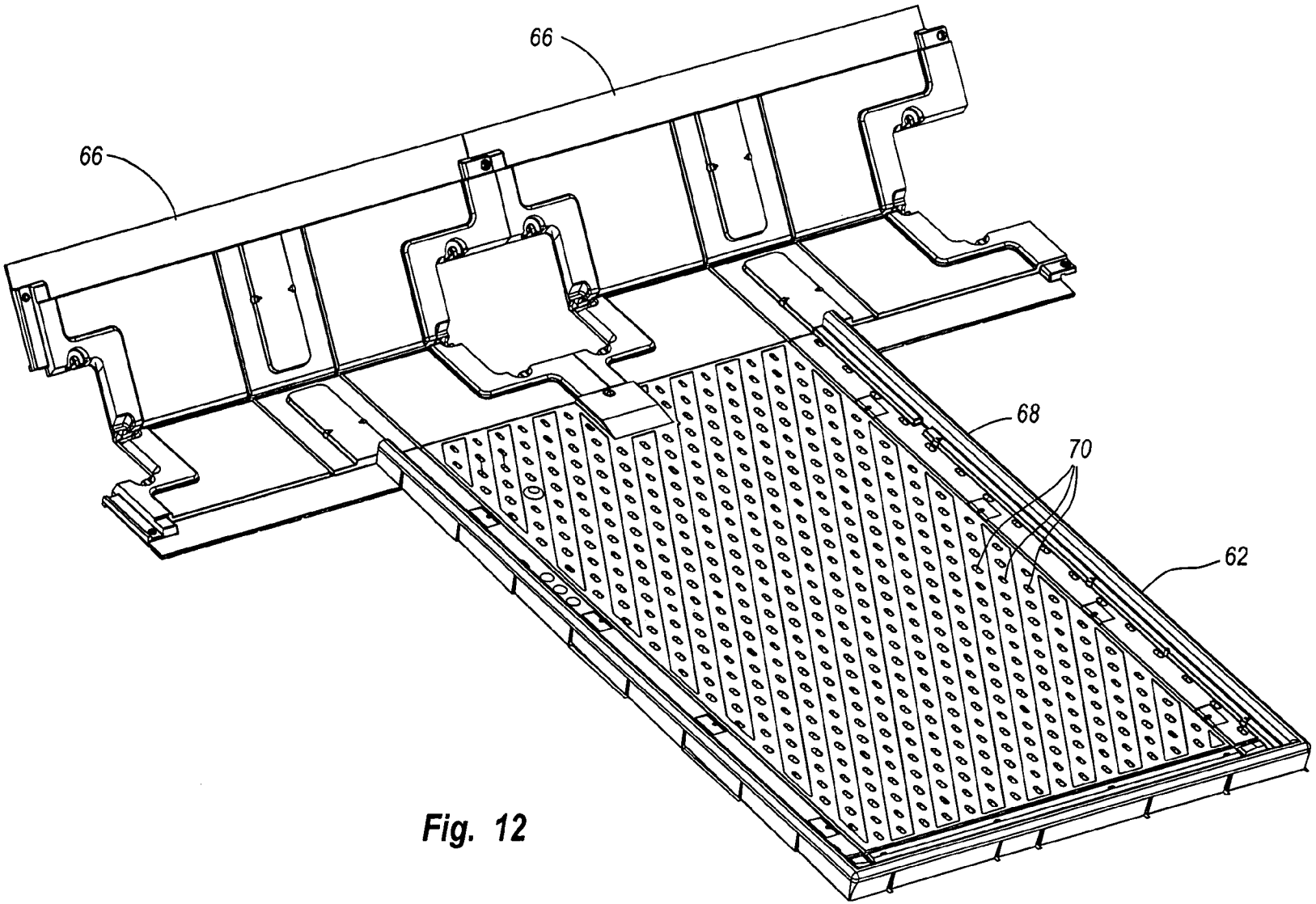
FIG. 12 is a perspective view of a portion of the shed shown in FIG. 1, illustrating an exemplary connection of a pair of roof cap portions to a roof panel.
Figure 13:
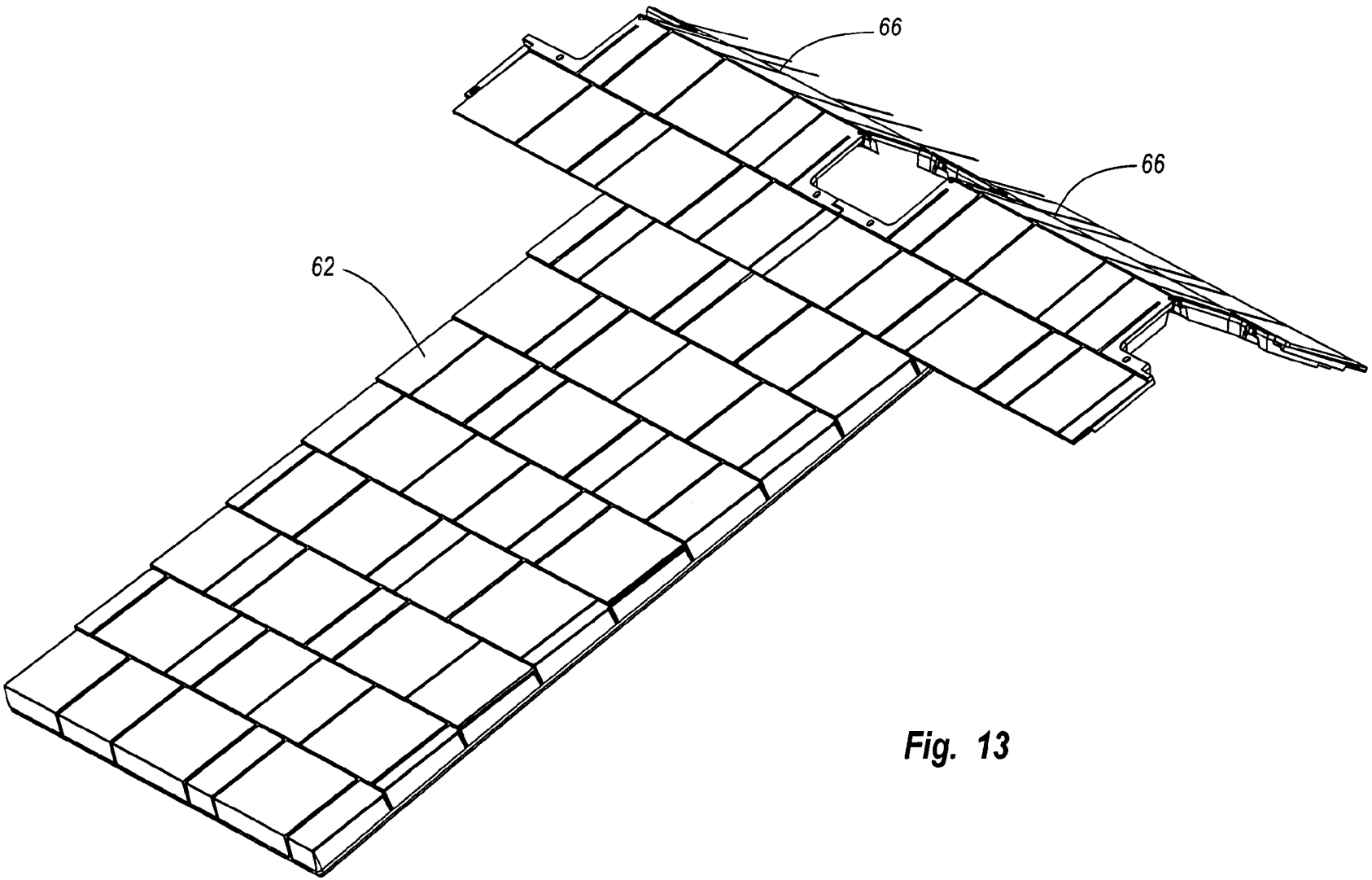
FIG. 13 is another perspective view of the connection of the roof cap portions and roof panel.

In greater detail, the roof 20 may include lower roof panels 62*a-h* and each lower roof panel may include an inner surface, an outer surface, a top portion, a bottom portion, a left side and a right side. As shown in FIG. 12, the lower roof panels 62*a-h* may also include a lip 68 that extends outwardly away from the inner surface and is formed on one or more sides of the lower roof panel. The lip 68 may be formed on the outer periphery of selected lower roof panel 62*a-h* to create a thicker edge, which may create the appearance of thicker roof. The lip 68 may include a hollow interior portion that is formed during the manufacturing process. Advantageously, the lower roof panels 62 and the lip 68 are constructed from blow-molded plastic, which may be integrally formed as part of a unitary, one-piece structure. One or ordinary skill in the art will appreciated that the lower roof panels 62 could have a variety of suitable configurations.

Advantageously, because the lower roof panels 62*a-h* may have generally the same or identical shape and configuration, the lower roof panels may be used interchangeably. As discussed above, the lower roof panels 62 may include one or more depressions that may be sized and configured to increase the strength and/or rigidity of the roof panels, such as depressions 70 shown in FIG. 12. The lower roof panels 62 may include one or more reinforcing members, if desired.

Similarly, the roof cap portions 64, 66 may include one or more depressions that may be sized and configured to increase the strength and/or rigidity of the roof cap portions. In addition, the roof cap portions 64, 66 may include one or more reinforcing members, if desired. Advantageously, the roof cap portions 64, 66 may each include a first portion and a second portion that are joined together by a living hinge. It will be appreciated, however, that the roof cap portions 64, 66 do not require any living hinge.

The roof 20, as seen in FIG. 3, may include a roofline that is formed from the end roof cap portions 64*a*, 64*b* and the intermediate roof cap portions 66*a-c*. The end roof cap portions 64*a*, 64*b* and the intermediate roof cap portions 66*a-c* are preferably constructed from blow-molded plastic. It will be appreciated that the end roof cap portions 64*a*, 64*b* can be substantially mirror images of each other and the intermediate roof cap portions 66*a-c* can also be substantially mirror images of each other. It will be understood, however, that the end roof cap portions 64*a*, 64*b* and/or the intermediate roof cap portions 66*a-c* do not have to be mirror images, respectively, and these portions may have other suitable designs and configurations.

As shown in the accompanying figures, the end roof cap portions 64*a*, 64*b*, the intermediate roof cap portions 66*a-c* and the lower roof panels 62*a-h* can be connected to form the roof 20. It will be appreciated that the roof 20 can have other suitable configurations and arrangements.

Figure 10:
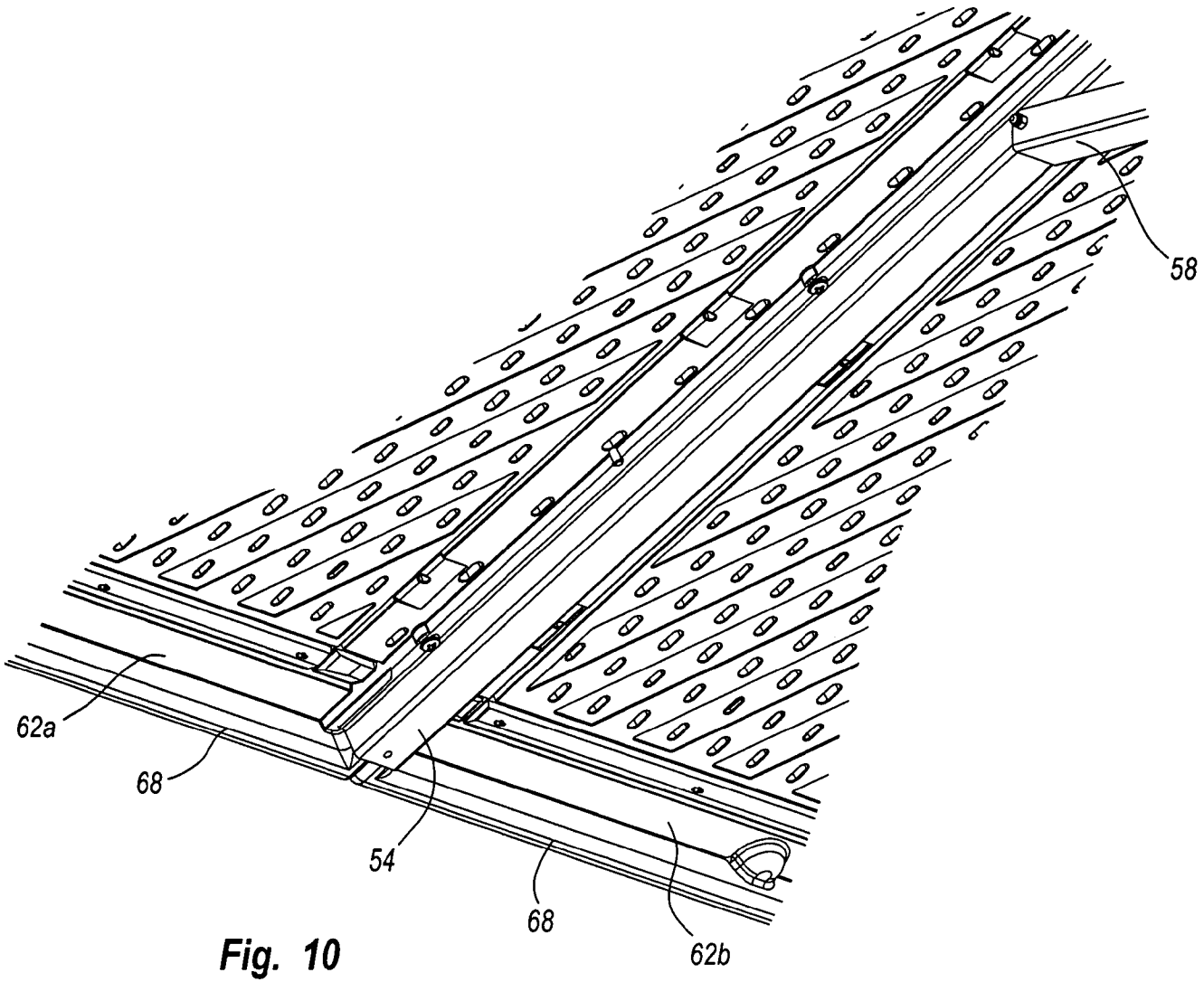
FIG. 10 is a perspective view of a portion of the shed shown in FIG. 1, illustrating an exemplary a connection of a pair of roof panels to a portion of the roof truss.
Figure 11:
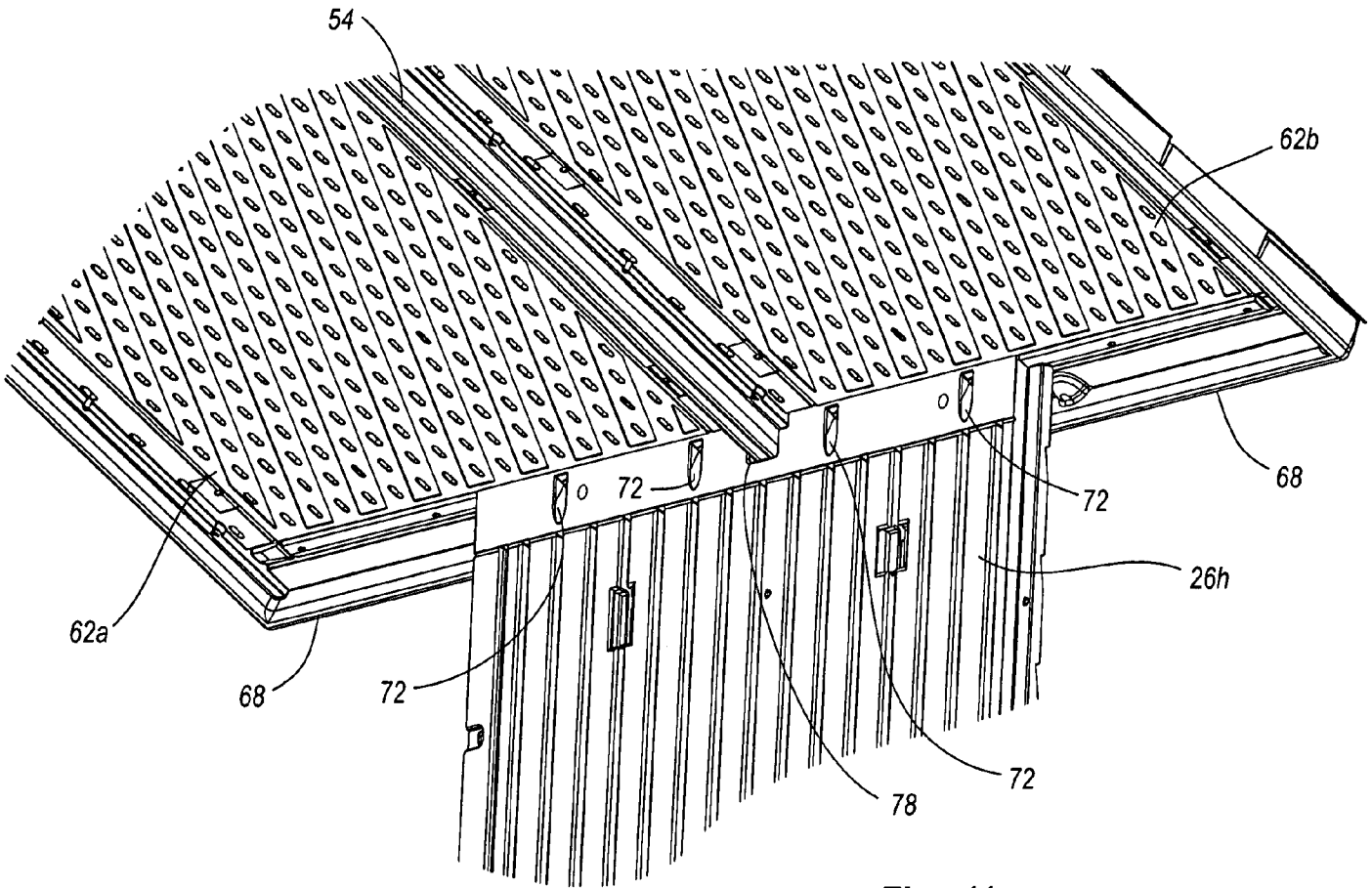
FIG. 11 is a perspective view of a portion of the shed shown in FIG. 1, illustrating an exemplary connection of a wall panel to the roof panels.

The roof truss 52 may be sized and configured to assist in connecting the roof panels to the shed 10, and the truss may be sized and configured to allow any water or moisture that passes between the roof panels to be drained from the shed. For example, as shown in FIGS. 10 and 11, an exemplary support beam 54 of a truss 52 may have a channel that is sized and configured to receive at least a portion of the lower roof panels 62*a* and 62*b*. In particular, the support beam 54 may help connect the lower roof panels 62*a*, 62*b*. Additionally, at least a portion of the lip 68 of the lower roof panel 62*a* and at least a portion of the lip 68 of the lower roof panel 62*b* may be disposed within the channel of the support beam 54. Because the channel and/or other portions of the support beam 54 may be disposed underneath the seam between the lower roof panels 62*a*, 62*b*, any water or moisture penetrating the seam may be collected within the channel. Advantageously, because the truss 52 and the lower roof panels 62*a*, 62*b* preferably extend to and beyond the outer walls of the shed 10, the water or moisture may be transported out of the interior portion of the shed. While the support beam 54 may have a generally U-shaped configuration that defines at least a portion of the channel, it will be appreciated that the truss and support beam may have other suitable shapes, sizes and configurations.

As shown in the accompanying figures, the roof 20 may be connected to one or more wall panels 26. For example, as shown in FIG. 11, the wall panels 26 may include one or more screw bosses 72 that are sized and configured to receive a screw or other fastener to connect the wall panels to the roof (or to other portions of the shed, such as the gables 74, 76). The wall panels 26 preferably include a receiving portion or opening 78 that is sized and configured to receive and/or be connected to at least a portion of the truss 52 and/or lower roof panel 62. In particular, as shown in FIG. 11, the opening 78 may be sized and configured to receive at least a portion of the support beam 54 or other portion the truss 52, at least a portion of the lip 68 of the lower roof panel 62*a* and at least a portion of the lip 68 of the lower roof panel 62*b*. This may allow the truss 52, the lower roof panel 62*a*, the lower roof panel 62*b* and the wall panel 26*h* to be securely connected, which may allow a strong and stable shed 10 to be created.

Advantageously, the roof 20 of the shed 10 may be cost effective because it may be constructed from a plurality of blow-molded panels that may be part of a modular construction. In addition, the blow-molded panels may be strong, lightweight and relatively rigid. The roof 20 may also be constructed with a pitch of about 6:12, which may allow water and snow to quickly and easily run off the roof. Further, the roof may be quickly and easily assembled because it is constructed from a relatively few parts that may be quickly and easily connected.

One of ordinary skill in the art will appreciate that the roof 20 may have other suitable shapes, sizes and configuration depending, for example, upon the intended use and/or design of the shed 10. Additional information and other features of a roof 20 that may be used in connection with the shed 10 are disclosed in Assignee's co-pending application U.S. application Ser. No. 11/091,811, entitled ROOF SYSTEM FOR A MODULAR ENCLOSURE, filed Mar. 28, 2005, which is incorporated by reference in its entirety.

Floor

As discussed above, the shed 10 preferably includes a floor 22 and the floor may provide a base or foundation for the shed. The floor 22 may also help position various components of the shed 10, such as the walls 12, 14, 16, 18 and doors 24. In addition, the floor 22 may increase the potential uses of the shed 10 and it may allow the shed to be used in a wide variety of situations and environments. Further, the floor 22 may include one or more floor panels and the floor panels may be interchangeable. This may allow the floor 22 to be part of a modular construction and, as discussed in greater detail below, the floor panels may have generally the same size and configuration as the wall panels and/or roof panels, which may facilitate manufacturing, shipping and transport of the shed. The floor panels may also have the same type of construction and/or structure as the as the wall panels and/or roof panels, which may also facilitate manufacturing of the shed.

Figure 16:
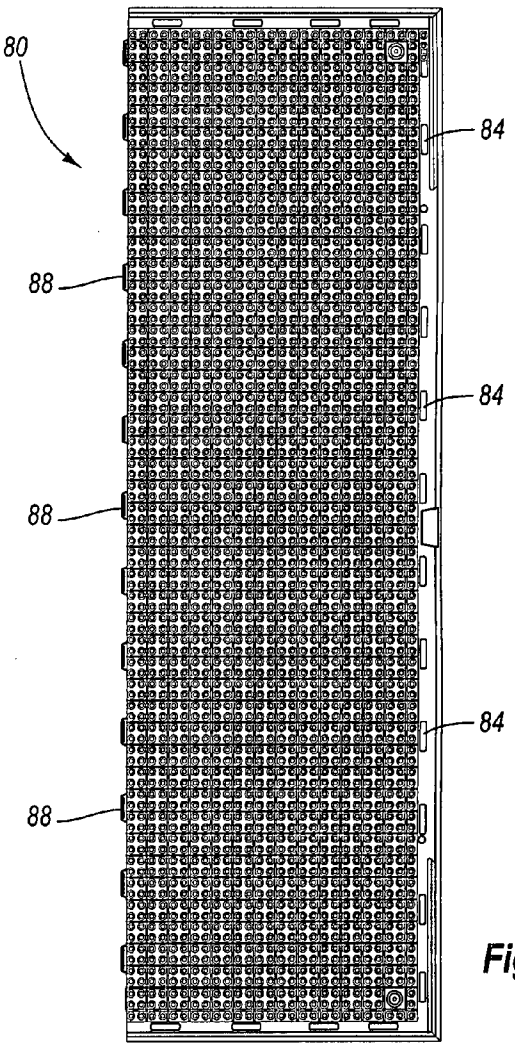
FIG. 16 is a top view of the floor panel shown in FIG. 14.
Figure 15:
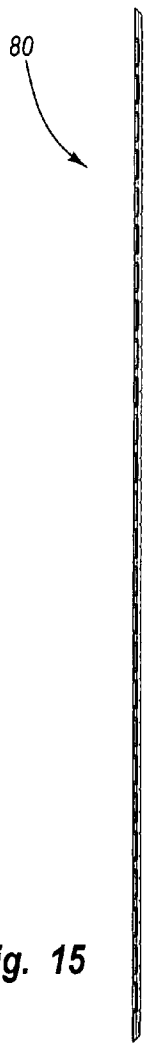
FIG. 15 is a side view of the floor panel shown in FIG. 14.
Figure 14:
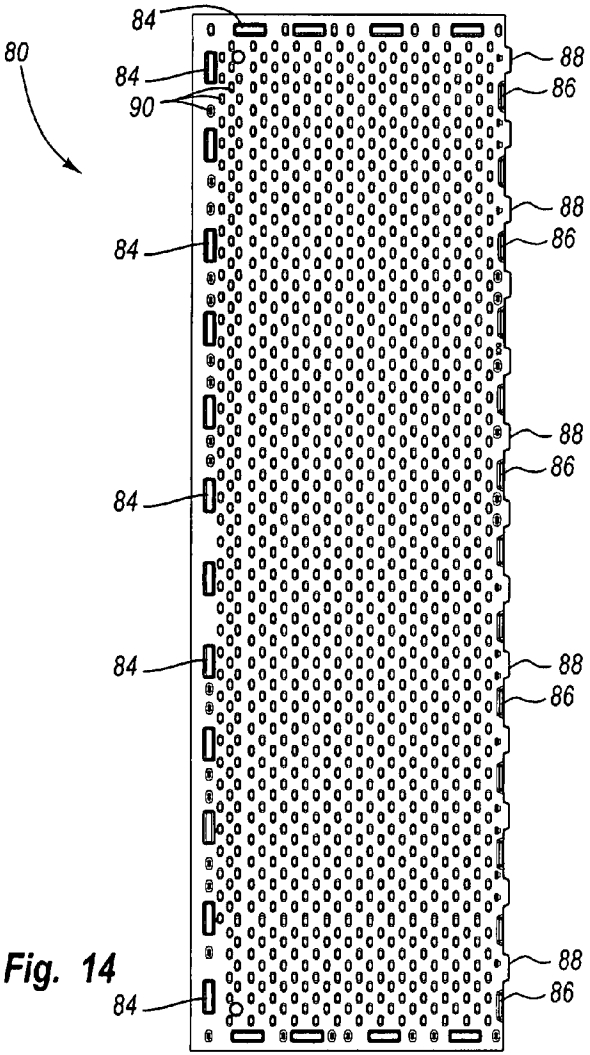
FIG. 14 is a bottom view of an exemplary floor panel.
Figure 18:
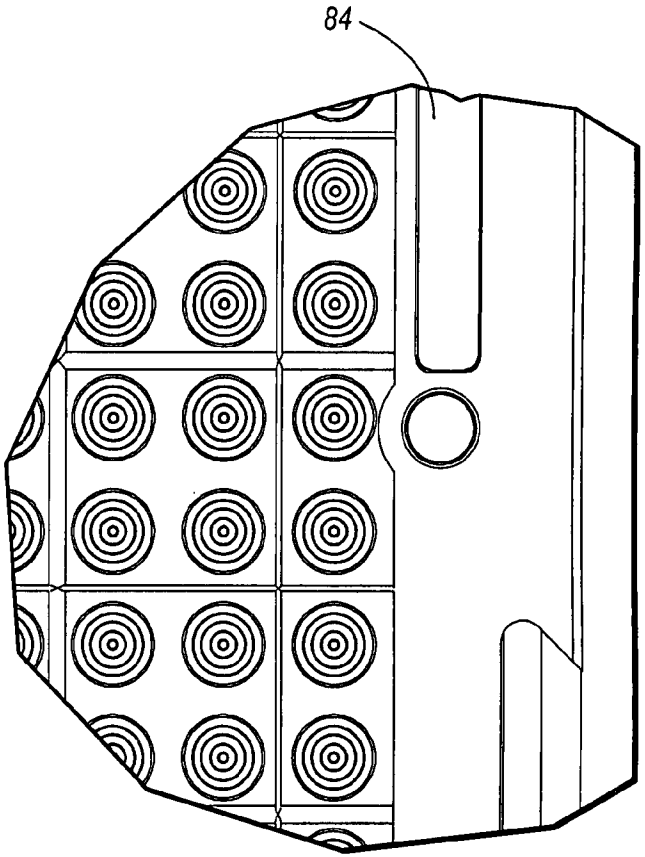
FIG. 18 is an enlarged top view of a portion of the floor panel shown in FIG. 14, illustrating a pattern on the upper surface.

In greater detail, as seen in FIGS. 3 and 4, the floor 22 preferably has a modular construction including end floor panels 80*a*, 80*b* and intermediate floor panels 82*a*, 82*b*. Each of the floor panels 80, 82 may include a top portion, a bottom portion, a front side, a rear side, a left side and a right side. As shown in FIGS. 14-16, each of the end floor panels 80*a*, 80*b* may include a plurality of receiving portions 84 that are preferably sized and configured to allow, for example, the walls 12, 14, 16, 18 to be connected to the floor 22. Desirably, the receiving portions 84 are formed along three of the sides of the end floor panels 80*a*, 80*b*. In greater detail, the end floor panels 80*a*, 80*b* may include receiving portions 84 that are disposed along the left side, the right side and either the front side or the rear side. Similarly, the intermediate floor panels 82*a*, 82*b* may include such receiving portions 84 formed along two of their sides, in particular, the left side and the right side.

The sides of a floor panel without the receiving portions 84 may be sized and configured to be connected to an adjacent floor panel. In particular, the side of the end floor panels 80 without the receiving portions 84 may include a plurality of outwardly extending portions or protrusions that are sized and configured to be attached to an intermediate floor panel 82, and the sides of the intermediate floor panel 82 without the receiving portions 84 may also include a plurality of outwardly extending portions or protrusions that are sized and configured to be attached to an intermediate floor panel 82 or an end floor panel 80. For example, as shown in FIGS. 14-16, the end floor panels 80 may include one or more inwardly extending or recessed portions 86 sized and configured to contact, engage, and/or overlap corresponding protrusions of an intermediate floor panel 82, and the end floor panels may include one or more protrusions 88 sized and configured to contact, engage, and/or overlap corresponding inwardly extending or recessed portions of an intermediate floor panel. Similarly, an intermediate floor panel 82 may include one or more inwardly extending or recessed portions sized and configured to contact, engage, and/or overlap corresponding protrusions of a pair of adjacent floor panels 80, 82, and the pair of floor panels may include one or more protrusions sized and configured to contact, engage, and/or overlap corresponding inwardly extending or recessed portions of the intermediate floor panel. As shown in FIGS. 14-16, the protrusions 88 and the recessed portions 86 of a floor panel 80, 82 preferably alternate, and the protrusions are preferably flush with the bottom surface of the floor panels. In one embodiment, rather than alternating, the protrusions 88 and the recessed portions 86 of a floor panel 80, 82 may be generally aligned, and the protrusions may be alternately flush with top surface or bottom surface of the floor panel. When the two adjacent floor panels are connected by the overlapping and/or corresponding portions, the floor panels may be securely connected. In particular, the floor panels may be connected by a snap, friction or interference fit, or other suitable type of connection. Additionally, if desired, the connection can be reinforced by using, for example, mechanical fasteners such as screws.

Figure 17:
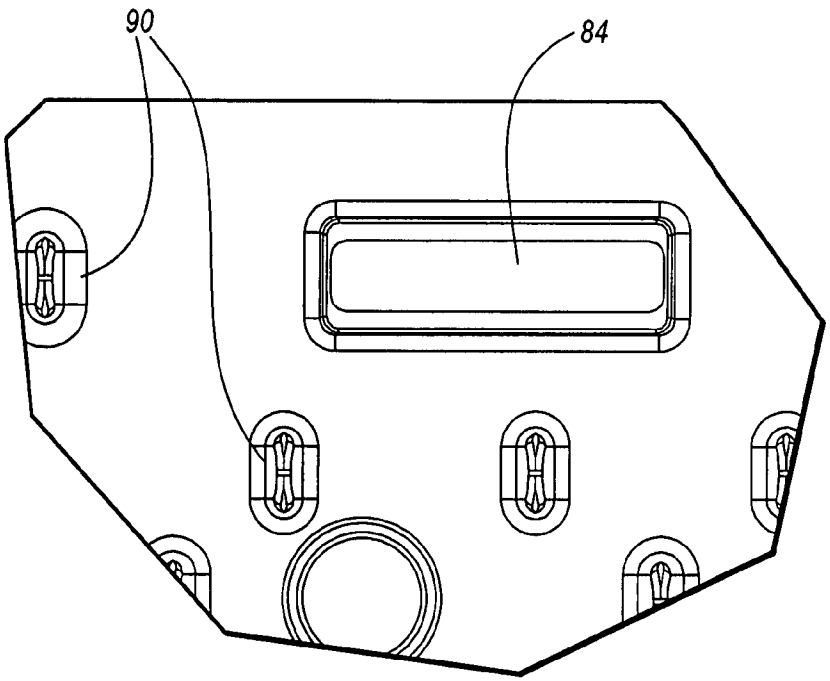
FIG. 17 is an enlarged bottom view of a portion of the floor panel shown in FIG. 14, illustrating a plurality of depressions formed in the lower surface and extending towards the upper surface.

The bottom surface of end floor panels 80 and the intermediate floor panels 82 may include a plurality of depressions, such as depressions 90 shown in FIGS. 14 and 17. As discussed above, the depressions may be sized and configured to increase the strength and/or rigidity of the floor panels 80, 82. In particular, the depressions preferably cover substantially the entire bottom surface of the floor panels 80, 82 so that the panels have generally the same characteristics. It will be appreciated that the depressions may provide an integral support structure to the upper surface of the floor panels 80, 82 and the ends of the depressions may contact or engage the upper surface of the floor panels. On the other hand, the ends of the depressions may also be spaced apart from the upper surface of the floor panels 80, 82. In addition, the depressions are preferably closely spaced in a predetermined patter or array.

As discussed above, while it was previously believed that structures constructed from blow-molded plastic were made stronger by making the walls thicker and/or adding reinforcement structures such as ribs. The increased number of closely spaced depressions, however, provides the surprising and unexpected result that a stronger structure may be created without increasing the wall thickness or adding reinforcement structures such as ribs. In fact, the plurality of closely spaced depressions may allow the structures to be constructed with thinner walls. In addition, the plurality of closely spaced depressions may increase the strength and structural integrity of the structure despite forming disruptions in the continuity of bottom surface of floor panels 80, 82 and less plastic can be used to make the structure even though the plurality of depressions are formed in the structure. The costs of manufacturing and transportation may be decreased because less plastic may be used to construct the floor panels 80, 82 and the panels may allow a lighter weight shed to be constructed.

In particular, the plurality of closely spaced depressions may allow the thickness of the floor panels 80, 82 to be decreased. For example, the floor panels 80, 82 may now have a thickness of about 0.75 inches (1.9 centimeters) and still have the required strength and structural integrity. Additionally, as discussed above, one or both sides of the floor panels 80, 82 may include designs or patterns that allow the height and/or size of the depressions to be decreased. For example, one side of the floor panels 80, 82 may include a pattern and the other side of the floor panels may have a different pattern. The patterns are preferably sized and configured to include a number of points of intersection where the opposing surfaces are more closely spaced than other portions of the panels 80, 82. Advantageously, this may allow depressions to be located at the points of intersection of the patterns and the depressions may have a smaller size and/or height because the distance separating these points may be smaller. Because the depressions have a smaller size and/or height, that may allow the floor panels to be constructed with a thickness of about 0.75 inches (1.9 centimeters) or less.

The floor panels 80, 82 are preferably sized and configured to be directly connected to the walls 12, 14, 16, 18. As discussed above, the wall panels 26*a-b* and the corner panels 28*a-d* may include a number of outwardly extending protrusions 44 that are sized and configured to connect the wall panels to the floor panels 80, 82. In particular, as shown in the accompanying figures, exemplary wall panels 26*a*, 26*b* are joined together and connected to exemplary floor panel 82*a*. The protrusions 44 extending outwardly from the wall panels 26*a*, 26*b* are at least partially disposed within the receiving portions 84 formed in the floor panels 80, 82. Advantageously, the interconnection between the floor panels 80, 82 and the wall panels 26 or the corner panels 28 can be made by snap, interference or friction fit. In addition, as discussed above, the protrusions 44 can include one or more locking portions 46 and the receiving portions 84 can have a smaller opening or inwardly extending lip. The locking portions 46 and the opening or inwardly extending lip are preferably sized and configured so that as the protrusions 44 are being inserted into the receiving portions 84, the opening or inwardly extending lip may move, deform or deflect slightly to allow the protrusion to be inserted into the receiving portion. When the protrusion 44 is fully disposed within the receiving portion 84, the locking portions 46 may help prevent the wall or corner panel 26, 28 from being inadvertently removed from the floor panel 80, 82. Advantageously, the various protrusions 44, locking portions 46, receiving portions 84 and the like may allow the components to be connected in a modular or interchangeable manner.

One of ordinary skill in the art will appreciate that the floor 22 and the interconnection of the walls 12, 14, 16, 18 and the floor could have other suitable arrangements and configurations. For example, floor 22 may include one or more features described in Assignee's co-pending application U.S. application Ser. No. 11/091,861, entitled FLOOR FOR A MODULAR ENCLOSURE, filed Mar. 28, 2005, which is incorporated by reference in its entirety.

Offset Configuration

Figure 19:
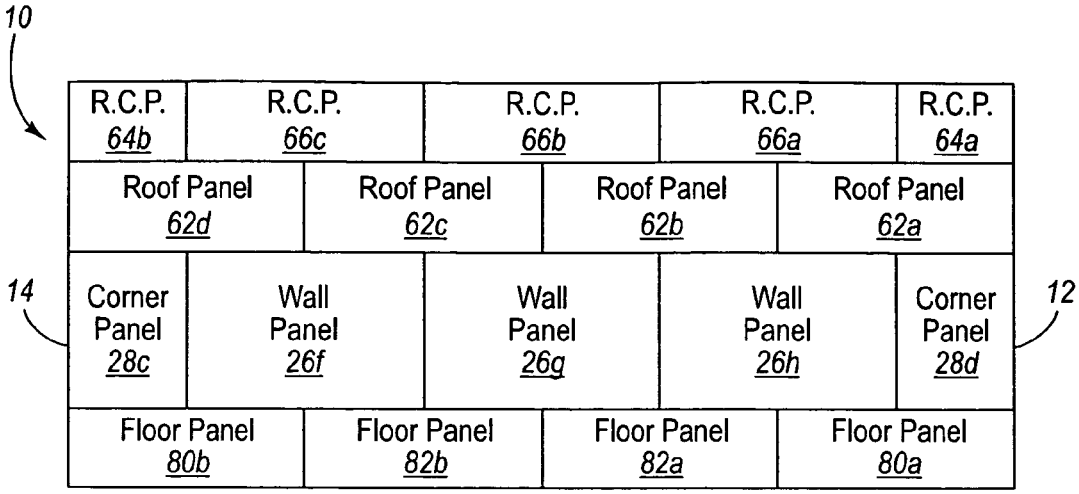
FIG. 19 is a block diagram of a left side view of a shed, illustrating an exemplary configuration of the roof caps, roof panels, corner panels, wall panels and floor panels.
Figure 20:
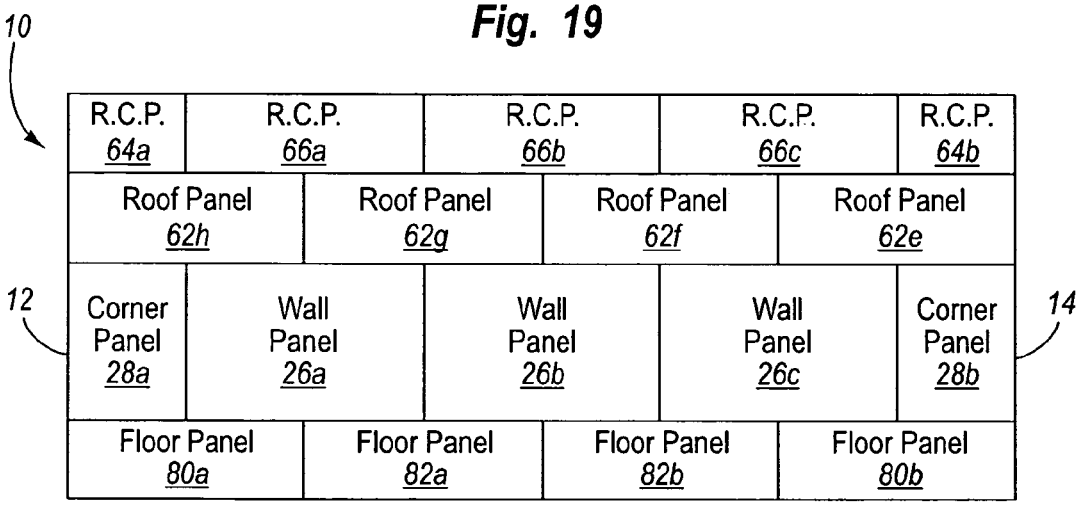
FIG. 20 is a block diagram of a right side view of a shed, illustrating an exemplary configuration of the roof caps, roof panels, corner panels, wall panels and floor panels.

As shown in FIGS. 1-4 and in FIGS. 19 and 20, the connection of the floor panels 80, 82 may be offset from the connection of wall panels 26 and/or the connection of wall panels 26 and corner panels 28. This configuration can assist making a strong and sturdy shed 10 because the connections or seams formed by joining adjacent floor panels 80, 82 and the connections or seams formed by joining adjacent wall panels 26 (and/or a wall panel 26 and a corner panel 28) are not aligned. In addition, as seen in FIGS. 1-4 and in FIGS. 19 and 20, the connection of the roof panels 62 may be offset from the connection of wall panels 26 and/or the connection of wall panels 26 and corner panels 28. Preferably, the connection of the floor panels 80, 82 and the connection of the roof panels 62 are generally vertically aligned and these connections are offset or spaced apart from the connection of the wall panels 26 to wall panels 26 or corner panels 28. Advantageously, this may allow a strong and sturdy shed 10 to be constructed.

Significantly, the offset or spaced apart connection between the floor panels 80, 82 and the panels 26, 28; and the offset or spaced apart connection between the roof panels 62 and the panels 26, 28 may be created by the corner panels 28. As discussed above, the corner panels 28 desirably include a living hinge, which may bisect the panel in half. Thus, the corner panel 28 preferably has one-half the width of a wall panel 26. The wall panels 26, roof panels 62 and floor panels 80, 82, preferably have generally the same width. Therefore, when the shed 10 is assembled, the corner panels 28 with the living hinges cause the connection of the wall panels 26, 28 to be offset from the connection of the roof panels and floor panels. This offset configuration can assist to strengthen the interlocking connections formed between wall panels 26, corner panels 28, roof panels 62, and floor panels 80, 82. Further, this offset configuration may increase the structural integrity of the shed 10 by staggering the locations of the connection of the panels. The shed 10, however, may be relatively easy to assembly, manufacture and ship because the wall, corner, roof and floor panels may have generally the same dimensions when the corner panels are disposed in the flat, planar configuration.

The size and configuration of the shed 10 may also be changed, if desired. For example, the shed 10 may have specified dimensions, but the dimensions may be changed to expand or contract the size of the shed. In particular, an expansion kit may be used to change the size and configuration of the shed 10. Advantageously, this may allow the shed 10 to be sold with one size and expansion kits may also be sold to allow the size and configuration of the shed to be changed. This may greatly enhance the potential uses of the shed 10.

Figure 21:
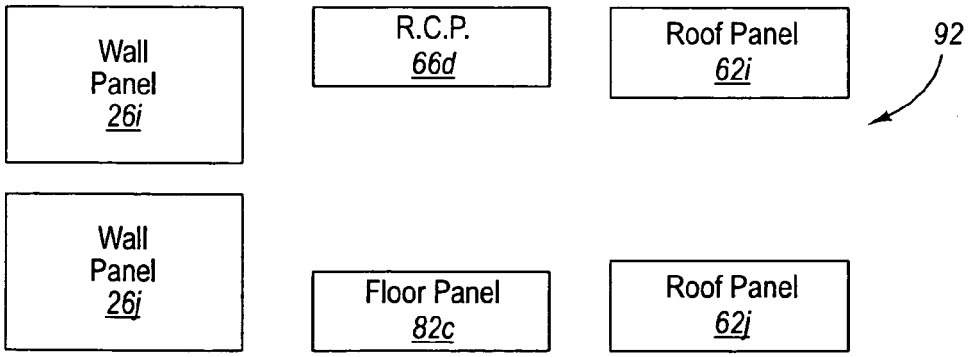
FIG. 21 is a block diagram of an exemplary embodiment of an extension kit.
Figure 22:
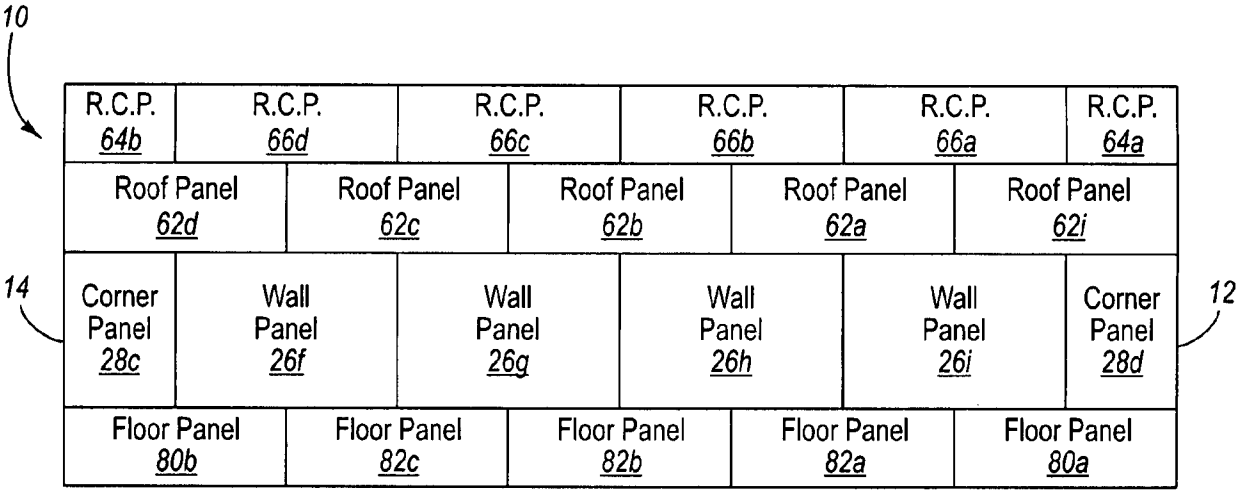
FIG. 22 is a block diagram of a left side view of the shed shown in FIG. 19, illustrating a use of the extension kit shown in FIG. 21 to enlarge the size of the shed.
Figure 23:
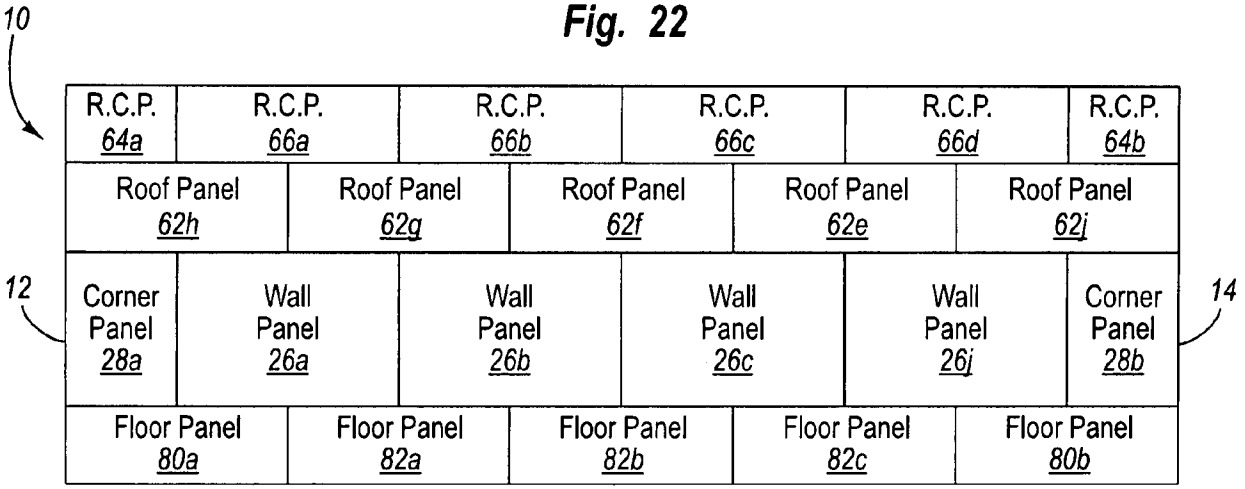
FIG. 23 is a block diagram of a right side view of the shed shown in FIG. 22.
Figure 24:
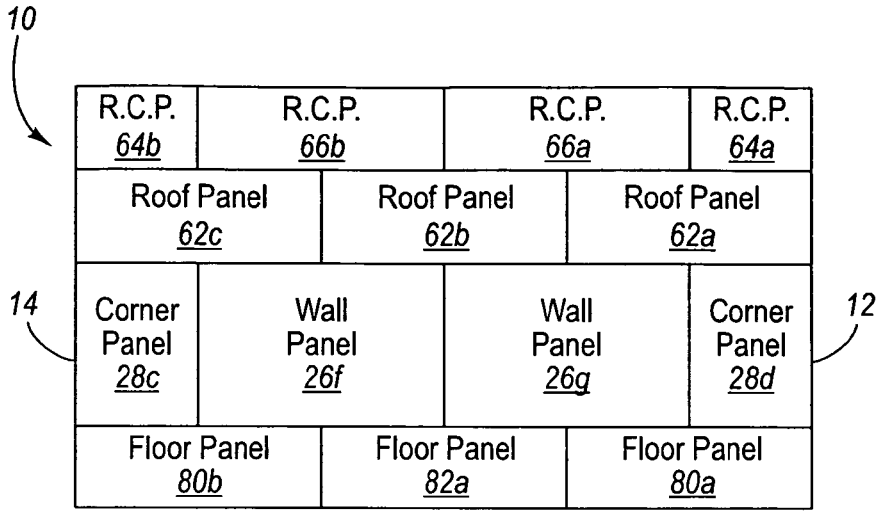
FIG. 24 is a block diagram of a left side view of the shed shown in FIG. 19.
Figure 25:
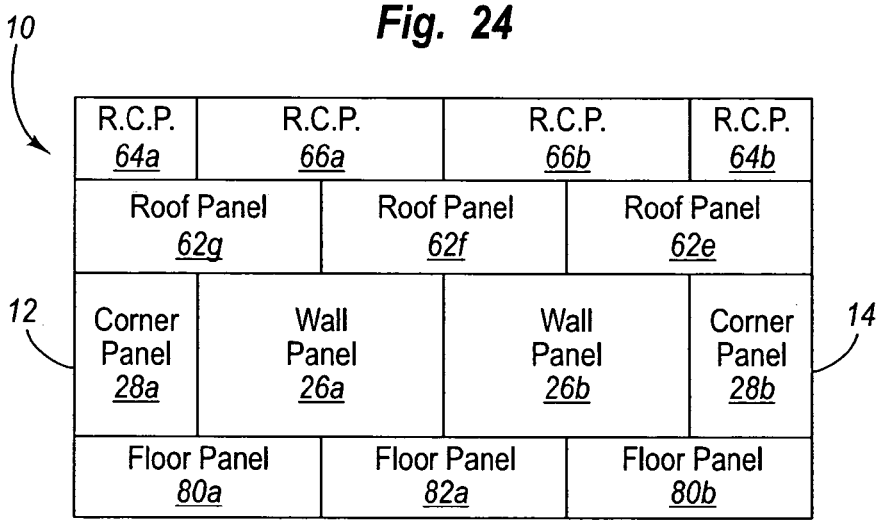
FIG. 25 is a block diagram of a right side view of the shed shown in FIG. 22.
Figure 26:
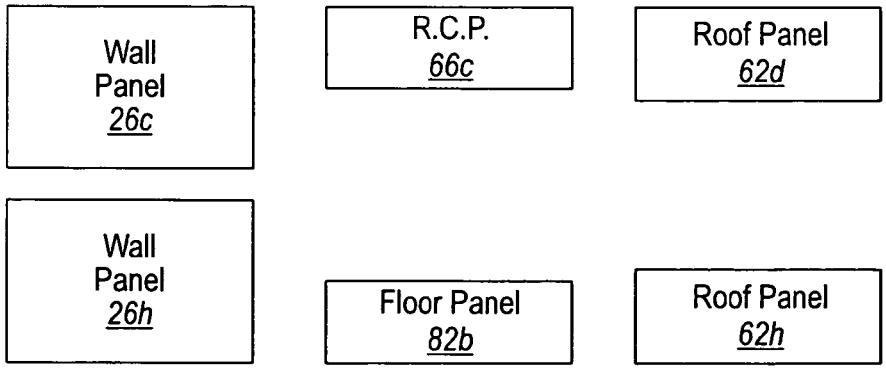
FIG. 26 is a block diagram of an exemplary embodiment of components of the shed shown in FIG. 19.

For example, the shed 10 may have a first size as shown in FIGS. 19 and 20 and the shed 10 may be expanded to the size shown in FIGS. 22 and 23 using an expansion kit 92. In particular, as shown in FIG. 21, the expansion kit 92 may include a wall panel 26*i*, a wall panel 26*j*, an intermediate roof cap portion 66*d*, an intermediate floor panel 82*c*, a lower roof panel 62*i* and a lower roof panel 62*j*. As shown in FIGS. 22 and 23, the expansion kit 92 may be used to provide, for example, a longer shed 10. The expansion kit 92 may also include a truss, one or more fasteners, and/or other components suitable for expanding the size of the shed 10. Also, the size of the shed 10 shown in FIGS. 19 and 20 may be contracted to the size shown in FIGS. 24 and 25 by removing various components, such as those shown in FIG. 26. Thus, it will be understood that the shed 10 may have a variety of suitable sizes and configurations.

It will be appreciated that the shed 10 may have other suitable arrangements and configurations. For instance, the shed 10 may include one or more of the features disclosed in Assignee's co-pending application U.S. application Ser. No. 11/091,837, entitled MODULAR ENCLOSURE WITH OFFSET STRUCTURES, filed Mar. 28, 2005, which is incorporated by reference in its entirety.

Packaging

Advantageously, the various components of the shed 10 may be sized and configured to be compactly packaged in one or more shipping boxes or other containers. For example, many of the components may have generally similar dimensions to facilitate packaging. In addition, some of the components may include one or more cavities or recesses in which other components of the shed 10 may be disposed. In particular, one or more of the panels may include an outwardly extending lip and the lip may help define a cavity or recess in which other components may be disposed. A number of the components may also be sized and configured to permit the components to be packaged in substantially uniform layers. For instance, many of the components may have substantially the same height and/or thickness to facilitate packaging of the shed 10.

Various components may also include one or more living hinges that allow the components to be stored or packed in a generally flat or planar configuration. Significantly, this may minimize the size of the required packaging. In addition, the relatively small size of the packaging may allow the shed 10 to be more easily transported and stored. The relatively small size packaging may also facilitate the consumer transporting and moving the shed 10, such as from the store to the person's home or office Exemplary Floor and Roof Panels As discussed above, the floor 22 of the shed 10 may be constructed from one or more panels, such as the floor panels 80, 82. As shown in FIGS. 1-4, the floor panels 80, 82 preferably span the width of the shed 10 from the left sidewall 16 to right sidewall 18. Accordingly, the floor panels 80, 82 may each be connected to the sidewalls 16, 18.

Figure 27:
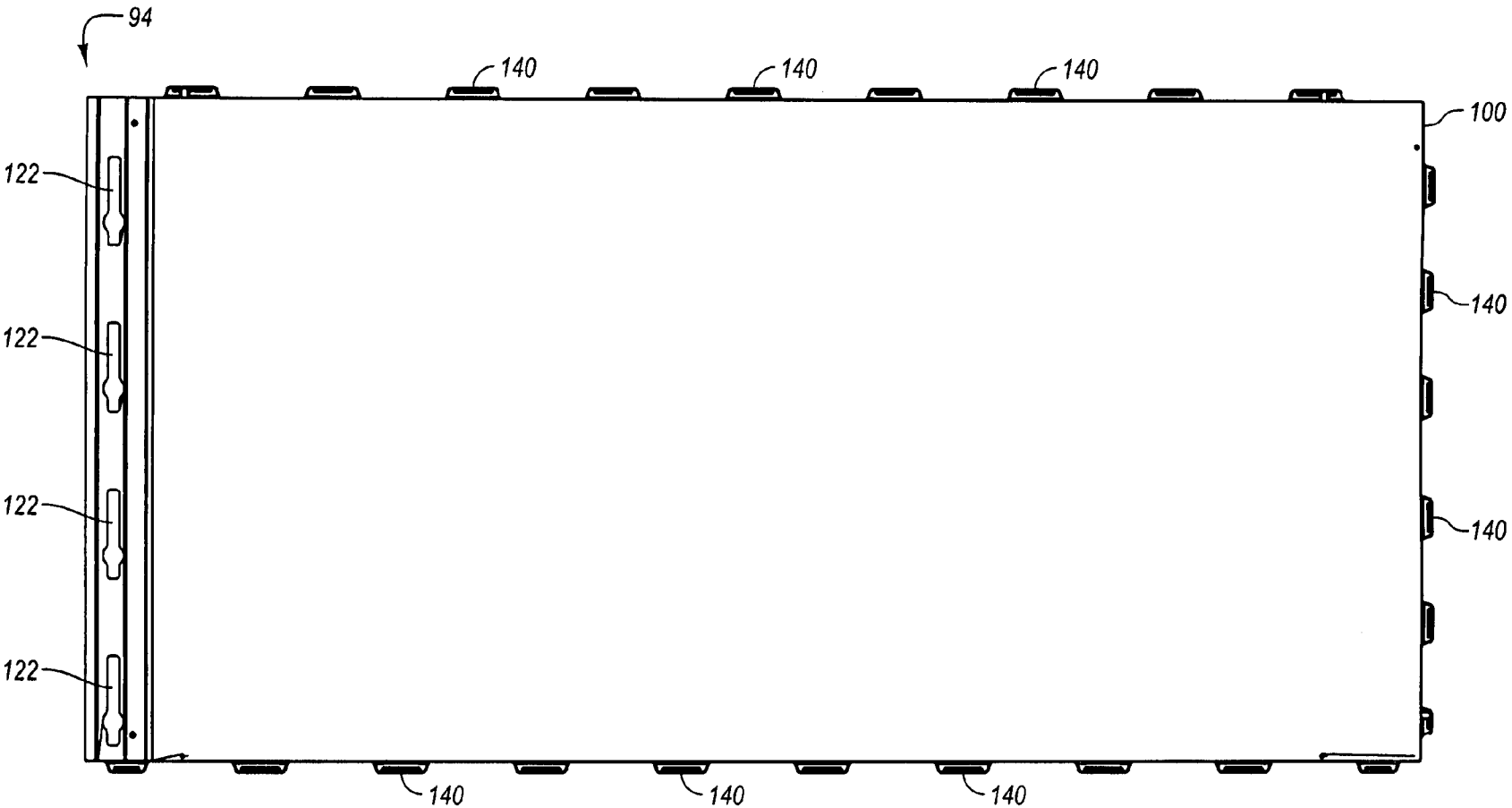
FIG. 27 is a top view of an exemplary embodiment of a floor panel.
Figure 28:
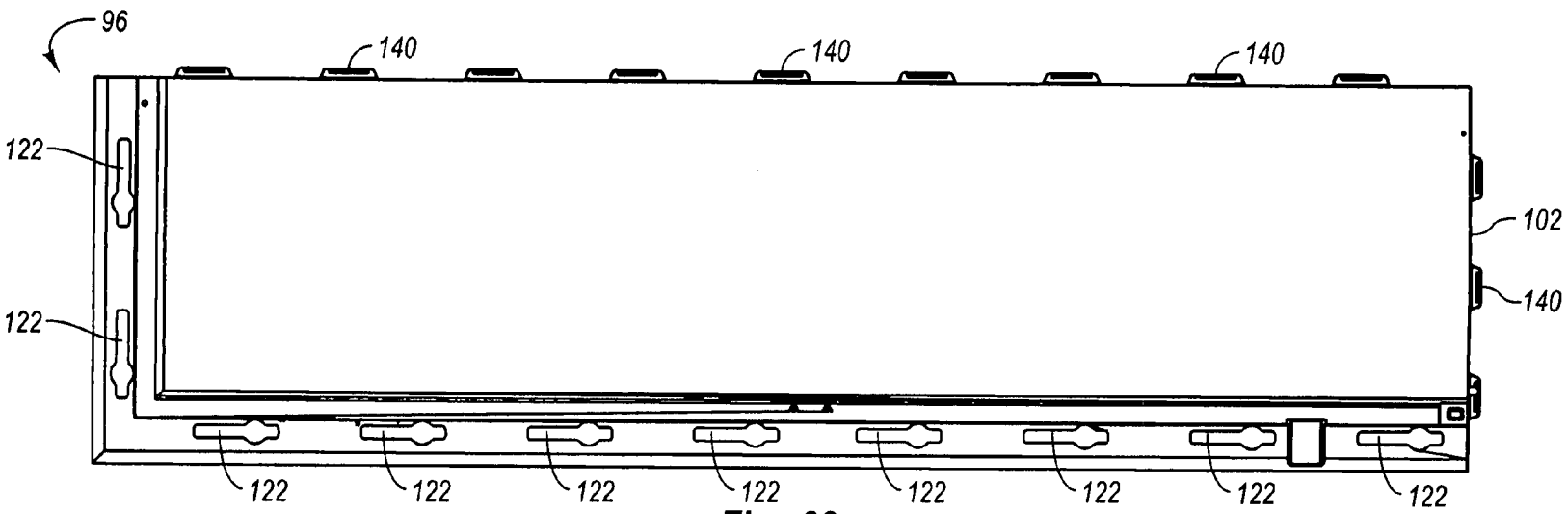
FIG. 28 is a top view of another exemplary embodiment of a floor panel.
Figure 29:
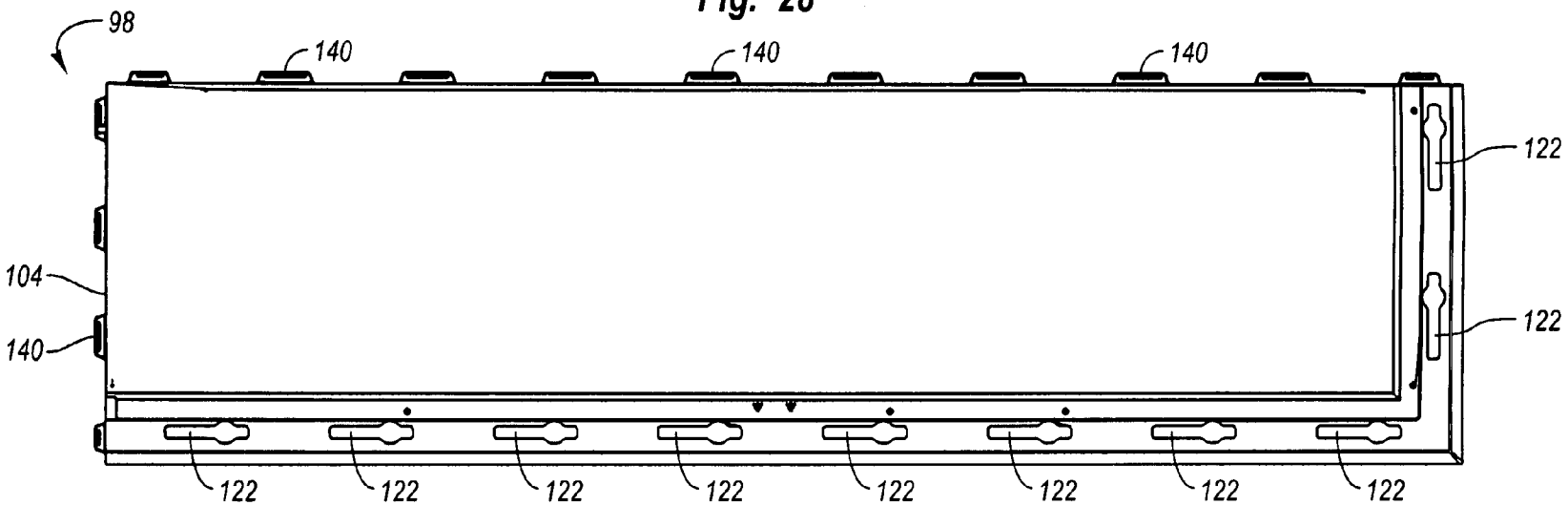
FIG. 29 is a top view of yet another exemplary embodiment of a floor panel.
Figure 30:
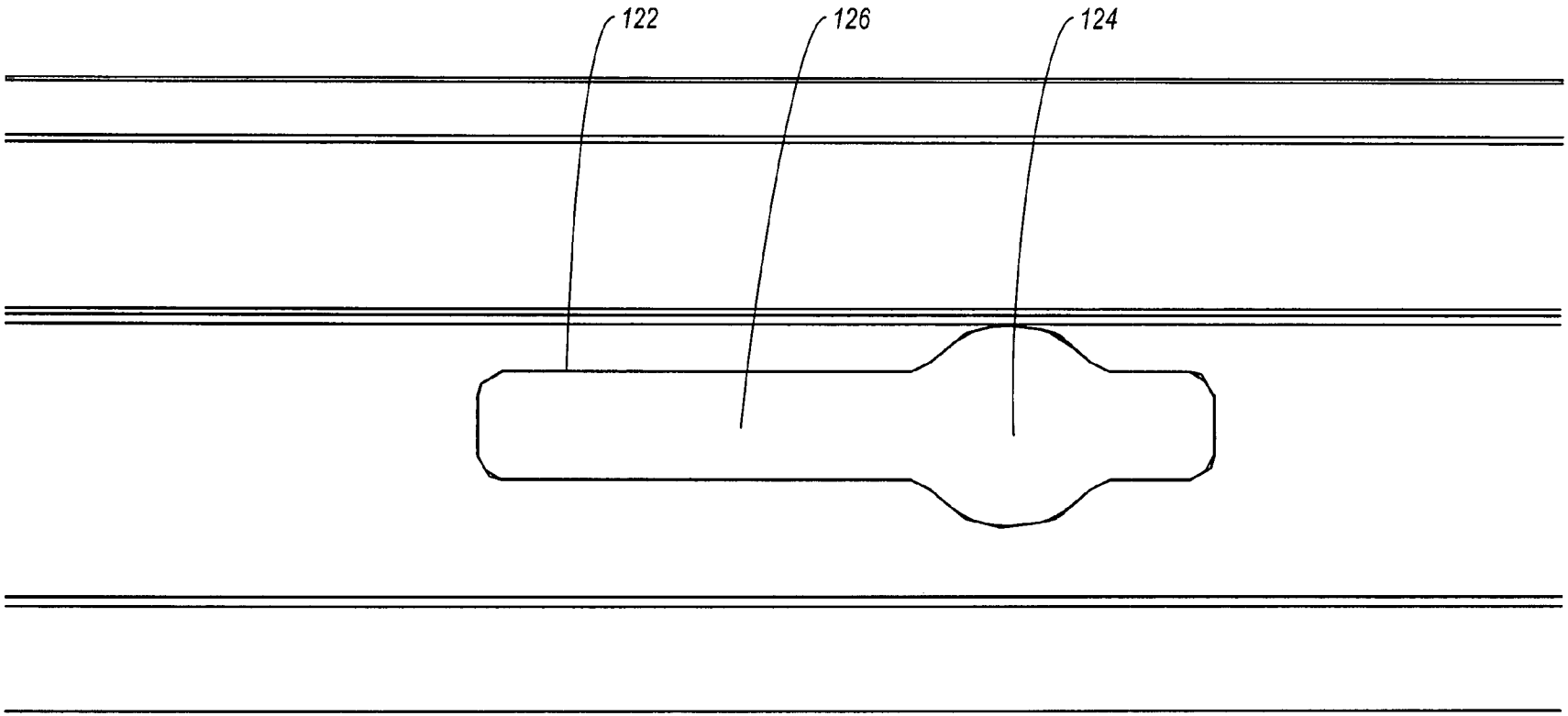
FIG. 30 is an enlarged top view of a portion of a floor panel, illustrating an exemplary embodiment of a receiving portion.
Figure 31:
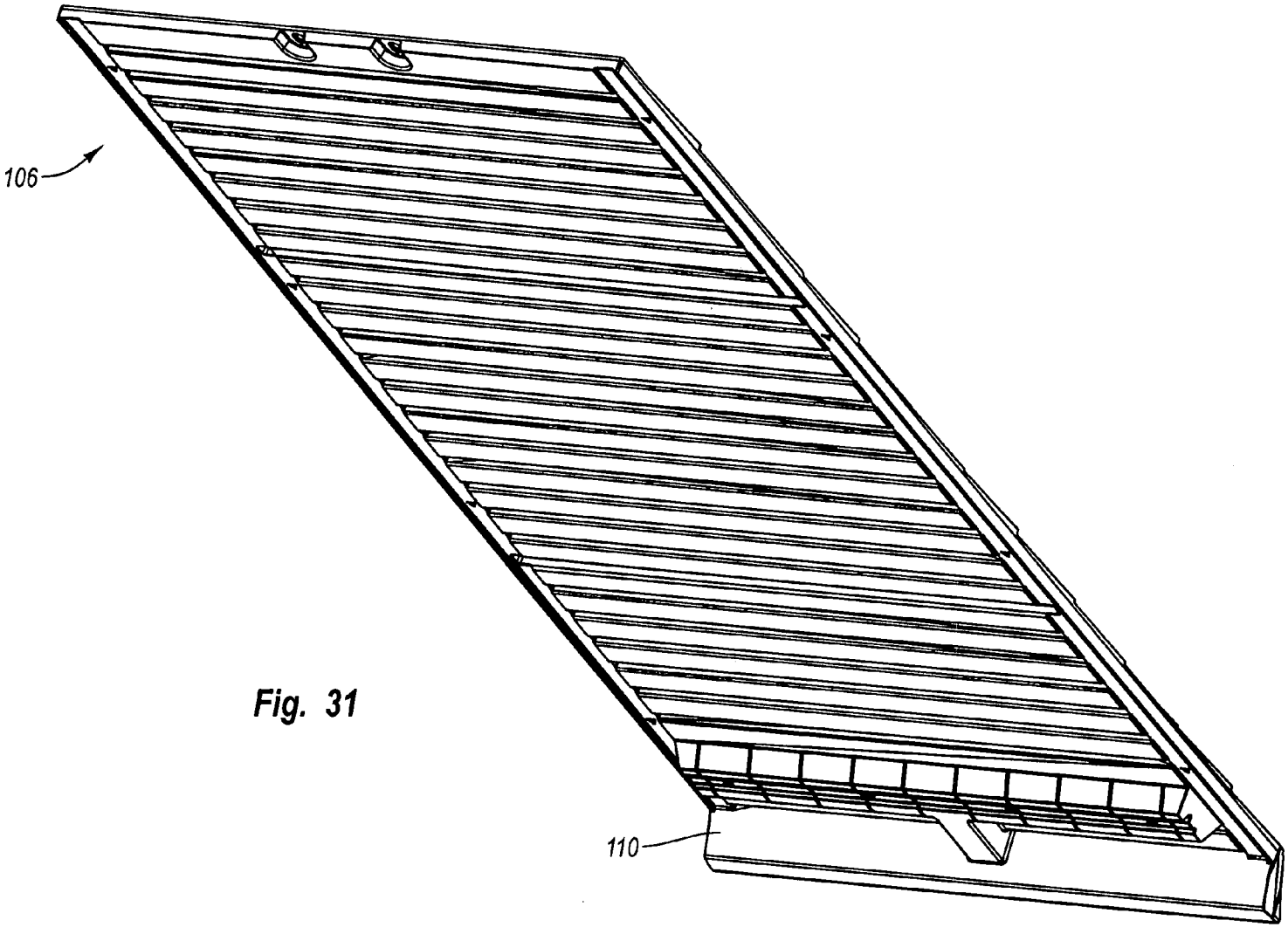
FIG. 31 is a perspective view of an exemplary embodiment of a roof panel.
Figure 32:
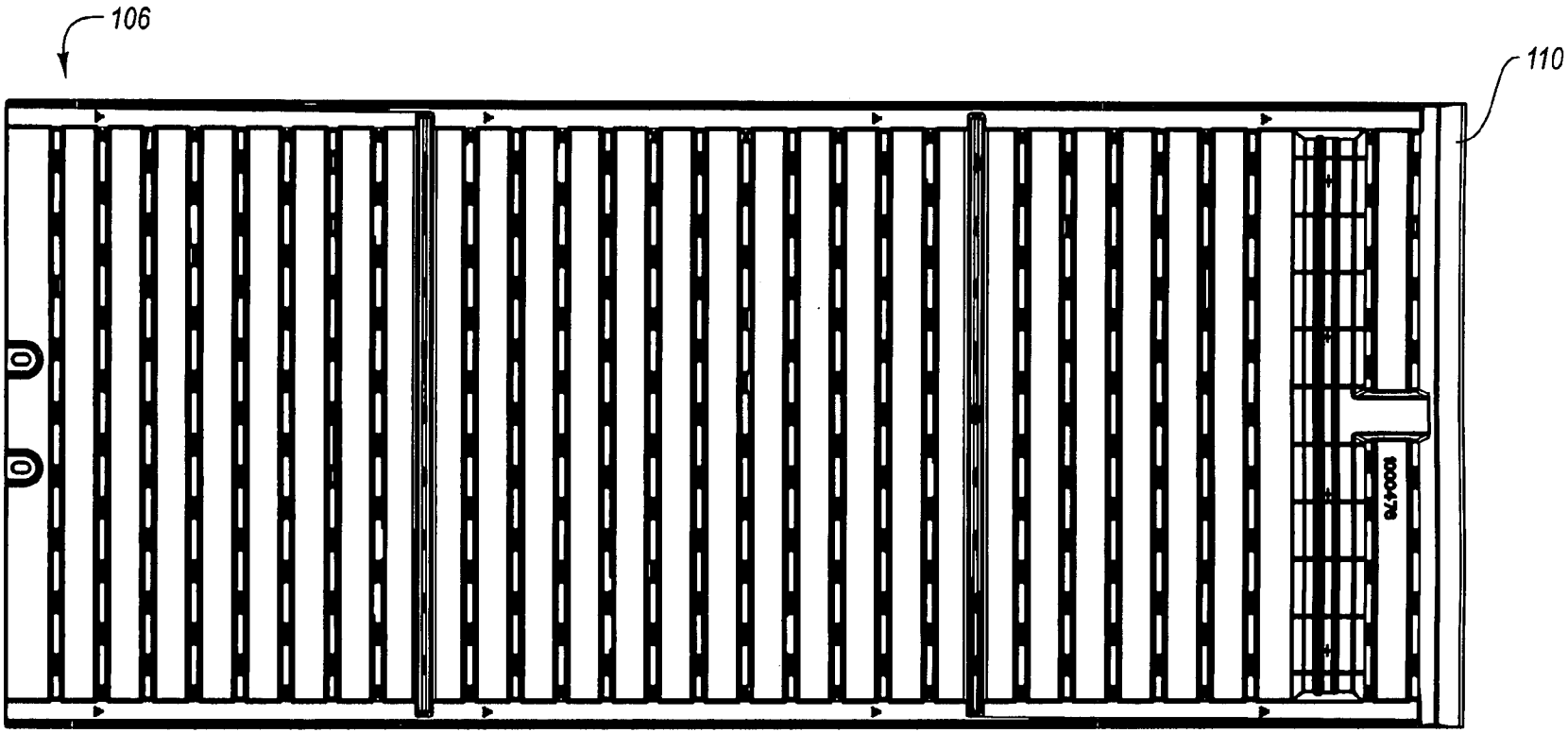
FIG. 32 is a bottom view of the roof panel shown in FIG. 31.
Figure 33:
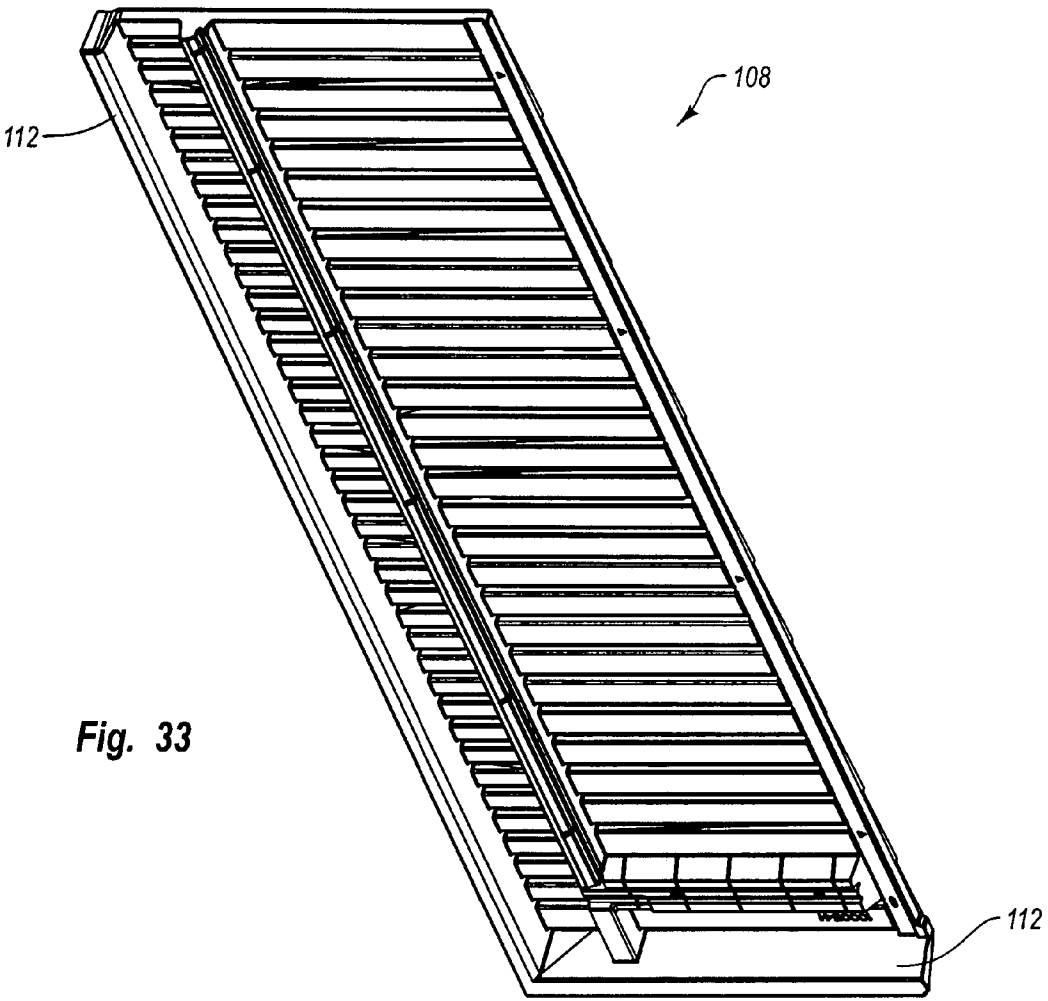
FIG. 33 is a perspective view of another exemplary embodiment of a roof panel.
Figure 34:
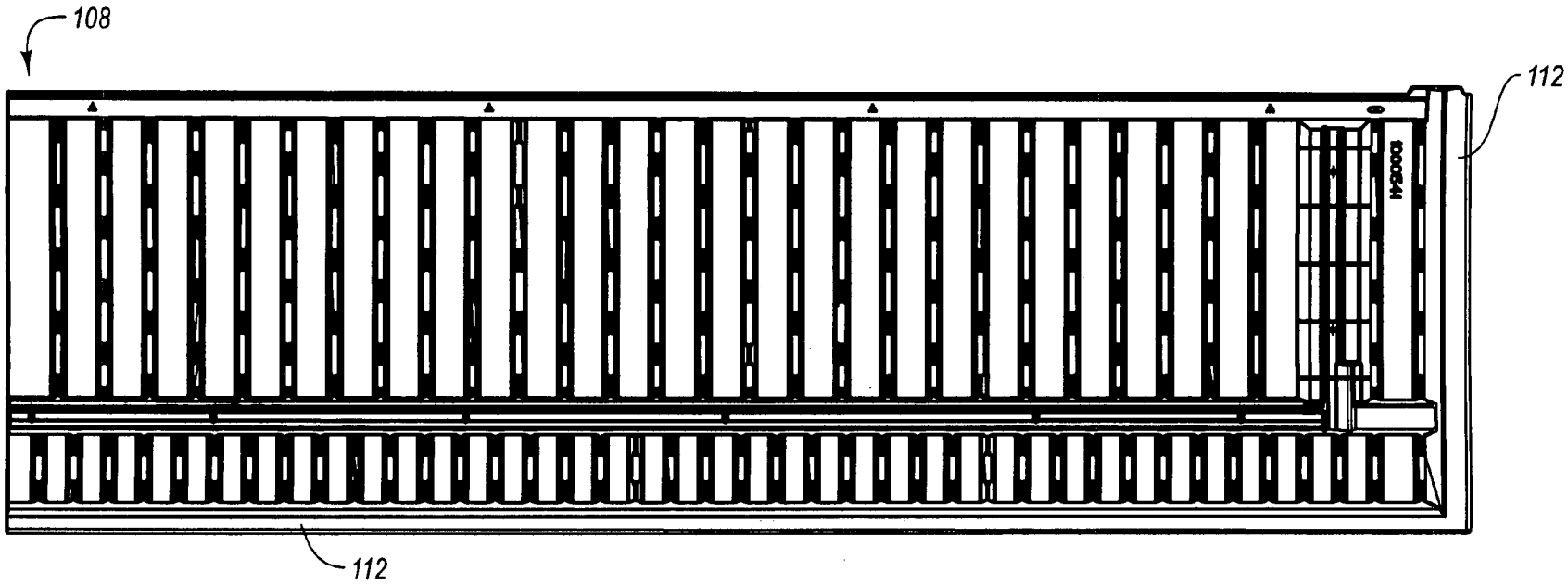
FIG. 34 is a bottom view of the roof panel shown in FIG. 33.
Figure 35:
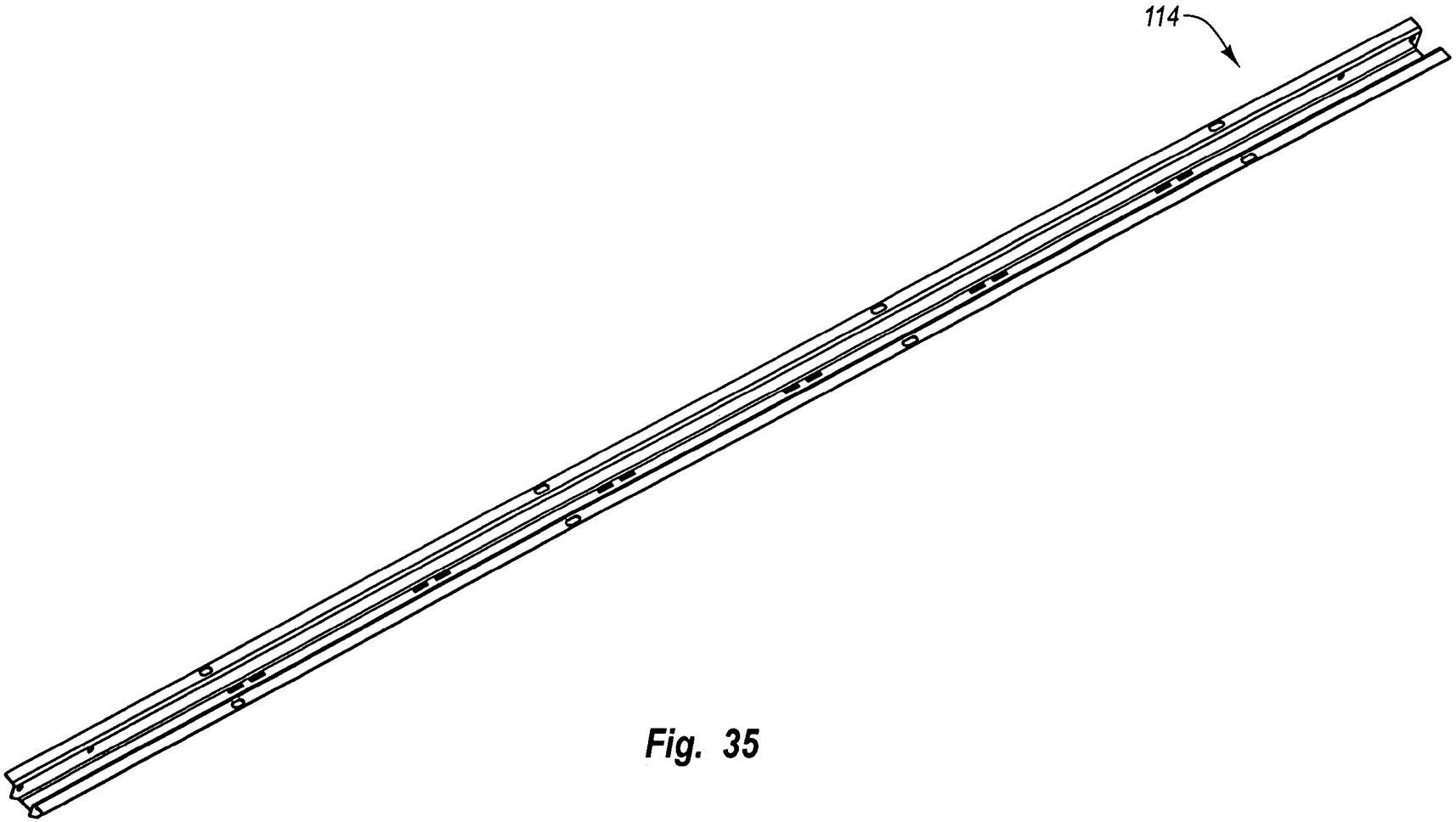
FIG. 35 is a perspective view of an exemplary embodiment of a bracket or support member.
Figure 36:
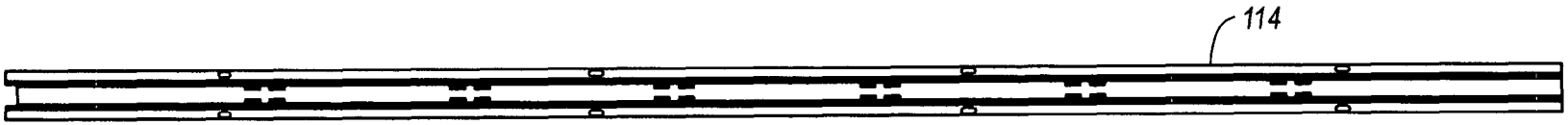
FIG. 36 is a front view of the bracket shown in FIG. 35.
Figure 37:
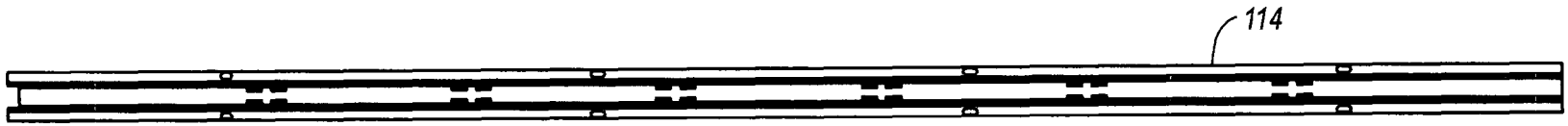
FIG. 37 is a rear view of the bracket shown in FIG. 35.
Figure 38:
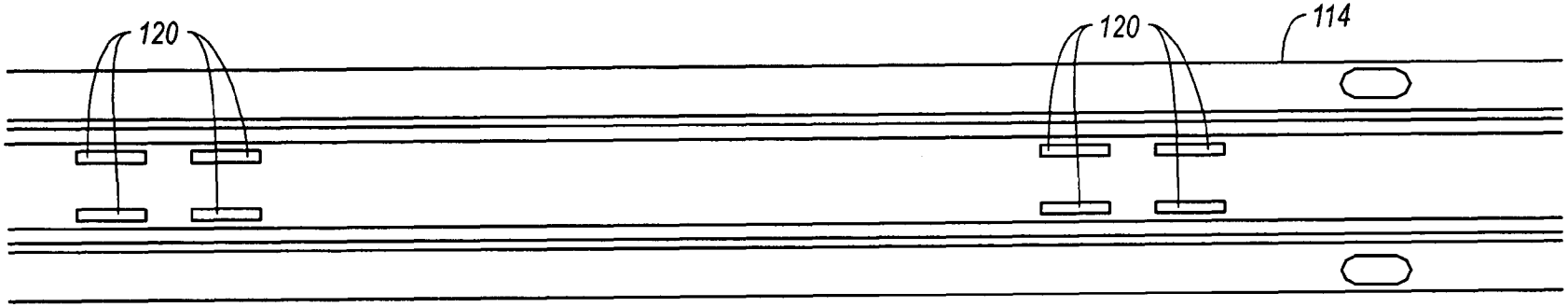
FIG. 38 is an enlarged front view of a portion of the bracket shown in FIG. 35.
Figure 43:
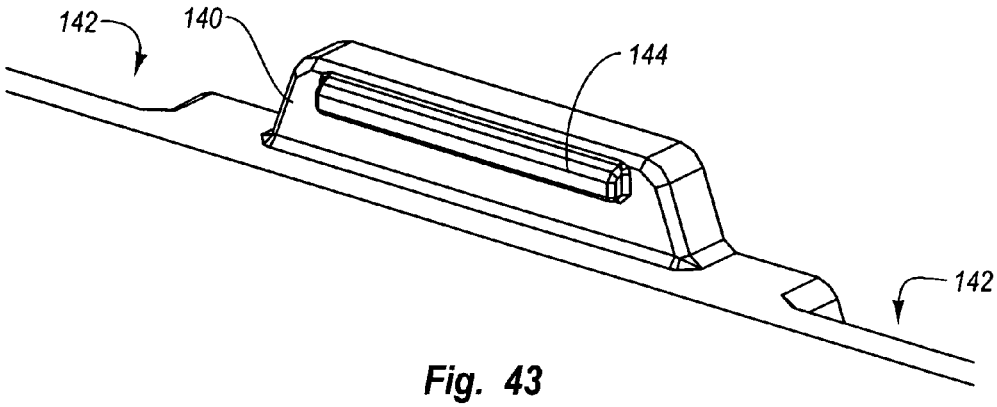
FIG. 43 is a top perspective view of a portion of another exemplary floor panel.
Figure 44:
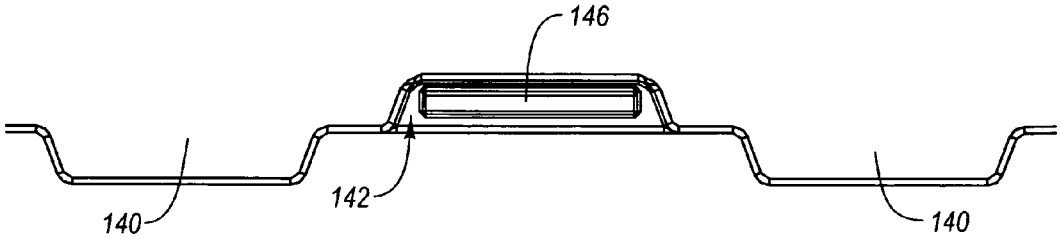
FIG. 44 is a bottom view of the portion of the floor panel shown in FIG. 43.

The floor panels of the floor 22, however, need not span the width of the shed 10 from the left sidewall 16 to right sidewall 18. Instead, two or more floor panels may be interconnected to span the width of the shed 10. For example, a pair of floor panels 94 (FIG. 27) may be interconnected to span the width of the shed 10, and a floor panel 96 (FIG. 28) and a floor panel 98 (FIG. 29) may be interconnected to span the width of the shed 10. In particular, interior edges 100 of the floor panels 94 may be connected to allow the floor panels to span the width of the shed 10. In addition, the interior edges 102, 104 of the floor panels 96, 98 are connected to allow the floor panels to span the width of the shed. The floor panels 94, 96, 98 may include one or more outwardly extending portions or protrusions 140 and/or one or more inwardly extending or recessed portions 142 (FIG. 43), which may be sized and configured to be connected to an adjacent floor panel.

Because two or more floor panels may be used to span the width of the shed, the size of the shipping boxes or containers may be reduced. For example, if the shed 10 has a width of about 10 feet (about 3 meters), the two floor panels that are about 5 feet (about 1.5 meters) in length may be interconnected to span the 10-foot width of the shed. Advantageously, the 5-foot floor panels may fit within a shipping box that is about 80 inches (about 2 meters) in length. Of course, the shed, floor panels and/or shipping boxes may have other suitable dimensions depending, for example, upon the size and shape of the shed.

As discussed above, the shed 10 may include a plurality of roof panels with a lip disposed on one or more sides. For example, the roof 20 may include a plurality of roof panels 106, 108 shown in FIGS. 31-34. The roof panels 106 may include lip 110, which is preferably disposed on a single side of the roof panels 106, and the roof panels 108 may include a lip 112, which is preferably disposed on two adjacent sides of the roof panels 108.

As discussed above, roof panels may be positioned within the shipping boxes so that storage areas or cavities are disposed between the panels. Advantageously, the storage areas or cavities disposed between the roof panels 106 may be sized and configured to receive all or at least a portion of one or more floor panels 94, 96, 98, and the storage areas or cavities disposed between the roof panels 108 may also be sized and configured to receive all or at least a portion of one or more floor panels 94, 96, 98. In particular, the sizes and dimensions of the roof panels 106, 108 may be configured to allow the floor panels 94, 96, 98 to be disposed within the storage areas or cavities.

Because the storage areas or cavities disposed between the roof panels may be sized and configured to receive all or at least a portion of one or more floor panels, the size of the shipping boxes or containers may be reduced. For example, in an exemplary embodiment, the floor panels 94, 96, 98 may have a length of about 5 feet (about 1.5 meters), the roof panels 106, 108 may have a length of about 68 inches (about 1.7 meters), the roof panels may include a lip that is about 3 inches (about 7.6 centimeters) in length, and the roof panels may be sized and configured to overhang about 5 inches (about 12.7 centimeter). It will be appreciated, however, that the roof panels 106, 108 may include a lip disposed on one, two, three or more sides, if desired. It will be further appreciated that the lips 110, 112 of the roof panels 106, 108 may have may be disposed on one, two, three or more sides of the roof panels to help form the storage areas or cavities.

In addition, because the storage areas or cavities disposed between the roof panels may be sized and configured to receive all or at least a portion of one or more floor panels, the length of the lip may be increased without substantially increasing the shipping boxes or containers. This may advantageously give the roof a thicker, sturdier appearance without substantially increasing the shipping boxes or containers.

Exemplary Brackets

As discussed above, the shed 10 may include one or more trusses, such as trusses 52, which may help increase the rigidity and/or strength to the shed. As shown in FIGS. 35-40, the shed 10 may also include one or more support beams or members, such as a bracket 114. The brackets 114 may be connected the trusses 52, which may further increase the rigidity and/or strength of the shed. In particular, a bracket 114 may be disposed along one side of the shed and another bracket 114 may be disposed along the other side of the shed and it may be connected to the same truss. Because the bracket 114 may increase the strength and rigidity of the shed, the wall panels do not require any reinforcing members 148, which may help reduce the manufacturing costs of the wall panels. It will be appreciated, however, the wall panels may still include the reinforcing members 48, if desired. may help reduce the manufacturing costs of the wall panels. It will be appreciated, however, the wall panels may still include the reinforcing members 148, if desired.

To even further increase the strength and rigidity of the shed, the bracket 114 is preferably connected to a truss and/or at least one floor panel. For example, the bracket 114 may extend along at least a substantial portion of the height of the wall panel to allow the bracket be connected to at least one floor panel and/or a portion of a truss (such as, a support beam 54). In particular, the bracket 114 preferably extends along at least a third of the height of the wall panel and/or at least a third of the height of the wall formed by the wall panel, and the bracket may be connected to at least one floor panel and/or a truss. The bracket may be connected to a pair of adjacent floor panels proximate a seam between the adjacent floor panels.

If desired, the bracket 114 may also be connected to one or more roof panels, which may also help increase the strength and rigidity of the shed. The brackets 114 may be connected to wall panels, floor panels, trusses, and/or roof panels by one or more fasteners, but the brackets could also be attached by other suitable means such as adhesives or a snap, friction or interference fit.

Figure 39:
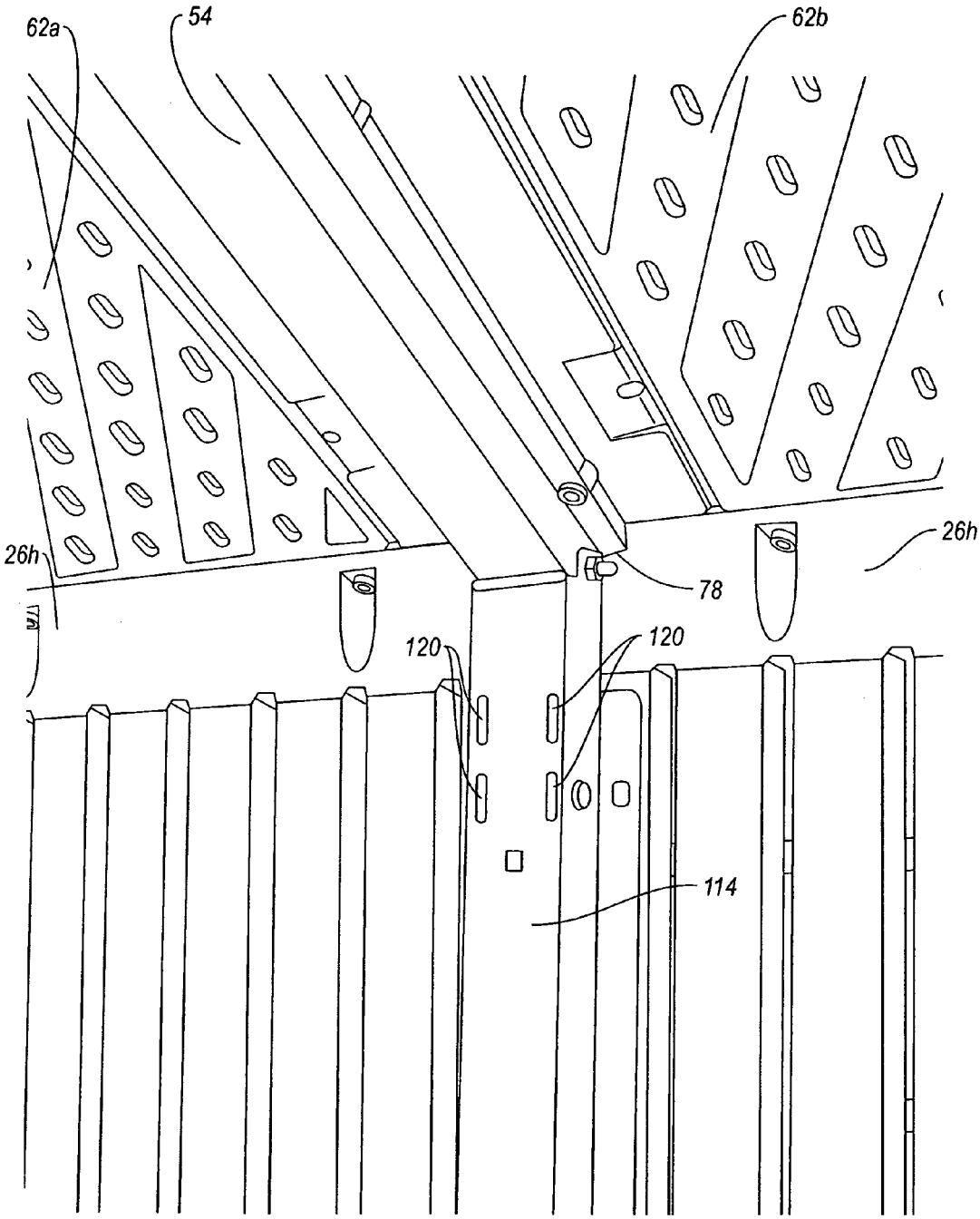
FIG. 39 is a perspective view of an exemplary connection of a bracket, a truss and a wall panel.

As shown in FIG. 39, the bracket 114 may be connected to a wall panel (such as the wall panel **26*h*) proximate a generally central portion of the wall panel. Accordingly, the bracket 114 may be spaced apart from the wall panel's edges that are connected to adjacent wall panels. Thus, the bracket 114 may be spaced apart from the seams created between the wall panel and the adjacent wall panels. Spacing the bracket 114** apart from the seams between adjacent wall panels may also help increase the strength and rigidity of the shed.

The brackets 114, however, need not be spaced apart from the seams between adjacent wall panels. For example, a bracket 114 may be used to connect two or more wall panels, and the bracket may extend along at least a substantial portion of the length of the seam between the wall panels. In particular, the bracket 114 may extend along at least a third of the length of the seam between the wall panels. As best shown in FIGS. 35-38, the bracket 114 may include a first attachment portion (such as a flange) that may be attached to a first wall panel and a second attachment portion (such as a flange) that may be attached to a second wall panel. The bracket 114 may be spaced apart from an exterior surface of the walls of the shed and, in particular, connected to an interior surface of the wall panels. Advantageously, the bracket 114 may help prevent items or objects from undesirably entering the shed. For example, the bracket 114 may help prevent water or dust from entering the shed. In addition, the bracket 114 may provide a strong and secure connection between the wall panels. It will be appreciated that the bracket 114 need not be connected to a truss, a floor panel, a roof panel or other portions of the shed and that the bracket may be connected to merely the wall panels, if desired.

As shown in FIGS. 35-40, the bracket 114 may include one or more openings 120 that may be sized and configured to allow shelves to be attached. Thus, shelves may be directly attached to the brackets 114, which may allow a strong and sturdy shelf to be constructed. To help install the shelves, one or more shelf braces or supports may be inserted into the openings 120, and the shelves may rest upon and/or be connected to the shelf braces or supports. It will be appreciated that the openings 120 may also allow other types of structures, such as peg boards, to be directly attached to the brackets 114.

The bracket 114 preferably has a generally U-shaped configuration and it is preferably constructed from a relatively strong and rigid material such as metal. In particular, the bracket 114 may be constructed from steel and it may include a powder-coated finish, but the bracket could be constructed from any suitable type of material and it could have other shapes and configurations, if desired. It will be appreciated that the brackets 114 may have other suitable shapes and configurations, and may be connected to any desired portions of the shed. The brackets 114, however, are not required.

Exemplary Wall to Floor Connection

As discussed above, the floor panels are preferably directly connected to the wall and corner panels, which may facilitate construction of a strong and sturdy shed. In particular, the wall and the corner panels may include outwardly extending protrusions (such as protrusions 44) that are sized and configured to be connected to receiving portions in the floor panels. As shown in FIGS. 27-30, the floor panels 94, 96, 98 may include one or more receiving portions 122 sized and configured to be connected to the protrusions 44 of the wall and corner panels. The receiving portions 122 may include a first part that is sized and configured to initially receive a protrusion 44 and a second part that is sized and configured to retain the protrusion in a generally fixed position. In particular, the receiving portions 122 may include a generally keyhole-shaped configuration with an enlarged first part 124 and a smaller second part 126. Preferably, the protrusion is initially received into the enlarged part 124 and the protrusion is moved or slid into the smaller part 126. Advantageously, the protrusions of the wall and corner panels may be connected to the receiving portions 124 of the floor panels by a friction, snap or interference fit, if desired. It will be appreciated that other portions of the shed may be connected in a similar manner or any other appropriate manner.

If desired, a floor panel may be connected to a plurality of wall and corner panels. For example, the floor panel may include a first set of one or more receiving portions 122 and a second set of one or more receiving portions 122. The first set may be connected to one or more protrusions 44 of a first wall or corner panel, and the second set may be connected to one or more protrusions 44 of a second wall or corner panel.

If desired, a wall or corner panel may be connected to a plurality of floor panels. For example, the wall or corner panel may include a first set of one or more protrusions 44 and a second set of one or more one or more protrusions 44. The first set may be connected to one or more receiving portions 122 of a first floor panel, and the second set may be connected to one or more receiving portions 122 of a second floor panel.

Exemplary Corners

As discussed above, the shed 10 may include corner panels with a first portion and a second portion that are joined by a living hinge. The shed 10, however, does not require corner panels with a living hinge. For example, the shed 10 could include two corner and/or wall panels that are positioned at an angle to form a corner. One or more brackets, caps, coverings or the like may be used to connect these panels and/or form a portion of the corner. Advantageously, a cover may be disposed at the corner and the cover may be used to connect the panels and/or the cover may be simply for aesthetic or design reasons.

Figure 40:
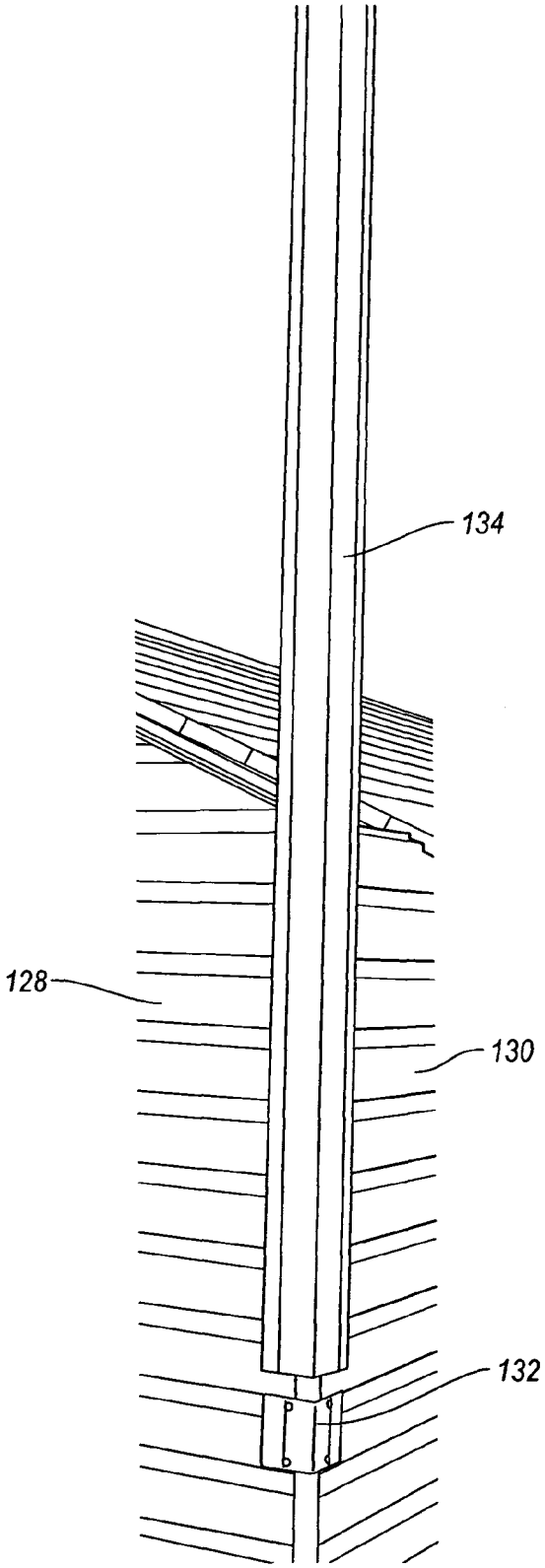
FIG. 40 is a perspective view of an exemplary embodiment of a bracket and a cover that may be used in connection with a shed.
Figure 41:
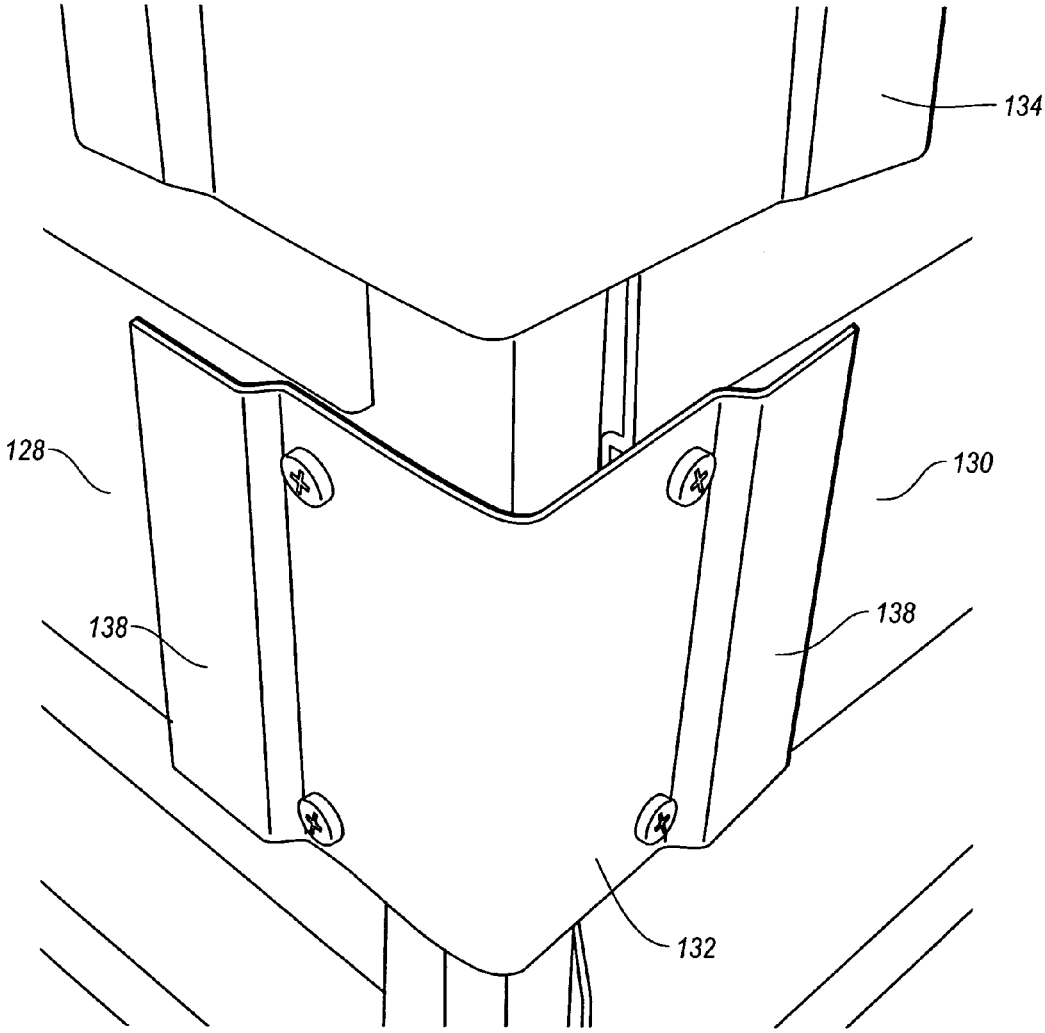
FIG. 41 is an enlarged perspective view of a portion of the shed shown in FIG. 40.

In greater detail, as shown in FIGS. 40-41, two panels 128, 130 may be used to form a corner of the shed 10, and one or more brackets (such as brackets 132) may be positioned on the interior portion of the shed and/or the exterior portion of the shed. The brackets preferably have a generally L-shaped configuration and the brackets are preferably constructed from a relatively strong material such as metal. Advantageously, the brackets may extend along all or a portion of the corner. The panels 128, 130 are preferably disposed at about a 90 degree angle relative to each other; however, the panels may be disposed at greater or lesser angles, if desired. The brackets are preferably connected to the panels by fasteners, but the brackets could be attached by any suitable means.

Figure 42:
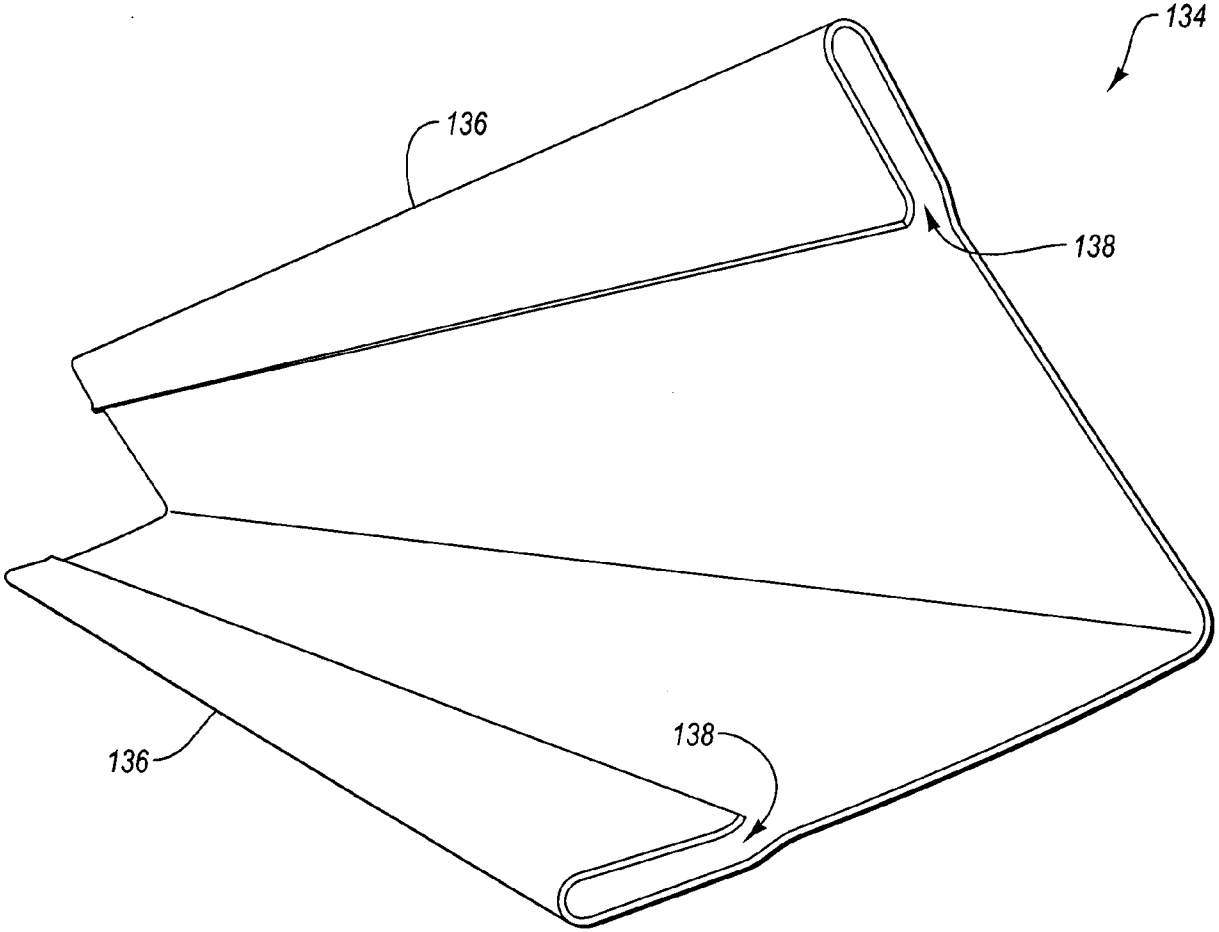
FIG. 42 is an enlarged perspective view of the cover shown in FIG. 40.

As discussed above, a cover may be attached to or form part of the corner. As shown in FIGS. 40-42, a cover 134 may be sized and configured to be connected to one or more of the brackets 132. Preferably, the cover 134 is sized and configured to slidably or otherwise movably connected to the brackets 132. In particular, the cover 134 may include one or more folds 136 that form one or more receiving portions 138 sized and configured to receive and/or retain at least a portion of the brackets 132, such as flanges 138. It will be appreciated that the cover need not be slidably or otherwise movably connect to the brackets 132 and that the cover may be connected to the brackets in any other suitable fashion.

The panels 128, 130 may be disposed adjacent each other and may form a seam between the panels. The cover 134 may advantageously be disposed along at least a portion of the seam between the panels 128, 130.

Advantageously, the cover 134 may help protect the brackets from adverse weather conditions, prevent water from entering the shed and/or provide a more aesthetically pleasing appearance. It will be appreciated that the bracket 132 and cover 134 may have other suitable shapes and configurations, and may be constructed from other materials with suitable characteristics.

Compensating for Changes in Panel Size

As discussed above, roof panels and floor panels may have generally the same width. This may advantageously facilitate the above-discussed offset configuration of panels that may strengthen the shed 10.

The dimensions of these panels may change depending, for example, upon the particular temperature of the panels, the material used to construct the panels, the shape and configuration of the panels and/or other factors. Consequently, the dimensions of the roof panels, the floor panels and the wall panels may change disproportionately to each other because these panels may be subjected to different temperatures and may have different shapes and configurations.

As discussed below, the shed 10 may include a variety of features that advantageously accommodate these disproportionate changes in dimensions. For example, as shown in FIG. 27-30, the floor panels 94, 96, 98 may include receiving portions 122 that accommodate disproportionate changes in panel dimensions while remaining connected to the protrusions 44 of wall and corner panels. In particular, the smaller part 126 of the receiving portions 122 preferably has an elongated shape. The elongated shape may allow the wall or corner panel and the floor panel to remain connected, while permitting an amount of movement of the protrusions 44 along the elongated smaller part 126. The permitted amount of movement may be sized and configured to accommodate disproportionate changes in panel dimensions.

Also, for example, as shown in FIGS. 27-29 and 43-44, the floor panels 94, 96, 98 may include protrusions 140 that may be inserted into corresponding recessed portions 142 of adjacent panels. To maintain adjacent floor panels in a generally fixed relative position, the protrusions 140 may include a locking member 144 that may be inserted to a receiving portion 146 of the recessed portion 142. The locking members 144 and the receiving portions 146 preferably have elongated configurations. The receiving portions 146 preferably have a greater width than the width of the locking members 144, which may advantageously allow the receiving portions and the locking members remain to connected while permitting an amount of relative movement. The permitted amount of movement may be sized and configured to accommodate disproportionate changes in panel dimensions.

Further, for example, the roof panels may be sized to have a slightly smaller width than the wall panels. This may provide a slight gap between adjacent roof panels. The gap may advantageously allow the roof panels to expand disproportionately to the wall panels.

Exemplary Door Locations

As discussed above, the shed 10 may include one or more doors and the shed may be expandable. For example, the length of the shed 10 may be increased by increasing the number of wall panels. Advantageously, a door may also be added when increasing the size of the shed 10. This may allow, for example, easier access to various portions of the shed 10. Additionally, as discussed above, the doors may be located in various suitable positions. For example, the doors may be located at an end of the shed as shown in FIG. 1. In addition, the doors may be located along the sides 16, 18 of the shed. Of course, the shed 10 could also include doors located on both the ends and sides, or other appropriate portions of the shed. The shed may also include any suitable number and configuration of doors depending, for example, upon the size and intended use of the shed.

Advantageously, the shed may have a variety of suitable shapes, sizes, configuration and features, such as disclosed in U.S. patent application Ser. No. 11/091,848, entitled MODULAR ENCLOSURE, which was filed on Mar. 28, 2005; U.S. patent application Ser. No. 10/890,601, entitled PARTITION SYSTEM, which was filed on Jul. 14, 2004; U.S. Design patent application Ser. No. 29/202,299, entitled SHED, which was filed on Mar. 29, 2004; U.S. Design patent application Ser. No. 29/202,291, entitled SHED CONSTRUCTED FROM BLOW-MOLDED PLASTIC, which was filed on Mar. 29, 2004; U.S. Design patent application Ser. No. 29/202,267, entitled EXTERIOR SURFACES OF A SHED, which was filed on Mar. 29, 2004; U.S. Design patent application Ser. No. 29/202,397, entitled DEVICE FOR ATTACHING PEGBOARD TO A SURFACE, which was filed on Mar.

29, 2004; U.S. Design patent application Ser. No. 29/204,812, entitled EXTERIOR PORTIONS OF A SHED, which was filed on May 3, 2004; U.S. Design patent application Ser. No. 29/204,811, entitled EXTERIOR PORTIONS OF A SHED, which was filed on May 3, 2004; each of which is expressly incorporated by reference in its entirety.

Although this invention has been described in terms of certain preferred embodiments, other embodiments apparent to those of ordinary skill in the art are also within the scope of this invention.

What is claimed is:

1. A modular enclosure constructed from a plurality of blow-molded plastic panels, the modular enclosure comprising:

a first blow-molded plastic roof panel including an outer surface, an inner surface and a hollow interior portion that are integrally formed as part of a unitary, one-piece construction, the first blow-molded plastic roof panel extending beyond an outer wall of the modular enclosure;

a second blow-molded plastic roof panel including an outer surface, an inner surface and a hollow interior portion that are integrally formed as part of a unitary, one-piece construction, the second blow-molded plastic roof panel extending beyond the outer wall of the modular enclosure and cooperating with the first blow-molded plastic roof panel to define a roof seam;

a truss comprising a support beam that includes a first flange supporting the first roof panel, a second flange supporting the second roof panel and a generally U-shaped body disposed between the first flange and the second flange, the body including a first sidewall, a second sidewall and a connecting portion, the U-shaped body extending beyond the outer wall and having an open end positioned beyond the outer wall, and the U-shaped body positioned underneath the seam and at least partly exposed to the environment such that moisture passing through the seam is collected by the truss and directed out the open end of the U-shaped body;

a first blow-molded plastic wall panel including an outer surface that forms a portion of the outer wall, an inner surface and a hollow interior portion that are integrally formed as part of a unitary, one-piece construction; and a support member comprising a first flange supporting the wall panel, a second flange supporting the first wall panel and a generally U-shaped body disposed between the first flange and the second flange, the body including a first sidewall, a second sidewall and a connecting portion, the first sidewall of the body of the support member connected to the first sidewall of the body of the truss, the second sidewall of the body of the support member connected to the second sidewall of the body of the truss.

2. The modular enclosure as in claim 1, wherein the support member is spaced apart from the outer surface of the first wall panel, the outer surface of the first roof panel and the outer surface of the second roof panel;

wherein the support member is connected to an inner surface of the first wall panel.

3. The modular enclosure as in claim 1, further comprising a fastener connecting the generally U-shaped body of the support beam and the generally U-shaped body of the support member.

4. The modular enclosure as in claim 1, wherein the first sidewall of the support beam engages the first sidewall of the support member;

wherein the second sidewall of the support beam engages the second sidewall of the support member; and wherein the connecting portion of the support beam is disposed at least proximate the connecting portion of the support member.

5. The modular enclosure as in claim 1, further comprising a first blow-molded plastic floor panel including an outer surface, an inner surface and a hollow interior portion that are integrally formed as part of a unitary, one-piece construction;

wherein an upper end of the support member is connected to the truss; and wherein a lower end of the support member is connected to the first floor panel.

6. The modular enclosure as in claim 1, wherein the first wall panel includes an engagement surface on the inner wall; and wherein the first flange of the support member includes a first engagement surface that engages the engagement surface of the first wall panel; and wherein the support member is spaced apart from the outer surface of the first wall panel by a first distance.

7. The modular enclosure as in claim 1, wherein the first wall panel includes an engagement surface on the inner wall;

wherein a second wall panel includes an engagement surface on the inner wall;

wherein the first flange of the support member includes an engagement surface that engages the engagement surface of the first wall panel;

wherein the second flange of the support member includes an engagement surface that engages the engagement surface of the second wall panel.

8. The modular enclosure as in claim 1, wherein the U-shaped body of the support beam is spaced apart from the roof seam by a distance; and further comprising a wall seam disposed between the first wall panel and a second wall panel, the body of the support member being spaced apart from the wall seam by generally the same distance as the distance between the U-shaped body of the support beam and the roof seam.

9. The modular enclosure as in claim 1, wherein the first support member is positioned proximate a central portion of the first wall panel.

10. The modular enclosure as in claim 1, wherein an outer edge of the first flange of the support beam is generally aligned with an outer edge of the first flange of the support member;

wherein an outer edge of the second flange of the support beam is generally aligned with an outer edge of the second flange of the support member; and wherein the U-shaped body of the support beam is generally aligned with the body of the support member.

11. The modular enclosure as in claim 1, wherein the first flange of the support beam is generally aligned with and spaced apart from the first flange of the support member by a first distance; and wherein the second flange of the support beam is generally aligned with and spaced apart from the second flange of the support member by a second distance.

12. The modular enclosure as in claim 1, wherein the entire support member is spaced apart from the outer surface of the first wall panel by a distance at least equal to a thickness of the outer surface of the first wall panel, a thickness of the interior portion of the first wall panel and a thickness of the inner surface of the first wall panel.

13. The modular enclosure as in claim 1, further comprising a first blow-molded plastic floor panel connected to the first wall panel, the support member providing a contiguous support structure between the first floor panel, the first wall panel, the first roof panel and the second roof panel.

14. The modular enclosure as in claim 1, further comprising a first blow-molded plastic floor panel connected to the first wall panel, the support member providing a contiguous support structure between the first floor panel, the first wall panel, the first roof panel and the second roof panel.

15. The modular enclosure as recited in claim 1, further comprising:

a second blow-molded plastic wall panel including an outer surface, an inner surface and a hollow interior portion that are integrally formed as part of a unitary, one-piece construction; and a first bracket comprising:

a first engagement portion connected to the first wall panel;

a second engagement portion connected to the second wall panel, the first engagement portion being disposed at approximately a ninety degree angle to the second engagement portion;

a first flange extending outwardly from the first engagement portion, the first flange disposed generally parallel to the first engagement portion; and a second flange extending outwardly from the second engagement portion, the second flange disposed generally parallel to the second engagement portion; and a cover connected to the first bracket, the cover being constructed from an integral, one-piece construction, the cover comprising:

a first portion that covers the first engagement portion of the first bracket;

a second portion that covers the second engagement portion of the first bracket, the first portion being disposed at approximately a ninety degree angle to the second portion;

a first receiving portion formed by an inwardly folded section of the first portion of the cover, the first flange of the first bracket being disposed within the first receiving portion; and a second receiving portion formed by an inwardly folded section of the second portion of the cover, the second flange of the first bracket being disposed within the second receiving portion.

16. The modular enclosure as in claim 15, wherein the first portion of the first bracket is connected to the outer surface of the first wall panel; and wherein the second portion of the first bracket is connected to the outer surface of the second wall panel.

17. The modular enclosure as in claim 15, further comprising a second bracket, the second bracket comprising a first engagement portion connected to the first wall panel, a second engagement portion connected to the second wall panel, the first engagement portion being disposed at approximately a ninety degree angle to the second engagement portion, a first flange extending outwardly from the first engagement portion, the first flange disposed generally parallel to the first engagement portion, and a second flange extending outwardly from the second engagement portion, the second flange disposed generally parallel to the second engagement portion.

18. The modular enclosure as in claim 17, wherein the first portion of the cover covers the first engagement portion of the second bracket, the second portion of the cover covers the second engagement portion of the bracket, the first flange of the second bracket is disposed within the first receiving portion, and the second flange of the second bracket is disposed within the second receiving portion.

19. The modular enclosure as in claim 15, further comprising a support member with a first engagement surface engaging an engagement surface on the inner surface of the first wall panel, a second engagement surface engaging an engagement surface on the inner surface of the second panel, the entire support member being spaced apart from the outer surface of the first wall panel and the outer surface of the second wall panel by a distance.

20. The modular enclosure as in claim 15, wherein the first receiving portion of the cover is disposed generally parallel to the first portion of the cover and the second receiving portion of the cover is disposed generally parallel to the second portion of the cover.

21. The modular enclosure of claim 1, wherein the truss further comprises:

an additional support beam that cooperates with the support beam to define an apex of the truss;

a first bracket located proximate the apex and connected to the support beam and the additional support beam;

a second bracket having first and second ends, the first end connected to the first bracket; and a rafter connected at a first end to the support beam and connected at a second end to the additional support beam, and the second end of the second bracket being connected to the rafter proximate a midpoint of the rafter.

22. The modular enclosure as in claim 15, wherein the first portion of the first bracket is connected to the inner surface of the first wall panel; and wherein the second portion of the first bracket is connected to the inner surface of the second wall panel.

* * * * *

UNITED STATES PATENT AND TRADEMARK OFFICE

CERTIFICATE OF CORRECTION

PATENT NO. : 8,020,347 B2
APPLICATION NO. : 11/432825
DATED : September 20, 2011
INVENTOR(S) : Mower et al.

It is certified that error appears in the above-identified patent and that said Letters Patent is hereby corrected as shown below:

Page 3, Item 56, References Cited, U.S. PATENT DOCUMENTS, Left Hand Column
Change the reference "D481,138 S 10/2003 Carling et al." to --D481,138 S 10/2003 Forster et al--

Column 2
Line 18, change "constructed" to --construct--

Column 4
Line 6, change "increasing" to --increase--

Column 5
Line 24, before "may" insert --and--
Line 32, change "assembly" to --assemble--
Line 61, after "components" insert --are--
Line 64, change "by" to --be--

Column 6
Line 14, change "assembly" to --assemble--
Line 46, after "so that" remove [is a]

Column 7
Line 56, change "limits" to --limit--

Column 8
Line 17, change "exemplary a connection" to --exemplary connection--

Column 11
Line 27, change "that shed" to --that the shed--

Signed and Sealed this
Third Day of April, 2012

David J. Kappos

David J. Kappos
*Director of the United States Patent and Trademark Office*

Column 12
Line 11, change "wall panels 26*a-h*" to --wall panel 26*a-h*--
Line 19, change "wall panels 26*a-h*" to --wall panel 26*a-h*--
Line 20, change "corner panels 28*a-d*" to --corner panel 28*a-d*--
Line 21, change "wall panels 26*a-h*" to --wall panel 26*a-h*--
Lines 22-23, change "corner panels 28*a-d*" to --corner panel 28*a-d*--
Line 42, change "walls" to --wall--
Line 64, change "that" to --than--

Column 13
Line 36, change "complimentary" to --complementary--

Column 14
Line 24, change "shed," to --sheds,--

Column 16
Line 18, change "It-" to --It--
Line 38, change "of thicker" to --of a thicker--
Line 43, change "One or ordinary" to --One of ordinary--
Line 44, change "appreciated" to --appreciate--

Column 17
Line 49, change "portion the truss" to --portion of the truss--
Line 63, change "from a relatively few parts" to --from relatively few parts--

Column 18
Line 22, change "as the as the" to --as the--

Column 19
Line 28, change "patter" to --pattern--

Column 21
Line 8, change "assembly" to --assemble--

Column 22
Line 3, change "office" to --office.--

Column 23
Line 5, before "be disposed" remove [have may]
Line 20, change "connected the" to --connected to the--
Line 29, change "reinforcing members 48" to --reinforcing members 148--
Line 37, change "bracket be connected" to --bracket to be connected--

Column 25
Line 38, change “connected to” to --connect to--

Column 26
Line 28, change “remain to connected” to --to remain connected--